US010002694B2

(12) United States Patent
Wang et al.

(10) Patent No.: US 10,002,694 B2
(45) Date of Patent: Jun. 19, 2018

(54) INDUCTOR INCLUDING ALPHA"-FE16Z2 OR ALPHA"-FE16(NXZ1-X)2, WHERE Z INCLUDES AT LEAST ONE OF C, B, OR O

(71) Applicant: Regents of the University of Minnesota, Minneapolis, MN (US)

(72) Inventors: Jian-Ping Wang, Shoreview, MN (US); Yanfeng Jiang, Minneapolis, MN (US); Md Aminul Mehedi, Minneapolis, MN (US)

(73) Assignee: Regents of the University of Minnesota, Minnepolis, MN (US)

( * ) Notice: Subject to any disclaimer, the term of this patent is extended or adjusted under 35 U.S.C. 154(b) by 0 days. days.

(21) Appl. No.: 14/821,520

(22) Filed: Aug. 7, 2015

(65) Prior Publication Data

US 2016/0042846 A1 Feb. 11, 2016

Related U.S. Application Data

(60) Provisional application No. 62/035,184, filed on Aug. 8, 2014.

(51) Int. Cl.
*H01F 1/03* (2006.01)
*H01F 17/00* (2006.01)
(Continued)

(52) U.S. Cl.
CPC ..... *H01F 1/0302* (2013.01); *H01F 17/0006* (2013.01); *H01F 41/046* (2013.01); *H01F 1/065* (2013.01); *H01F 17/0013* (2013.01)

(58) Field of Classification Search
None
See application file for complete search history.

(56) References Cited

U.S. PATENT DOCUMENTS 5,032,947 A 7/1991 Li et al.
5,068,147 A 11/1991 Hori et al.
(Continued)

FOREIGN PATENT DOCUMENTS

CN 1156516 A 8/1997
CN 1621549 A 6/2005
(Continued)

OTHER PUBLICATIONS

Slater, "Electronic Structure of Alloys," Journal of Applied Physics, vol. 8, No. 6, Jun. 1937, 8 pp.
(Continued)

*Primary Examiner* — Kevin M Bernatz
(74) *Attorney, Agent, or Firm* — Shumaker & Sieffert, P.A.

(57) ABSTRACT

An inductor may include a magnetic material that may include $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$, where Z includes at least one of C, B, or O, and x is a number greater than zero and less than one. In some examples, the magnetic material may include a relatively high magnetic saturation, such as greater than about 200 emu/gram, greater than about 242 emu/gram, or greater than about 250 emu/gram. In addition, in some examples, the magnetic material may include a relatively low coercivity or magnetocrystalline anisotropy. Techniques for forming the inductor including the magnetic material are also described.

33 Claims, 17 Drawing Sheets

(51) Int. Cl.
*H01F 41/04* (2006.01)
*H01F 1/06* (2006.01)

(56) References Cited

U.S. PATENT DOCUMENTS

| | | | | |
|---|---|---|---|---|
| 5,137,588 | A | 8/1992 | Wecker et al. | |
| 5,330,554 | A | 7/1994 | Koyano et al. | |
| 5,449,417 | A | 9/1995 | Shimizu et al. | |
| 5,617,275 | A * | 4/1997 | Ogura | G11B 5/1276 360/125.35 |
| 6,139,765 | A | 10/2000 | Kitazawa et al. | |
| 6,217,672 | B1 | 4/2001 | Zhang | |
| 6,319,485 | B1 | 11/2001 | Nagatomi et al. | |
| 6,457,629 | B1 | 10/2002 | White | |
| 6,778,358 | B1 | 8/2004 | Jiang et al. | |
| 6,841,259 | B1 * | 1/2005 | Takahashi | B82Y 10/00 428/812 |
| 7,238,439 | B2 | 7/2007 | Sasaki et al. | |
| 9,715,957 | B2 | 1/2017 | Wang et al. | |
| 2002/0117102 | A1 | 8/2002 | Takahashi et al. | |
| 2002/0191354 | A1 | 12/2002 | Yoshikawa et al. | |
| 2002/0197530 | A1 | 12/2002 | Tani et al. | |
| 2004/0247859 | A1 | 12/2004 | Sasaki et al. | |
| 2005/0208320 | A1 | 9/2005 | Masada et al. | |
| 2006/0105170 | A1 | 5/2006 | Dobson et al. | |
| 2006/0112873 | A1 | 6/2006 | Uchida et al. | |
| 2008/0166584 | A1 | 7/2008 | Deligianni et al. | |
| 2009/0042063 | A1 | 2/2009 | Inoue et al. | |
| 2009/0087688 | A1 | 4/2009 | Masaki | |
| 2010/0035086 | A1 | 2/2010 | Inoue et al. | |
| 2010/0104767 | A1 | 4/2010 | Sskuma et al. | |
| 2010/0288964 | A1 | 11/2010 | Pirich et al. | |
| 2011/0059005 | A1 | 3/2011 | Sankar et al. | |
| 2011/0074531 | A1 | 3/2011 | Yamashita et al. | |
| 2012/0090543 | A1 | 4/2012 | Cheong | |
| 2012/0145944 | A1 | 6/2012 | Komuro et al. | |
| 2012/0153212 | A1 * | 6/2012 | Liu | B22F 1/0018 252/62.55 |
| 2013/0126775 | A1 | 5/2013 | Abe et al. | |
| 2013/0140076 | A1 | 6/2013 | Lee et al. | |
| 2014/0001398 | A1 | 1/2014 | Takahashi et al. | |
| 2014/0008446 | A1 * | 1/2014 | Carr | H01Q 1/248 235/492 |
| 2014/0290434 | A1 | 10/2014 | Matthiesen | |
| 2014/0294657 | A1 | 10/2014 | Yamamoto et al. | |
| 2014/0299810 | A1 | 10/2014 | Wang et al. | |
| 2015/0380135 | A1 * | 12/2015 | Wang | H01F 1/055 428/220 |
| 2015/0380158 | A1 | 12/2015 | Brady et al. | |
| 2016/0042846 | A1 | 2/2016 | Wang et al. | |
| 2016/0042849 | A1 * | 2/2016 | Wang | C22C 38/002 420/121 |
| 2016/0141082 | A1 | 5/2016 | Wang et al. | |
| 2016/0189836 | A1 | 6/2016 | Takahashi et al. | |
| 2017/0186518 | A1 * | 6/2017 | Wang | H01F 1/047 |
| 2017/0243680 | A1 | 8/2017 | Wang et al. | |

FOREIGN PATENT DOCUMENTS

| | | | |
|---|---|---|---|
| CN | 102576591 | A | 7/2012 |
| CN | 103339694 | A | 10/2013 |
| CN | 103827986 | A | 5/2014 |
| CN | 105849834 | A | 8/2016 |
| EP | 0509361 | A2 | 10/1992 |
| EP | 0633581 | A1 | 1/1995 |
| EP | 0994493 | A2 | 4/2000 |
| EP | 1548760 | A2 | 6/2005 |
| EP | 1675133 | A2 | 6/2006 |
| EP | 2492927 | A1 | 8/2012 |
| EP | 2666563 | A1 | 11/2013 |
| EP | 2696356 | A1 | 2/2014 |
| JP | S61143557 | A | 7/1986 |
| JP | S61157634 | A | 7/1986 |
| JP | S62232101 | A | 10/1987 |
| JP | S63132701 | A | 6/1988 |
| JP | H02173209 | A | 7/1990 |
| JP | H02212320 | A | 8/1990 |
| JP | H03100124 | A | 4/1991 |
| JP | H04217305 | A | 8/1992 |
| JP | H05269503 | A | 10/1993 |
| JP | H05311390 | A | 11/1993 |
| JP | H05326239 | A | 12/1993 |
| JP | H0696947 | A | 4/1994 |
| JP | H06267722 | A | 9/1994 |
| JP | H06311390 | A | 11/1994 |
| JP | 2000176513 | A | 6/2000 |
| JP | 2001135508 | A | 5/2001 |
| JP | 2001176715 | A | 6/2001 |
| JP | 2002334695 | A | 11/2002 |
| JP | 2004319923 | A | 11/2004 |
| JP | 2005183932 | A | 7/2005 |
| JP | 2006155894 | A | 6/2006 |
| JP | 2007070669 | A | 3/2007 |
| JP | 2007273038 | A | 10/2007 |
| JP | 2008311518 | A | 12/2008 |
| JP | 2009259402 | A | 11/2009 |
| JP | 2012190156 | A | 10/2012 |
| JP | 2012193409 | A | 10/2012 |
| JP | 2012246174 | A | 12/2012 |
| JP | 2013069926 | A | 4/2013 |
| JP | 2013080922 | A | 5/2013 |
| JP | 2013102122 | A | 5/2013 |
| KR | 1020120091091 | A | 8/2012 |
| TW | 272293 | B | 3/1996 |
| TW | I303072 | B | 11/2008 |
| TW | 201249564 | A | 12/2012 |
| TW | 201447934 | A | 12/2014 |
| WO | WO 2011049080 | A1 | 4/2011 |
| WO | WO 2012159096 | A2 | 11/2012 |
| WO | WO 2013026007 | A2 | 2/2013 |
| WO | WO 2013042721 | A1 | 3/2013 |
| WO | WO 2013090895 | A1 | 6/2013 |
| WO | WO 2014124135 | A2 | 8/2014 |
| WO | WO 2014210027 | A1 | 12/2014 |
| WO | 2015148810 | A1 | 10/2015 |
| WO | 2016022685 | A1 | 2/2016 |
| WO | 2016022711 | A1 | 2/2016 |
| WO | 2016122712 | A1 | 8/2016 |
| WO | 2016122971 | A1 | 8/2016 |
| WO | 2016122987 | A1 | 8/2016 |

OTHER PUBLICATIONS

Kikkawa et al., "Fine Fe16N2 powder prepared by low-temperature nitridation," Materials Research Bulletin, vol. 43, ScienceDirect, Feb. 19, 2008, 8 pp.

Bogaerts et al., "Monte Carlo simulation of an analytical glow discharge: motion of electrons, ions and fast neutrals in the cathode dark space," Spectrochimica Acta, vol. 50B, No. 1, Jan. 1995, 20 pp.

Gagnoud et al., "Electromagnetic Modelling of Induction Melting Devices in Cold Crucible," IEEE Transactions on Magnetics, vol. 24, No. 1, Jan. 1988, 5 pp.

Sakuma, "Electronic and Magnetic Structure of Iron Nitride, Fe16N2 (invited)," Journal of Applied Physics, vol. 79, No. 8, Apr. 15, 1996, 8 pp.

Becke, "Density-Functional Exchange-Energy Approximation With Correct Asymptotic Behavior," Physical Review A General Physics, vol. 38, No. 6, Sep. 15, 1988, 4 pp.

Floris et al., "Vibrational Properties of MnO and NiO from DFT + U-Based Density Functional Perturbation Theory," Physical Review B Condensed Matter, vol. 84, Oct. 2011, 6 pp.

Liechtenstein et al., "Density-Functional Theory and Strong Interactions: Orbital Ordering in Mott-Hubbard Insulators," Physical Review B Condensed Matter, vol. 52, No. 8, Aug. 15, 1995, 5 pp.

Vasil'Ev et al., "Structural and Magnetic Phase Transitions in Shape-Memory Alloys Ni2+xMnl-xGa," Physical Review B: Condensed Matter and Materials Physics, vol. 59. No. 2, Jan. 1, 1999, pp. 1113-1120.

(56) References Cited

OTHER PUBLICATIONS

Sozinov et al., "Crystal Structures and Magnetic Anisotropy Properties of Ni-Mn-Ga Martensitic Phases With Giant Magnetic-Field-Induced Strain," IEEE Transactions on Magnetics, vol. 38, No. 5, Sep. 2002, pp. 2814-2816.
Zayak et al., "Switchable Ni-Mn-Ga Heusler nanocrystals," Journal of Applied Physics vol. 104, No. 7, Oct. 2008, 6 pp.
Likhachev et al., "Modeling the Strain Response, Magneto-Mechanical Cycling Under the External Stress, Work Output and Energy Losses in Ni-Mn-Ga," Mechanics of Materials, vol. 38, May 2006 pp. 551-563.
Morisako et al., "Magnetic Anisotropy and Soft Magnetism of Iron Nitride Thin Films Prepared by Facing-Target Sputtering," Journal of Applied Physics, vol. 69, No. 8, Apr. 15, 1991, pp. 5619-5621.
Jordan et al., "Magnetic Fluid Hyperthermia (MFH): Cancer Treatment with AC Magnetic Field Induced Excitation of Biocompatible Superparamagnetic Nanoparticles," Journal of Magnetism and Magnetic Materials vol. 201, Jul. 1, 1999 pp. 413-419.
Chakrabarti et al., "Influence of Ni Doping on the Electronic Structure of Ni2MnGa," Physical Review B vol. 72, Aug. 5, 2005, 4 pp.
Kirby et al., "Anomalous ferromagnetism in TbMnO3 thin films," Journal of Applied Physics, vol. 105, No. 7, Apr. 2009, 5 pp.
"2014 Titans of Technology—Jian-Ping Wang," Minneapolis/St. Paul Business Journal, Sep. 19, 2014, 18 pp.
Brady et al., "The Formation of Protective Nitride Surfaces for PEM Fuel Cell Metallic Bipolar Plates," Journal of the Minerals, Aug. 2006, pp. 50-57.
Himmetoglu, et al., "First-Principles Study of Electronic and Structural Properties of CuO," Physical Review B. vol. 84, Sep. 14, 2011, 8 pp.
Wedel et al., "Low Temperature Crystal Structure of Ni-Mn-Ga Alloys," Journal of Alloys and Compounds, vol. 290, Aug. 30, 1999 pp. 137-143.
Min, "Enhancement of Fe Magnetic Moments in Ferromagnetic Fe16B2, Fe16C2, and Fel6N2," International Journal of Modern Physics B. vol. 7, No. 1-3, Jan. 1993, pp. 729-732.
Bozorth, "Atomic Moments of Ferromagnetic Alloys," The Physical Review, vol. 79, No. 5, Sep. 1, 1950. pp. 887.
Rong et al., "Fabrication of Bulk Nanocomposite Magnets Via Severe Plastic Deformation and Warm Compaction," Applied Physics Letters, vol. 96, No. 10, Mar. 8, 2010, 3 pp.
Lorenz et al., "Precise Determination of the Bond Percolation Thresholds and Finite-Size Scaling Corrections for the sc, fcc, and bcc Lattices," Physical Review E, vol. 57, No. 1, Jan. 1998, pp. 230-236.
Majkrzak, "Polarized Neutron Reflectometry," Physica B: Condensed Matter, vol. 173, No. 1 & 2, Aug. 1991, 16 pp.
Opeil et al., "Combined Experimental and Theoretical Investigation of the Premartensitic Transition in Ni2MnGa," Physical Review Letters, vol. 100, Apr. 25, 2008, 4 pp.
Gao et al., "Quantitative Correlation of Phase Structure With the Magnetic Moment in rf Sputtered Fe-N Films," Journal of Applied Physics, vol. 73, No. 10, May 15, 1993, pp. 6579-6581.
Ortiz et al., "Epitaxial Fe16N2 Films Grown by Sputtering," Applied Physics Letters, vol. 65. No. 21, Nov. 21, 1994, pp. 2737-2739.
Cheng et al., "Tempering of Iron-Carbon-Nitrogen Martensites," Metallurgical Transactions A: Physical Metallurgy and Materials Science, vol. 23A, No. 4, Apr. 1992, pp. 1129-1145.
Chikazumi, "Physics of Ferromagnetism," Oxford Science Publications, Ed. 2, 1999, pp. 199-203. (Applicant points out, in accordance with MPEP 609.04(a), that the year of publication, 1999, is sufficiently earlier than the effective U.S. filing date, Aug. 8, 2014, so that the particular month of publication is not in issue.).
Wehrenberg et al., "Shock Compression Response of α"-Fe16N2 Nanoparticles," Journal of Applied Physics, vol. 111, No. 8, Apr. 23, 2012, 8 pp.
Ceperley et al., "Ground State of the Electron Gas by a Stochastic Method," Physical Review Letters, vol. 45, No. 7, Aug. 18, 1980, pp. 566-569.
Borsa et al., "Phase Identification of Iron Nitrides and Iron Oxy-Nitrides with Mössbauer Spectroscopy," Hyperfine Interactions, vol. 151/152, Dec. 2003, pp. 31-48.
Cook, "Strain Induced Martensite Formation in Stainless Steel," Metallurgical Transactions A, vol. 18A, No. 2, Feb. 1987, pp. 201-210.
Sun et al., "Epitaxial Single Crystal Fe16N2 Films Grown by Facing Targets Sputtering," Journal of Applied Physics, vol. 79, No. 8, Apr. 15, 1996, pp. 5440-5442.
Ping et al., "Partitioning of Ga and Co Atoms in a Fe3B/Nd2Fe14B Nanocomposite Magnet," Journal of Applied Physics, vol. 83, No. 12, Jun. 15, 1998, pp. 7769-7775.
Scherlis et al., "Simulation of Heme Using DFT +U: A Step Toward Accurate Spin-State Energetics," The Journal of Physical Chemistry, vol. 111, No. 25, Apr. 21, 2007, pp. 7384-7391.
Jugovic et al., "A Review of Recent Developments in the Synthesis Procedures of Lithium Iron Phosphate Powders," Journal of Power Sources, vol. 190, Feb. 6, 2009, pp. 538-544.
Fullerton et al., "Structure and Magnetic Properties of Exchange-Spring Sm-Co/Co Superlattices," Applied Physics Letters vol. 72, No. 3, Jan. 19, 1998, pp. 380-382.
Van Voorthuysen et al., "Low-Temperature Extension of the Lehrer Diagram and the Iron-Nitrogen Phase Diagram," Metallurgical and Materials Transactions A: Physical Metallurgy and Materials Science, vol. 33A, No. 8, Aug. 2002, pp. 2593-2598.
Kita et al., "Magnetic Properties of Core-Shell Type Fe16N2 Nanoparticles," Journal of Magnetism and Magnetic Materials, vol. 310, Nov. 21, 2006, pp. 2411-2413.
Kneller et al., "The Exchange-Spring Magnet: A New Material Principle for Permanent Magnets," IEEE Transaction on Magnetics, vol. 27, No. 4, Jul. 1991, pp. 3588-3600.
Lavernia et al., "The Rapid Solidification Processing of Materials: Science, Principles, Technology, Advances, and Applications," Journal of Material Science, vol. 45, Dec. 1, 2009, pp. 287-325.
Casoli et al., "Exchange-Coupled FePt/Fe Bilayers with Perpendicular Magnetization," IEEE Transactions on Magnetics, vol. 41, No. 10, Oct. 2005, pp. 3877-3879.
Zhou et al., "Phase Separation in LixFePO4 Induced by Correlation Effects," Physical Review B, vol. 69, May 12, 2004, 4 pp.
Zhou et al., "First-Principles Prediction of Redox Potentials in Transition-Metal Compounds with LDA+U," Physical Review B. vol. 70, Dec. 20, 2004, 8 pp.
Zhou et al., "The Li Intercalation Potential of LiMPO4 and LiMSiO4 Olivines with M=Fe, Mn, Co, Ni," Electrochemistry Communications, vol. 6, Sep. 25, 2004, pp. 1144-1148.
Zhou et al., "Configurational Electronic Entropy and the Phase Diagram of Mixed-Valence Oxides: The Case of LixFePO4," Physical Review Letters, vol. 97, Oct. 13, 2006, 4 pp.
Herzer, "Grain Size Dependence of Coercivity and Permeability in Nanocrystalline Ferromagnets," IEEE Transactions on Magnetics, vol. 26, No. 5, Sep. 1990, pp. 1397-1402.
Ludtka et al., "In Situ Evidence of Enhanced Transformation Kinetics in a Medium Carbon Steel Due to a High Magnetic Field," Scripta Materialia, vol. 51, Apr. 20, 2004, pp. 171-174.
Felcher, "Neutron Reflection as a Probe of Surface Magnetism," Physical Review B: Condensed Matter, vol. 24, No. 3, Aug. 1, 1981, pp. 1595-1598.
Speich et al., "Elastic Constants of Binary Iron-Base Alloys," Metallurgical Transactions, vol. 3, No. 8, Aug. 1972, pp. 2031-2037.
Fernando et al., "Magnetic Moment of Iron in Metallic Environments," Physical Review B, vol. 61, No. 1, Jan. 1, 2000, pp. 375-381.
Felcher, "Magnetic Depth Profiling Studies by Polarized Neutron Reflection," Physica B: Condensed Matter, vol. 192, Nos. 1 & 2, Oct. 1993, pp. 137-149.
Gaunt, "The Magnetic Properties of Platinum Cobalt Near the Equiatomic Composition Part II. Mechanism of Magnetic Hardening," The Philosophical Magazine, vol. 13, No. 123, Mar. 1966, pp. 579-588.

(56) References Cited

OTHER PUBLICATIONS

Takahashi et al., "α"-Fe16N2 Problem—Giant Magnetic Moment or Not," Journal of Magnetism and Magnetic Materials, vol. 208, No. 3, Jan. 11, 2000, pp. 145-157.
Shokrollahi et al., "Soft Magnetic Composite Materials (SMCs)," Journal of Materials Processing Technology, vol. 189, Feb. 20, 2007, pp. 1-12.
Sugita et al., "Magnetic and Electrical Properties of Single-Phase, Single-Crystal Fe16N2 Films Epitaxially Grown by Molecular Beam Epitaxy (Invited)," Journal of Applied Physics, vol. 79, No. 8, Apr. 15, 1996, pp. 5576-5581.
Takahashi et al., "Perpendicular Uniaxial Magnetic Anisotropy of Fe16N2(001) Single Crystal Films Grown by Molecular Beam Epitaxy," IEEE Transactions on Magnetics, vol. 35, No. 5, Sep. 1999, pp. 2982-2984.
Tanaka et al., "Electronic Band Structure and Magnetism of Fe16N2 Calculated by the FLAPW Method," Physical Review B: Condensed Matter and Materials Physics, vol. 62, No. 22, Dec. 1, 2000, pp. 15042-15046.
Zeng et al., "Exchange-Coupled Nanocomposite Magnets by Nanoparticle Self-Assembly," Nature, vol. 420, No. 6914, Nov. 28, 2002, pp. 395-398.
Du, "A Reevaluation of the Fe-N and Fe-C-N Systems," Journal of Phase Equilibria, vol. 14, No. 6, Aug. 24, 1993, pp. 682-693.
Jiang et al., "The Thermostability of the Fe16N2 Phase Deposited on a GaAs Substrate by Ion-Bean-Assisted Deposition," Journal of Physical Condensed Matter, vol. 6, Mar. 17, 1994, pp. L279-L282.
Jan et al., "Monte Carlo Simulations of Spin-1/2 Micelle and Microemulsion Models," Journal De Physique, vol. 49, No. 4, Apr. 1988, pp. 623-633.
Nelson, "Epitaxial Growth From the Liquid State and Its Application to the Fabrication of Tunnel and Laser Diodes," RCA Review, vol. 24, No. 4, Dec. 1963, pp. 603-615.
Shinno et al., "Effects of Film Thickness on Formation Processes of Fe16N2 in Nitrogen Ion-Implanted Fe Films," Surface and Coatings Technology vol. 103-104, May 1998, pp. 129-134.
Takahashi et al., "Ferromagnetic Resonance Studies of Fe16N2 Films with a Giant Magnetic Moment," Journal of Applied Physics, vol. 73, No. 10, May 15, 1993, pp. 6060-6062.
Shimba et al., "Preparation of Iron Nitride Fe16N2 Nanoparticles by Reduction of Iron Nitrate," J. Japan Inst. Metals, vol. 74, No. 3, 2010, 5 pp. (Applicant points out, in accordance with MPEP 609.04(a), that the year of publication, 2010, is sufficiently earlier than the effective U.S. filing date, Aug. 8, 2014, so that the particular month of publication is not in issue.).
Hook et al., "Magnetic Order," Solid State Physics, Ed. 2, Ch. 8, 1991, pp. 219-252. (Applicant points out, in accordance with MPEP 609.04(a), that the year of publication, 1991, is sufficiently earlier than the effective U.S. filing date, Aug. 8, 2014, so that the particular month of publication is not in issue.).
Hsu et al., "First-Principles Study for Low-Spin LaCoO3 with a Structurally Consistent Hubbard U," Physical Review B, vol. 79, Mar. 31, 2009, 9 pp.
Hsu et al., "Spin-State Crossover and Hyperfine Interactions of Ferric Iron in MgSiO3 Perovskite," Physical Review Letters, vol. 106, Mar. 18, 2011, 4 pp.
McCurrie, "Chapter 3: The Structure and Properties of Alinco Permanent Magnet Alloys," Handbook of Ferromagnetic Materials, vol. 3, 1982, 82 pp. (Applicant points out, in accordance with MPEP 609.04(a), that the year of publication, 1982, is sufficiently earlier than the effective U.S. filing date, Aug. 8, 2014, so that the particular month of publication is not in issue.).
Kulik et al., "Density Functional Theory in Transition-Metal Chemistry: A Self-Consistent Hubbard U Approach," Physical Review Letters, vol. 97, Sep. 8, 2006, 4 pp.
Bae et al., "Cost Effective Parallel-Branch Spiral Inductor with Enhanced Quality Factor and Resonance Frequency," Electronics and Telecommunications Research Institute, 2007, pp. 87-90. (Applicant points out, in accordance with MPEP 609.04(a), that the year of publication, 2007, is sufficiently earlier than the effective U.S. filing date, Aug. 8, 2014, so that the particular month of publication is not in issue.).
Galanakis et al., "Spin-Polarization and Electronic Properties of Half-Metallic Heusler Alloys Calculated from First Principles," Journal of Physics: Condensed Matter, vol. 19, No. 31, Jul. 3, 2007 (online), 16 pp.
Al-Omari et al., "Magnetic Properties of Nanostructured CoSm/FeCo Films," Physical Review B, vol. 52, No. 5, Aug. 1, 1995, pp. 3441-3447.
Mazin et al., "Insulating Gap in FeO: Correlations and Covalency," Physical Review B, vol. 55, No. 19, May 15, 1997, pp. 12822-12825.
Solovyev et al., "Corrected Atomic Limit in the Local-Density Approximation and the Electronic Structure of d Impurities in Rb," Physical Review B, vol. 50, No. 23, Dec. 15, 1994, pp. 16861-16871.
Campos et al., "Evaluation of the Diffusion Coefficient of Nitrogen in Fe4N1-x Nitride Layers During Microwave Post-Discharge Nitriding," Applied Surface Science, vol. 249, Dec. 30, 2004, pp. 54-59.
Borchers et al., "Observation of Antiparallel Magnetic Order in Weakly Coupled Co/Cu Multilayers," Physical Review Letters, vol. 82, No. 13, Mar. 29, 1999, pp. 2796-2799.
Takahashi et al., "Structure and Magnetic Moment of α"-Fe16N2 Compound Films: Effect of Co and H on Phase Formation (Invited)," Journal of Applied Physics, vol. 79, No. 8, Apr. 15, 1996, pp. 5564-5569.
Buschbeck et al., "Full Tunability of Strain Along the fcc-bcc Bain Path in Epitaxial Films and Consequences for Magnetic Properties," Physical Review Letters, vol. 103, Nov. 20, 2009, 4 pp.
Chakhalian et al., "Magnetism at the Interface Between Ferromagnetic and Superconducting Oxides," Nature Physics, vol. 2, Apr. 1, 2006, pp. 244-248.
Cui et al., "Phase Transformation and Magnetic Anisotropy of an Iron-Palladium Ferromagnetic Shape-Memory Alloy," Acta Materialia, vol. 52, No. 1, Jan. 5, 2004, 35-47.
Davies et al., "Anisotropy Dependence of Irreversible Switching in Fe/SmCo and FeNi/FePt Exchange Spring Magnet Films," Applied Physics Letters, vol. 86, No. 26, Jun. 27, 2005, 3 pp.
Herbst et al., "Neodymium-Iron-Boron Permanent Magnets," Journal of Magnetism and Magnetic Materials, vol. 100, Nos. 1-3, Nov. 1991, pp. 57-78.
Fidler et al., "Recent Developments in Hard Magnetic Bulk Materials," Journal of Physics: Condensed Matter, vol. 16, Jan. 23, 2004, pp. 455-470.
Haenl et al., "Room-Temperature Ferroelectricity in Strain SrTiO3," Nature, vol. 430, Aug. 12, 2004, pp. 758-761.
Hoppler et al., "Giant Superconductivity-Induced Modulation of the Ferromagnetic Magnetization in a Cuprate-Manganite Superlattice," Nature Materials, vol. 8, Apr. 2009, pp. 315-319.
Coey, "The Magnetization of Bulk α"-Fe16N2 (Invited)," Journal of Applied Physics, vol. 76, No. 19, Nov. 15, 1994, pp. 6632-6636.
Coey, "Magic Moments in Magnetism," Physics World, vol. 6, No. 8, Aug. 1993, pp. 25-26.
Qiu et al., "Tuning the Crystal Structure and Magnetic Properties of FePt Nanomagnets," Advanced Materials, vol. 19, Jun. 6, 2007, pp. 1703-1706.
Wang, "FePt Magnetic Nanoparticles and Their Assembly for Future Magnetic Media," Proceedings of the IEEE, vol. 96, No. 11, Nov. 2008, pp. 1847-1863.
Qiu et al., "Monodispersed and Highly Ordered L10 FePt Nanoparticles Prepared in the Gas Phase," Applied Physics Letters, vol. 88, May 9, 2006, 3 pp.
Qiu et al., "In Situ Magnetic Field Alignment of Directly Ordered L10 FePt Nanoparticles," Applied Physics Letters, vol. 89, Nov. 29, 2006, 3 pp.
Liu et al., "High Energy Products in Rapidly Annealed Nanoscale Fe/Pt Multilayers," Applied Physics Letters, vol. 72, No. 4, Jan. 26, 1998, pp. 483-485.

(56) References Cited

OTHER PUBLICATIONS

Wang et al., "Fabrication of Fe16N2 Films by Sputtering Process and Experimental Investigation of Origin of Giant Saturation Magnetization in Fe16N2," IEEE Transactions on Magnetics, vol. 48, No. 5, May 2012, pp. 1710-1717.
Shi et al., "Diamond-Like Carbon Films Prepared by Facing-Target Sputtering," Thin Solid Films, vols. 420-421, Dec. 2, 2002, pp. 172-175.
Jiang et al., "Improving Exchange-Spring Nanocomposite Permanent Magnets," Applied Physics Letters, vol. 85, No. 22, Nov. 29, 2004, pp. 5293-5295.
Zhou et al., "Permanent-Magnet Properties of Thermally Processed FePt and FePt-Fe Multilayer Films," IEEE Transactions on Magnetics, vol. 38, No. 5, Sep. 2002, pp. 2802-2804.
MacLaren, "Role of Alloying on the Shape Memory Effect in Ni2MnGa," Journal of Applied Physics, vol. 91, No. 10, May 15, 2002, pp. 7801-7803.
Perdew et al., "Self-Interaction Correction to Density-Functional Approximations for Many-Electron Systems," Physical Review B, vol. 23, No. 10, May 15, 1981, pp. 5048-5079.
Dong et al., "Shape Memory and Ferromagnetic Shape Memory Effects in Single-Crystal Ni2MnGa Thin Films," Journal of Applied Physics, vol. 95, No. 5, Mar. 1, 2004, pp. 2593-2600.
Bland et al., "Ferromagnetic Moments in Metastable Magnetic Films by Spin-Polarized-Neutron Reflection," Physical Review Letters, vol. 58, No. 12, Mar. 23, 1987, pp. 1244-1247.
Bland et al., "Layer Selective Magnetometry in Ultrathin Magnetic Structures by Polarised Neutron Reflection," Journal of Magnetism and Magnetic Materials, vol. 165, Jun. 1997, pp. 46-51.
Ji et al., "Elemental Specific Study on FeCo-Au nanoparticles," Bulletin of the American Physical Society, APS Meeting 2010, vol. 55, No. 2, Mar. 15-19, 2010, 1 pp.
Coey, "Permanent Magnet Applications Journal of Magnetism and Magnetic Materials," vol. 248, Apr. 24, 2002, pp. 441-456.
Zhang et al., "Polarizer angular dependence of spin transfer oscillation in magnetic tunnel junction," Bulletin of the American Physical Society, APS Meeting 2010, vol. 55, No. 2, Mar. 15-19, 2010, 1 pp.
Kronmüller et al., "Micromagnetic Analysis of the Magnetic Hardening Mechanisms in RE-Fe-B Magnets," Journal De Physique, C8, No. 12, Tome 49, Dec. 1988, 6 pp.
Chen et al., "Modeling of On-Chip Differential Inductors and Transformers/Baluns," IEEE Transactions on Electron Devices, vol. 54, No. 2, Feb. 2007, pp. 369-371.
Ji et al., "N Site Ordering Effect on Partially Ordered Fe16N2," Applied Physics Letters, vol. 98, No. 9, Feb. 28, 2011, 3 pp.
Ji et al., "Epitaxial High Saturation Magnetization FeN Thin Films on Fe(001) Seeded GaAs(001) Single Crystal Wafer Using Facing Target Sputterings," Journal of Applied Physics, vol. 109, No. 7, Apr. 2011, 6 pp.
Ji et al., "Theory of Giant Saturation Magnetization in α"-Fe16N2: Role of Partial Localization in Ferromagnetism of 3d Transition Metals," New Journal of Physics, vol. 12, Jun. 17, 2010, 8 pp.
Cho, "The Best Refrigerator Magnet Ever?," Science/AAAD News, Science Now, Mar. 19, 2010, retrieved from the internet http://news.sciencemag.org/physics/2010/03/best-refrigerator-magnet-ever?sms_ss=email, 2 pp.
Ji et al., "Perpendicular Magnetic Anisotropy and High Spin-Polarization Ratio in Epitaxial Fe-N Thin Films," Physical Review B, vol. 84, Dec. 14, 2011, 8 pp.
Jiang et al., "FeN Foils by Nitrogen Ion-Implantation," Journal of Applied Physics, vol. 115, Mar. 12, 2014, 3 pp.
Jiang et al., "9 T High Magnetic Field Annealing Effects on FeN Bulk Sample," Journal of Applied Physics, vol. 115, Mar. 13, 2014, 3 pp.
"International Energy Outlook 2013," U.S. Energy Information Administration, Jul. 2013, 312 pp.
Croat, "Current Status of Rapidly Solidified Nd-Fe-B Permanent Magnets," IEEE Transactions on Magnetics, vol. 25, No. 5, Sep. 1989, pp. 3550-3554.
Perdew et al., "Generalized Gradient Approximation Made Simple," Physical Review Letters, vol. 77, No. 18, Oct. 28, 1996, pp. 3865-3868.
Guo et al., "A Broadband and Scalable Model for On-Chip Inductors Incorporating Substrate and Conductor Loss Effects," IEEE Radio Frequency Integrated Circuits Symposium, Jun. 12-14, 2005, pp. 593-596.
Jack, "The Occurrence and the Crystal Structure of α"-Iron Nitride; A New Type of Interstitial Alloy Formed During the Tempering of Nitrogen-Martensite," Proceedings of the Royal Society of London, vol. 208, Sep. 24, 1951, pp. 216-224.
Yamanaka et al., "Humidity Effects in Fe16N2 Fine Powder Preparation by Low-Temperature Nitridation," Journal of Solid State Chemistry, vol. 183, Aug. 4, 2010, pp. 2236-2241.
Frisk, "A New Assessment of the Fe-N Phase Diagram" Calphad, vol. 11, No. 2, 1987, pp. 127-134. (Applicant points out, in accordance with MPEP 609.04(a), that the year of publication, 1987, is sufficiently earlier than the effective U.S. filing date, Aug. 8, 2014, so that the particular month of publication is not in issue.).
Nakajima et al., "Large Magnetization Induced in Single Crystalline Iron Films by High-Dose Nitrogen Implantation," Applied Physics Letters, vol. 56, No. 1, Jan. 1, 1990, pp. 92-94.
Nakajima et al., "Nitrogen-Implantation-Induced Transformation of Iron to Crystalline Fe16N2 in Epitaxial Iron Films," Applied Physics Letters, vol. 54, No. 25, Jun. 19, 1989, pp. 2536-2538.
Nakajima et al., "Formation of Ferromagnetic Iron Nitrides in Iron Thin Films by High-Dose Nitrogen Ion Implantation," Journal of Applied Physics, vol. 65, No. 11, Jun. 1, 1989, pp. 4357-4361.
Strnat, "Modern Permanent Magnets for Applications in Electro-Technology," Proceedings of the IEEE, vol. 78, No. 6, Jun. 1990, pp. 923-946.
Strnat et al., "Bonded Rare Earth-Cobalt Permanent Magnets," Proceedings of the 12th Rare Earth Research Conference, vol. 1, Jul. 18-22, 1976, 11 pp.
Strnat et al., "Rare Earth-Cobalt Permanent Magnets," Journal of Magnetism and Magnetic Materials, vol. 100, Nos. 1-3, Nov. 1991, pp. 38-56.
Yang et al., "The Effect of Strain Induced by Ag Underlayer on Saturation Magnetization of Partially Ordered Fe16N2 Thin Films," Applied Physics Letters, vol. 103, Dec. 12, 2013, 4 pp.
Lewis et al., "Perspectives on Permanent Magnetic Materials for Energy Conversion and Power Generation," Metallurgical and Materials Transactions A, vol. 44A, Jan. 2013, 19 pp.
Pauling, "The Nature of the Interatomic Forces in Metals," Physical Review, vol. 54, Dec. 1, 1938, pp. 899-904.
Davison et al., "Shock Compression of Solids," Physics Reports, vol. 55, No. 4, Apr. 1979, pp. 255-379.
Liu et al., "Nanocomposite Exchange-Spring Magnet Synthesized by Gas Phase Method: From Isotropic to Anisotropic," Applied Physics Letters, vol. 98, Jun. 3, 2011, 3 pp.
Amato et al., "Exchange-Spring Behavior of Hard/Soft Magnetic Multilayers: Optimization Study of the Nanostructure," Physica B: Condensed Matter, vol. 275, Nos. 1-3, Jan. 2000, pp. 120-123.
Tijssens et al., "Towards an Improved Continuum Theory for Phase Transformations," Materials Science and Engineering, vol. 378, Sep. 23, 2003, pp. 453-458.
Komuro et al., "Epitaxial Growth and Magnetic Properties of Fe16N2 Films with High Saturation Magnetic Flux Density (Invited)," Journal of Applied Physics, vol. 67, No. 9, May 1, 1990, pp. 5126-5130.
Brady et al., "Alloy Design of Intermetallics for Protective Scale Formation and for use as Precursors for Complex Ceramic Phase Surfaces," Intermetallics, vol. 12, Apr. 1, 2004, pp. 779-789.
Brady et al., "Pre-Oxidized and Nitrided Stainless Steel Alloy Foil for Proton Exchange Membrane Fuel Cell Bipolar Plates: Part 1. Corrosion, Interfacial Contact Resistance, and Surface Structure," Journal of Power Sources, vol. 195, Mar. 20, 2010, pp. 5610-5618.
"Annual Energy Outlook 2015, with projects to 2040," U.S. Energy Information Administration, Apr. 2015, 154 pp.
Kim et al., "New Magnetic Material Having Ultrahigh Magnetic Moment," Applied Physics Letters, vol. 20, No. 12, Jun. 15, 1972, pp. 492-494.

(56) References Cited

OTHER PUBLICATIONS

Zhuge et al., "Preparation and Property of Iron Nitrides by Ball Mill Method," Journal of Functional Materials, vol. 31, No. 5, 2000, pp. 471-472 (Abstract Only (on last page)) (Applicant points out, in accordance with MPEP 609.04(a), that the year of publication, 2000, is sufficiently earlier than the effective U.S. filing date, Aug. 8, 2014, so that the particular month of publication is not in issue.).
Takahashi et al., "Magnetic Moment of α"-Fe16N2 Films (Invited)," Journal of Applied Physics, vol. 76, No. 10, Nov. 15, 1994, pp. 6642-6647.
Takahashi et al., "Structure and Magnetic Moment of Fe16N2 Sputtered Film," Journal of Magnetism and Magnetic Materials, vol. 174, Nos. 1-2, Oct. 1, 1997, pp. 57-69.
Takahashi et al., "Magnetocrystalline Anisotropy for α'-Fe-C and α'-Fe-N Films," IEEE Transactions on Magnetics, vol. 37, No. 4, Jul. 2001, pp. 2179-2181.
Mühlethaler et al., "Improved Core-Loss Calculation for Magnetic Components Employed in Power Electronic Systems," IEEE Transactions on Power Electronics, vol. 27, No. 2, Feb. 2012, pp. 964-973.
Watanabe et al., "Perpendicular Magnetization of Epitaxial FePt(001) Thin Films with High Squareness and High Coercive Force," Japanese Journal of Applied Physics, vol. 35, No. 10A, Oct. 1, 1996, pp. 1264-1267.
Zhang et al., "Thermal Stability of Partially Ordered Fe16N2 Film on Non-Magnetic Ag Under Layer," Journal of Applied Physics, vol. 115, No. 17A, Mar. 20, 2014, 3 pp.
Uijttewaal et al., "Understanding the Phase Transitions of the Ni2MnGa Magnetic Shape Memory System from First Principles," Physical Review Letters, vol. 102, Jan. 23, 2009, 4 pp.
Pugaczowa-Michalska et al., "Electronic Structure and Magnetic Properties of Ni2MnGa1-xGex and Disordered Ni2MnSn Heusler Alloys," Acta Physica Polonica A, vol. 115, No. 1, Jan. 2009, pp. 241-243.
Brewer et al., "Magnetic and Physical Microstructure of Fe16N2 Films Grown Epitaxially on Si(001)," Journal of Applied Physics, vol. 81, No. 8, Apr. 15, 1997, pp. 4128-4130.
Abdellateef et al., "Magnetic Properties and Structure of the α"-Fe16N2 Films," Journal of Magnetism and Magnetic Materials, vol. 256, Nos. 1-3, Jan. 11, 2003, pp. 214-220.
Brewer et al., "Epitaxial Fe16N2 Films Grown on Si(001) by Reactive Sputtering," Journal of Applied Physics, vol. 79, No. 8, Apr. 15, 1996, pp. 5321-5323.
Van Genderen et al., "Atom Probe Analysis of the First Stage of Tempering of Iron-Carbon-Nitrogen Martensite," Zeitschrift Für Metallkunde, vol. 88, No. 5, May 1997, pp. 401-409.
Takahashi et al., "Impurity effect of carbon on structure and saturation magnetization of Fe-N films," Journal of Magnetism and Magnetic Materials, vol. 210, Sep. 1, 1999, pp. 333-340.
Huang et al., "Magnetism of α'-FeN Alloys and α"-(Fe16N2) Fe Nitrides," Journal of Magnetism and Magnetic Materials, vol. 135, Nov. 30, 1993, pp. 226-230.
Huang et al., "Spin-Density Distribution in Ferromagnetic α"-Fe16N2," Physical Review B: Condensed Matter, vol. 51, No. 5, Feb. 1, 1995, pp. 3222-3225.
Cococcioni et al., "Linear Response Approach to the Calculation of the Effective Interaction Parameters in the LDA+U Method," Physical Review B, vol. 71, Jan. 18, 2005, 16 pp.
Takahashi, "Discovery of Fe16N2 with Giant Magnetic Moment and Its Future View," IEEE Translation Journal on Magnetics in Japan, vol. 6, No. 12, Dec. 1991, pp. 1024-1038.
Zhang et al., "Strain Effect of Multilayer FeN Structure on GaAs Substrate," Journal of Applied Physics, vol. 113, No. 17, Apr. 10, 2013, 3 pp.
"New Compound Opens Way to EV Magnet without Rare Earths," Nikkei.com Morning Edition, Mar. 4, 2011, 1 pp.
Coey et al., "Magnetic nitrides," Journal of Magnetism and Magnetic Materials, vol. 200, Mar. 10, 1999, pp. 405-420.
Tomioka et al., "Iron Nitride Powder Produced as Substitute for Rare Metal," Nikkei Technology, Mar. 7, 2011, 2 pp.
Zheng et al., "Iron Nitride Thin Films Deposited by Chloride Assisted Plasma Enhanced Chemical Vapour Deposition: Facile Stoichiometry Control and Mechanism Study," Journal of Applied Physics D: Applied Physics, vol. 42, No. 18, Sep. 21, 2009, 9 pp.
Ji et al., "Strain Induced Giant Magnetism in Epitaxial Fe16N2 Thin Film," Applied Physics Letters, vol. 102, Feb. 21, 2013, 4 pp.
Lanska et al., "Composition and Temperature Dependence of the Crystal Structure of Ni-Mn-Ga Alloys," Journal of Applied Physics, vol. 95, No. 12, Jun. 15, 2004, pp. 8074-8078.
Takahashi et al., "Growth Mechanism of FeN Films by Means of an Atmospheric Pressure Halide Chemical Vapor Deposition," Materials Chemistry and Physics, vol. 65, Jan. 18, 2000. pp. 113-116.
Ji et al., "Growth and Depth-Dependence of Saturation Magnetization of Iron Nitride Thin Films on MgO Substrate," Spin, vol. 2, No. 1, Mar. 2012, 4 pp.
"Nanocrystalline soft magnetic material, FINEMET," Materials Magic, Hiatchi Metals, Apr. 2005, 12 pp.
Gutfleisch et al., "Magnetic Materials and Devices for the 21st Century: Stronger, Lighter, and More Energy Efficient," Advanced Materials, vol. 23, 2011, Dec. 15, 2010, pp. 821-842.
Ferguson et al., "The Tempering of Fe-C-N Martensite" Scripta Metallurgica, vol. 18, No. 11, Nov. 1984, pp. 1189-1194.
Brown et al., "The Crystal Structure and Phase Transitions of the Magnetic Shape Memory Compound Ni2MnGa," Journal of Physics: Condensed Matter, vol. 14, No. 43, Oct. 18, 2002, pp. 10159-10171.
Bruno, "Tight-Binding Approach to the Orbital Magnetic Moment and Magnetocrystalline Anisotropy of Transition-Metal Monolayers," Physical Review B, vol. 39, No. 1, Jan. 1, 1989, pp. 865-868.
Blöchl, "Projector Augmented-Wave Method," Physical Review B, vol. 50, No. 24, Dec. 15, 1994, pp. 17953-17979.
Entel et al., "Ab Initio Modeling of Martensitic Transformation (MT) in Magnetic Shape Memory Alloys," Journal of Magnetism and Magnetic Materials, vol. 310, Nov. 27, 2006, pp. 2761-2763.
Hohenberg et al., "Inhomogeneous Electron Gas," Physical Review, vol. 136, No. 3B, Nov. 9, 1964, pp. 864-871.
Sit et al., "Realistic Quantitative Descriptions of Electron Transfer Reactions: Diabatic Free-Energy Surfaces from First-Principles Molecular Dynamics," Physical Review Letters, vol. 97, Jul. 11, 2006, 4 pp.
Paseka et al., "Structure and Magnetic Properties of Ball-Milled Iron Nitride Powders," Journal of Alloys and Compounds, vol. 274, Mar. 10, 1998, pp. 248-253.
Giannozzi et al., "Quantum Espresso: A Modular and Open-Source Software Project for Quantum Simulations of Materials," Journal of Physics: Condensed Matter, vol. 21, Sep. 1, 2009, pp. 1-19.
Tong et al., "Low Temperature Wafer Direct Bonding," Journal of Microelectromechanical Systems, vol. 3, No. 1, Mar. 1994, pp. 29-35.
Fan et al., "Ferromagnetism at the Interfaces of Antiferromagnetic FeRh Epilayers," Physical Review B, vol. 82, Nov. 12, 2010, 5 pp.
Yao et al., "Formation and Magnetic Properties of Fe16N2 Films Prepared by Ion-Beam-Assisted Deposition," Journal of Magnetism and Magnetic Materials, vol. 177-181, Jan. 1998, pp. 1291-1292.
Skomski et al., "Giant Energy Product in Nanostructured Two-Phase Magnets," Physical Review B, vol. 48, No. 21, Dec. 1, 1993, pp. 15812-15816.
Tickle et al., "Magnetic and Magnetomechanical Properties of Ni2MnGa," Journal of Magnetism and Magnetic Materials, vol. 195, No. 3, Jun. 11, 1999, pp. 627-638.
Sabiryanov et al., "Electronic Structure and Magnetic Properties of Hard/Soft Multilayers," Journal of Magnetism and Magnetic Materials, vol. 177-181, Pt. 2, Jan. 1998, pp. 989-990.
Metzger et al., "Magnetism of α"-Fe16N2 (Invited)," Journal of Applied Physics, vol. 76, No. 10, Nov. 15, 1994, pp. 6626-6631.
Kardonina et al., "Transformations in the Fe-N System," Metal Science and Heat Treatment, vol. 52, Nos. 9-10, Oct. 2010, pp. 5-15.
Chu et al., "Opportunities and Challenges for a Sustainable Energy Future," Nature, vol. 488, No. 7411, Aug. 16, 2012, pp. 294-303.
Blundell et al., "Polarized Neutron Reflection as a Probe of Magnetic Films and Multilayers," Physical Review B, vol. 46, No. 6, Aug. 1, 1992, pp. 3391-3400.

(56) References Cited

OTHER PUBLICATIONS

Zhang et al., "Energy Barriers and Hysteresis in Martensitic Phase Transformations," Acta Materialia, vol. 57, Jul. 17, 2009, pp. 4332-4352.
Okamoto et al., "Crystal Distortion and the Magnetic Moment of Epitaxially Grown α"-Fe16N2," Journal of Magnetism and Magnetic Materials, vol. 208, Jul. 12, 1999, pp. 102-114.
Roy et al., "Depth Profile of Uncompensated Spins in an Exchange Bias System," Physical Review Letters, vol. 95, Jul. 21, 2005, 4 pp.
Uchida et al., "Magnetocrystalline Anisotropy Energies of Fe16N2 and Fe16C2," Journal of Magnetism and Magnetic Materials, vol. 310, Nov. 15, 2006, pp. 1796-1798.
Wang et al., "Properties of a New Soft Magnetic Material," Nature, vol. 407, Sep. 14, 2000, pp. 150-151.
Dudarev et al., "Electron-Energy-Loss Spectra and the Structural Stability of Nickel Oxide: An LSDA+U Study," Physical Review B, vol. 57, No. 3, Jan. 15, 1998, pp. 1505-1509.
Barman et al., "Structural and Electronic Properties of Ni2MnGa," Physical Review B, vol. 72, Nov. 8, 2005, 7 pp.
Atiq et al., "Preparation and the Influence of Co, Pt and Cr Additions on the Saturation Magnetization of α"-Fe16N2 Thin Films," Journal of Alloys and Compounds, vol. 479, Feb. 23, 2009, pp. 755-758.
Okamoto et al., "Characterization of Epitaxially Grown Fe-N Films by Sputter Beam Method," Journal of Applied Physics, vol. 79, No. 3, Feb. 1, 1996, pp. 1678-1683.
Sugita et al., "Magnetic and Mössbauer Studies of Single-Crystal Fe16N2 and Fe-N Martensite Films Epitaxially Grown by Molecular Beam Epitaxy (Invited)," Journal of Applied Physics, vol. 76, No. 10, Nov. 15, 1994, pp. 6637-6641.
Sugita et al., "Giant Magnetic Moment and Other Magnetic Properties of Epitaxially Grown Fe16N2 Single-Crystal Films (Invited)," Journal of Applied Physics, vol. 70, No. 10, Nov. 15, 1991, pp. 5977-5982.
Toops et al., "Pre-Oxidized and Nitrided Stainless Steel Alloy Foil for Proton Exchange Membrane Fuel Cell Bipolar Plates. Part 2: Single-Cell Fuel Evaluation of Stamped Plates," Journal of Power Sources, vol. 195, Mar. 19, 2010, pp. 5619-5627.
Klemmer et al., "Magnetic Hardening and Coercivity Mechanisms in L1 Ordered FePd Ferromagnets," Scripta Metallurgica et Materialia, vol. 33, Nos. 10-11, Dec. 1, 1995, pp. 1793-1805.
Ohtani et al., "Magnetic Properties of Mn-Al-C Permanent Magnet Alloys," IEEE Transactions on Magnetics, vol. MAG-13, No. 5, Sep. 1977, pp. 1328-1330.
Osaka et al., "A Soft Magnetic CoNiFe Film With High Saturation Magnetic Flux Density and Low Coercivity," Nature, vol. 392, Apr. 23, 1998, pp. 796-798.
Schrefl et al., "Exchange Hardening in Nano-Structured Two-Phase Permanent Magnets," Journal of Magnetism and Magnetic Materials, vol. 127, Jul. 12, 1993, pp. 273-277.
Kakeshita et al., "Effect of Magnetic Fields on Athermal and Isothermal Martensitic Transformations in Fe-Ni-Mn Alloys," Materials Transactions, vol. 34, No. 5, Dec. 9, 1992, pp. 415-422.
Koyano et al., "Magnetization of α' Iron Nitride Produced Through the fcc→bct Martensitic Transformation in High Magnetic Field," Journal of Applied Physics, vol. 100, No. 3, Aug. 1, 2006, 5 pp.
Oku et al., "Small-Angle Polarized Neutron Scattering Study of Spherical Fe16N2 Nano-Particles for Magnetic Recording Tape," Physica B, vol. 404, Sep. 1, 2009, pp. 2575-2577.
Shimoda et al., "High-Energy Cast Pr-Fe-B Magnets," Journal of Applied Physics, vol. 64, No. 10, Nov. 15, 1988, pp. 5290-5292.
Weber et al., "Search for Giant Magnetic Moments in Ion-Beam-Synthesized α"-Fe16N2," Thin Solid Films, vol. 279, Nos. 1-2, Jun. 1996, pp. 216-220.
Watanabe et al., "A New Challenge: Grain Boundary Engineering for Advanced Materials by Magnetic Field Application," Journal of Materials Science, vol. 41, No. 23, Oct. 24, 2006 (online), pp. 7747-7759.
Takahashi et al., "Preparation of FeN Thin Films by Chemical Vapor Deposition Using a Chloride Source," Materials Letters, vol. 42, No. 6, Mar. 2000, pp. 380-382.
Stern et al., "Electronic and Structural Properties of Fe3Pd-Pt Ferromagnetic Shape Memory Alloys," Journal of Applied Physics, vol. 91, No. 10, May 15, 2002, pp. 7818-7820.
Qian et al., "NiZn Ferrite Thin Films Prepared by Facing Target Sputtering," IEEE Transactions Magnetics, vol. 33, No. 5, Sep. 1997, pp. 3748-3750.
Takahashi et al., "New Soft Magnetic Material of α'-Fe-C With High Bs," Journal of Magnetism and Magnetic Materials, vol. 239, Nos. 1-3, Feb. 1, 2002, pp. 479-483.
Inoue et al., "Enhancement of the Formation of Fe16N2 on Fe Films by Co Additions (Invited)," Journal of Applied Physics, vol. 76, No. 10, Nov. 15, 1994, pp. 6653-6655.
Tsuchiya et al., "Spin Transition in Magnesiowüstite in Earth's Lower Mantle," Physical Review Letters, vol. 94, May 18, 2006, 4 pp.
Liu et al., "Nucleation Behavior of Bulk Ni-Cu Alloy and Pure Sb in High Magnetic Fields," Journal of Crystal Growth, vol. 321, Mar. 2, 2011, pp. 167-170.
Liu et al., "Effects of High Magnetic Fields on Solidification Microstructure of Al-Si Alloys," Journal of Material Science, vol. 46, Oct. 22, 2010, pp. 1628-1634.
Okunev et al., "The Low-Temperature Electric Conductivity of YBaCuO and LaSrMnO Dielectric Films Obtained by a Pulsed Laser Sputter Deposition Technique," Technical Physics Letters, vol. 26, No. 10, May 6, 2000, pp. 903-906.
Anisimov et al., "Density-Functional Calculation of Effective Coulomb Interactions in Metals," Physical Review B, vol. 43, No. 10, Apr. 1, 1991, pp. 7570-7574.
Anisimov et al., "Band-Structure Description of Mott Insulators (NiO, MnO, FeO, CoO)," Journal of Physics: Condensed Matter, vol. 2, No. 17, Apr. 30, 1990, pp. 3973-3987.
Anisimov et al., "First-Principles Calculations of the Electronic Structure and Spectra of Strongly Correlated Systems: the LDA+U Method," Journal of Physics: Condensed Matter, vol. 9, No. 4, Jan. 27, 1997, pp. 767-808.
Anisimov et al., "Band Theory and Mott Insulators: Hubbard U Instead of Stoner I," Physical Review B, vol. 44, No. 3, Jul. 15, 1991, pp. 943-954.
Campo et al., "Extended DFT + U + V Method With On-Site and Inter-Site Electronic Interactions," Journal of Physics: Condensed Matter, vol. 22, Jan. 19, 2010 (online), 12 pp.
Nimura et al., "Facing Targets Sputtering System for Depositing Co-Cr Perpendicular Magnetic Recording Media," Journal of Vacuum Science Technology, vol. 5, No. 1, Jan. 1987, pp. 109-110.
Lauter et al., "Highlights from the Magnetism Reflectometer at the SNS," Physica B, vol. 404, Sep. 1, 2009, pp. 2543-2546.
Godlevsky et al., "Soft Tetragonal Distortions in Ferromagnetic Ni2MnGa and Related Materials from First Principles," Physical Review B, vol. 63, Mar. 2, 2001, 5 pp.
Hou et al., "SmCo5/Fe Nanocomposites Synthesized from Reductive Annealing of Oxide Nanoparticles," Applied Physics Letters, vol. 91, Oct. 12, 2007, 3 pp.
Zhang et al., "Shift of the Eutectoid Point in the Fe-C Binary System by a High Magnetic Field," Journal of Physics D: Applied Physics, vol. 40, Oct. 19, 2007, pp. 6501-6506.
Pickett et al., "Reformulation of the LDA + U Method for a Local-Orbital Basis," Physical Review B, vol. 58, No. 3, Jul. 15, 1998, pp. 1201-1209.
Kohn et al., "Self-Consistent Equations Including Exchange and Correlation Effects," Physical Review, vol. 140, No. 4A, Nov. 15, 1965, pp. 1133-1138.
Gong et al., "Mechanically Alloyed Nanocomposite Magnets," Journal of Applied Physics, vol. 75, No. 10, May 15, 1994, pp. 6649-6651.
Li et al., "Effect of Assistant rf Field on Phase Composition of Iron Nitride Film Prepared by Magnetron Sputtering Process," Journal of Vacuum Science & Technology A, vol. 24, No. 1, Dec. 23, 2005 (online), pp. 170-173.
Liu et al., "Nanocrystalline Soft Magnetic Ribbon with α"-Fe16N2 Nanocrystallites Embedded in Amorphous Matrix," Journal of Magnetism and Magnetic Materials, vol. 320, Jun. 10, 2008, pp. 2752-2754.

(56) References Cited

OTHER PUBLICATIONS

Wallace et al., "Enhanced Fe Moment in Nitrogen Martensite and Fe16N2 (Invited)," Journal of Applied Physics, vol. 76, No. 10, Nov. 15, 1994, pp. 6648-6652.
Wang et al., "Growth, Structural, and Magnetic Properties of Iron Nitride Thin Films Deposited by dc Magnetron Sputtering," Applied Surface Science, vol. 220, May 20, 2003, pp. 30-39.
Rui et al., "In-Cluster-Structured Exchange-Coupled Magnets with High Energy Densities," Applied Physics Letters, vol. 89, Sep. 19, 2006, 3 pp.
Bao et al., "Synthesis and Properties of α"-Fe16N2 in Magnetic Particles," Journal of Applied Physics, vol. 75, No. 10, May 15, 1994, pp. 5870-5872.
Gao et al., "Exchange-coupling interaction and effective anisotropy in nanocomposite permanent materials," Chinese Science Bulletin, vol. 47, No. 14, Jul. 2002, 4 pp.
Grimsditch et al., "Exchange-spring systems: Coupling of hard and soft ferromagnets as measured by magnetization and Brillouin light scattering (Invited)," Journal of Applied Physics, vol. 85, No. 8, Apr. 15, 1999, 5 pp.
Stäblein, "Chapter 7: Hard Ferrites and Plastoferrites," Handbook of Ferromagnetic Materials, vol. 3, 1982, 162 pp. (Applicant points out, in accordance with MPEP 609.04(a), that the year of publication, 1982, is sufficiently earlier than the effective U.S. filing date, Aug. 8, 2014, so that the particular month of publication is not in issue.).
Tanaka et al., "Study on Crystal Structure and Electronic State of Ferromagnetic Nitride a"-Fe16N2", Jan. 1, 1999.
Jack et al., "The Synthesis, Structure, and Characterization of a'Fe16N2", Journal of Applied Physics, American Institute of Physics, Nov. 15, 1994,.
Turgut et al., "Thermal Plasma Synthesis of ?-FeN, Nanoparticles as Precursors for the Fe16N2 Synthesis by Annealing," ResearchGate, MRS Online Proceeding Library Jan. 2011, 7 pp.
Aoshima et al., "Preparation and Characterization of Fe-N Nanoparticles by Gas Flow Sputtering," Japanese Journal of Applied Physics, vol. 47, No. 1, Jan. 22, 2008, 4 pp.
Tang et al., "Formation of nanocrystalline Fe-N-B-Cu soft magnetic ribbons," Journal of Non-Crystalline Solids, vol. 337, Received Sep. 9, 2003, available online through Science Direct 2004, pp. 276-279.
Ziegler, "SRIM—The Stopping and Range of Ions in Matter," retrieved from http://srim.org/, dated accessed Oct. 13, 2016, 4 pp.
Jack, "The Iron-Nitrogen System: The Preparation and the Crystal Structures of Nitrogen-Austenite (γ) and Nitrogen-Martensite (α')," Proceedings of the Royal Society of London, Series A, Mathematical and Physical Sciences, Mar. 13, 1951, retrieved from http://rspa.royalsocietypublishing.org, available on Jul. 27, 2016, 19 pp.
Kaneko et al., "Fe-Cr-Co Ductile Magnet With (BH)max=8 MGOe," AIP Conference Proceedings, 1976, retrieved online https://publishing.aip.org on Jul. 27, 2016, 2 pp.
Liu et al., "Discovery of localized states of Fe 3d electrons in Fe16N2 and Fe8N films: an evidence of the existence of giant saturation magnetization," available online Cornell University Library arXiv: 0909.4478, Sep. 2009, 13 pp.
Ji et al., "Direct Observation of Giant Saturation Magnetization in Fe16N2," available online Cornell University Library arXiv:1211.0553, Nov. 2012, 27 pp.
Kart et al., "DFT Studies on Structure, Mechanics and Phase Behavior of Magnetic Shape Memory Alloys: Ni2MnGa," Physica Status Solidi A, vol. 205, No. 5, published online Mar. 20, 2008 available online www.pss-a.com, 10 pp.
Wang et al., "Searching, Fabricating and Characterizing Magnetic Materials With Giant Saturation Magnetization," TMRC 2014, Electrical and Computer Engineering Department, University of Minnesota, Aug. 11, 2014, 2 pp.
Yamamoto et al., "Formation of Fe16N2 in Deformed Iron by Ion Implantation Method," Proceedings of 1998 International Conference on Ion Implantation Technology, Jun. 22-26, 1998, available via IEEE 1999, 4 pp.
Tsubakino et al., "High resolution transmission electron microscopic study of the formation of Fe16N2 in bulk iron by on implantation," Material Letters 26, Elsevier, Feb. 1996, pp. 155-159.
Resta, "Ab initio study of tetragonal variants in Ni2MnGa alloy," Journal of Physics: Condensed Matter, vol. 14, No. 20, published online stacks.iop.org/JPhysCM/14/5325 on May 16, 2002, 14 pp.
Coey, "The Magnetization of Bulk α"-Fe16N2 (Invited)," Journal of Applied Physics, vol. 76, No. 19, Nov. 15, 1994, 5 pp.
Coey et al., "The Magnetization of α"-Fe16N2, Letter to the Editor," Journal of Physics: Condensed Matter, vol. 6, Sep. 27, 1993, pp. 23-28.
Kikkawa et al., "Particle Size Dependence in Low Temperature Nitridation Reaction for Fe16N2," Journal of Alloys and Compounds, vol. 449, Dec. 21, 2006 (online), pp. 7-10.
Zayak et al., "First-principles investigations of homogenous lattice-distortive strain and shuffles in Ni2MnGA," Journal of Physics: Condensed Matter, vol. 15, No. 2, Jan. 22, 2003, 8 pp.
Issakov et al., "Fast Analytical Parameters Fitting of Planar Spiral Inductors," 2008 IEEE International Conference on Microwaves, Communications, Antennas and Electronic Systems, May 13-14, 2008, 10 pp.
Coey et al., "The Magnetization of a"-Fe16N2," Journal of Physics: Condensed Matter, vol. 6, 1994, pp. 23-28. Per MPEP 609.09(a), Applicant points out that the year of publication, 1994, is sufficiently earlier than the effective U.S. filing date, Aug. 5, 2015, and any foreign priority date so that the particular month of publication is not in issue.
Huang et al., "Synthesis and characterization of Fe16N2 in bulk form," Journal of Applied Physics, vol. 75, No. 10, May 15, 1994, 4 pp.
Tsubakino et al., "Formation of Fe16N2 in iron sheet by an ion implantation method," Materials Chemistry and Physics 54, Elsevier, Jul. 1998, pp. 301-304.
Office Action from U.S. Appl. No. 14/820,284, dated Jan. 22, 2018, 14 pp.
Response to Office Action dated Jan. 22, 2018, from U.S. Appl. No. 14/820,284, filed Apr. 23, 2018 15pp.

* cited by examiner

INDUCTOR INCLUDING ALPHA"-FE16Z2 OR ALPHA"-FE16(NXZ1-X)2, WHERE Z INCLUDES AT LEAST ONE OF C, B, OR O

RELATED APPLICATIONS

This application claims the benefit of U.S. Provisional Patent Application No. 62/035,184, filed Aug. 8, 2014, and titled, "INDUCTOR INCLUDING $\alpha''$-$Fe_{16}Z_2$ OR $\alpha''$-$Fe_{16}(N_xZ_{1-x})_2$, WHERE Z INCLUDES AT LEAST ONE OF C, B, OR O," the entire content of which is incorporated by reference herein.

GOVERNMENT RIGHTS

This invention was made with Government support under contract number DE-AR0000199 awarded by DOE, Office of ARPA-E. The Government has certain rights in this invention.

TECHNICAL FIELD

The disclosure relates to inductor cores, transformer cores, antennas, impedance matching circuits, filters, AC-DC converters, RF energy harvesting circuits, and the like including a magnetic material and techniques for forming the inductor cores, transformer cores, antennas, impedance matching circuits, filters, AC-DC converters, RF energy harvesting circuits, and the like.

BACKGROUND

Magnetic materials, including both hard magnetic materials and soft magnetic materials, are used in many different applications. For example, soft magnetic materials may be used in transformer and inductor cores, magnetic recording write heads, microwave devices, magnetic shielding, and the like.

SUMMARY

The disclosure describes inductor cores, transformer cores, antennas, impedance matching circuits, filters, AC-DC converters, RF energy harvesting circuits, and the like including a magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$, where Z includes at least one of C, B, or O, and where x is a number greater than zero and less than one. In some examples, the magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$ may include at least one of a relatively high magnetic saturation, relatively low coercivity, relatively high magnetic permeability, relatively high intrinsic resistivity (e.g., compared to iron), or the like. In some examples, the magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$ may possess soft magnetic material properties. The magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$ may be used to form devices including inductor cores, transformer cores, antennas, or the like. In some examples, the devices may be integrated in a semiconductor device, such as an integrated circuit. In some examples, because of the properties of the magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$, the inductors may be scaled to smaller sizes, the inductors may be usable at relatively high frequencies, the antennas may be tunable within a relatively wide frequency range, the transformer cores may be efficient, and the like.

In some examples, at least a portion the inductor may define a substantially planar spiral shape. In some examples, the inductor may include a plurality of substantially planar spiral shapes connected by conductive vias. The inductors including the magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$ may be formed by, for example, chemical vapor deposition (CVD), liquid phase epitaxy (LPE), physical vapor deposition (PVD), or the like.

In some examples, the disclosure describes a device including a substrate, a dielectric or insulator layer on the substrate, and an inductor on the dielectric or insulator layer. The inductor may include a magnetic material including at least one of an $\alpha''$-$Fe_{16}(N_xZ_{1-x})_2$ phase domain or an $\alpha'$-$Fe_8(N_xZ_{1-x})$ phase domain, wherein Z at least one of C, B, or O, and x is a number greater than zero and less than one.

In some examples, the disclosure describes a device including a substrate, a dielectric or insulator layer on the substrate, and an inductor on the dielectric or insulator layer. The inductor may include a magnetic material including at least one of an $\alpha''$-$Fe_{16}N_2$ phase domain and an $\alpha''$-$Fe_{16}Z_2$ phase domain or an $\alpha'$-$Fe_8N$ phase domain and an $\alpha'$-$Fe_8Z$ phase domain, wherein Z includes at least one of C, B, or O, and.

In some examples, the disclosure describes a method including forming a dielectric or insulator layer on a substrate and forming an inductor on the dielectric or insulator layer. The inductor may include a magnetic material including at least one $\alpha''$-$Fe_{16}(N_xZ_{1-x})_2$ $\alpha'$-$Fe_8(N_xZ_{1-x})$ phase domain, wherein Z includes at least one of C, B, O, and x is a number greater than zero and less than one.

In some examples, the disclosure describes a method including forming a dielectric or insulator layer on a substrate and forming an inductor on the dielectric or insulator layer. The inductor may include a magnetic material including at least one of an $\alpha''$-$Fe_{16}N_2$ phase domain and an $\alpha''$-$Fe_{16}Z_2$ phase domain or an $\alpha'$-$Fe_8N$ phase domain and an $\alpha'$-$Fe_8Z$ phase domain, wherein Z includes at least one of C, B, or O, and.

The details of one or more examples are set forth in the accompanying drawings and the description below. Other features, objects, and advantages will be apparent from the description and drawings, and from the claims.

BRIEF DESCRIPTION OF DRAWINGS

The summary, as well as the following detailed description, is further understood when read in conjunction with the appended drawings. For the purpose of illustrating the disclosure, there are shown in the drawings examples; however, the disclosure is not limited to the specific techniques, compositions, and devices disclosed. In addition, the drawings are not necessarily drawn to scale.

DETAILED DESCRIPTION

Figure 1:
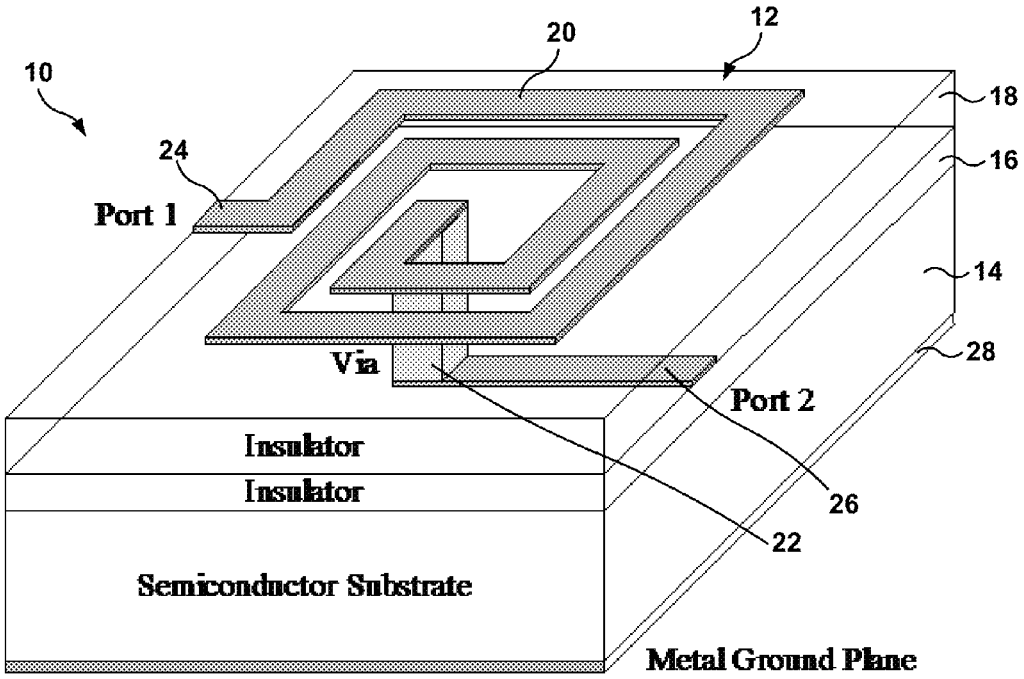
FIG. 1 is a conceptual and schematic diagram illustrating a portion of an example inductor formed over a substrate as part of a device.

The present disclosure may be understood more readily by reference to the following detailed description taken in connection with the accompanying figures and examples, which form a part of this disclosure. It is to be understood that this disclosure is not limited to the specific devices, methods, applications, conditions or parameters described and/or shown herein, and that the terminology used herein is for the purpose of describing particular examples and is not intended to be limiting of the claims. When a range of values is expressed, another example includes from the one particular value and/or to the other particular value. Similarly, when values are expressed as approximations, by use of the antecedent "about," it will be understood that the particular value forms another example. All ranges are inclusive and combinable. Further, a reference to values stated in a range includes each and every value within that range.

It is to be appreciated that certain features of the disclosure which are, for clarity, described herein in the context of separate examples, may also be provided in combination in a single example. Conversely, various features of the disclosure that are, for brevity, described in the context of a single example, may also be provided separately or in any subcombination.

The disclosure describes inductors, transformer cores, antennas, impedance matching circuits, filters, AC-DC converters, RF energy harvesting circuits, and the like including a magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$, where Z includes at least one of C, B, or O, and x is a number greater than zero and less than one. In some examples, the magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$ may include a relatively high magnetic saturation, such as greater than about 200 emu/gram, greater than about 219 emu/gram, greater than about 242 emu/gram, or greater than about 250 emu/gram. In addition, in some examples, the magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$ may include a relatively low coercivity. For example, the coercivity of the magnetic material may be less than about 10 Oestads. In some examples, the magnetic material including $\alpha''$-$Fe_{16}(N_xZ_{1-x})_2$ or $\alpha'$-$Fe_8(N_xZ_{1-x})$, or a mixture of at least one of $\alpha''$-$Fe_{16}N_2$ or $\alpha'$-$Fe_8N$ and at least one of $\alpha''$-$Fe_{16}Z_2$ or $\alpha'$-$Fe_8Z$ also may include relatively high magnetic permeability, relatively high intrinsic resistivity (e.g., compared to iron), or the like.

For purposes of description only, the following description will primarily refer to $\alpha''$-$Fe_{16}(N_xZ_{1-x})_2$ or a mixture of $\alpha''$-$Fe_{16}N_2$ and $\alpha''$-$Fe_{16}Z_2$. However, those of skill in the art will recognize that similar principles and examples may apply to and include $\alpha'$-$Fe_8(N_xZ_{1-x})$ or a mixture of $\alpha'$-$Fe_8N$ and $\alpha'$-$Fe_8Z$, or mixtures between these different phases.

In some examples, the magnetic material including $\alpha''$-$Fe_{16}(N_xZ_{1-x})_2$ or a mixture of $\alpha''$-$Fe_{16}N_2$ and $\alpha''$-$Fe_{16}Z_2$ may possess soft magnetic material properties. The magnetic material including $\alpha''$-$Fe_{16}(N_xZ_{1-x})_2$ or a mixture of $\alpha''$-$Fe_{16}N_2$ and $\alpha''$-$Fe_{16}Z_2$ may be used to form devices including inductors, transformer cores, antennas, or the like. In some examples, the devices may be integrated in a semiconductor device, such as an integrated circuit. In some examples, because of the properties of the magnetic material including $\alpha''$-$Fe_{16}(N_xZ_{1-x})_2$ or a mixture of $\alpha''$-$Fe_{16}N_2$ and $\alpha''$-$Fe_{16}Z_2$, the inductors may be scaled to smaller sizes, the inductors may be usable at relatively high frequencies, the antennas may be tunable within a relatively wide frequency range, the transformer cores may be efficient, and the like.

In some examples, the magnetic material may include a mixture including α"-$Fe_{16}N_2$ phase domains and α"-$Fe_{16}Z_2$ phase domains. In other examples, the magnetic material may include α"-$Fe_{16}(N_xZ_{1-x})_2$ phase domains, wherein x is greater than zero and less than one. By controlling the ratio of α"-$Fe_{16}N_2$ phase domains and α"-$Fe_{16}Z_2$ phase domains or the ratio of N atoms and Z atoms in α"-$Fe_{16}(N_xZ_{1-x})_2$, the coercivity of the magnetic material may be controlled.

For example, α"-$Fe_{16}N_2$ may have a magnetic easy axis lying along the <001> axis, while α"-$Fe_{16}Z_2$ may have an easy axis lying perpendicular to the <001> axis, such as in the <010> axis or the <100> axis. Because the easy axes are perpendicular, the magnetic anisotropy of α"-$Fe_{16}N_2$ and α"-$Fe_{16}Z_2$ may cancel each other when mixed together, reducing the coercivity of the magnetic material including a mixture of α"-$Fe_{16}N_2$ and α"-$Fe_{16}Z_2$. Similarly, in α"-$Fe_{16}(N_xZ_{1-x})_2$, N atoms and Z atoms may distort the iron crystalline structure in orthogonal directions, such that mixing N atoms and Z atoms reduces magnetocrystalline anisotropy and coercivity of the magnetic material compared to α"-$Fe_{16}N_2$ alone or α"-$Fe_{16}Z_2$ alone. Both α"-$Fe_{16}N_2$ and α"-$Fe_{16}Z_2$ possess relatively high saturation magnetizations, such that a material including a mixture of α"-$Fe_{16}N_2$ and α"-$Fe_{16}Z_2$ may have relatively high saturation magnetization, regardless of the ratio of α"-$Fe_{16}N_2$ to α"-$Fe_{16}Z_2$.

In some examples, at least a portion of an inductor that includes α"-$Fe_{16}(N_xZ_{1-x})_2$ or a mixture of α"-$Fe_{16}N_2$ and α"-$Fe_{16}Z_2$ may define a substantially planar spiral shape. In some examples, the inductor may include a plurality of substantially planar spiral shapes connected by conductive vias.

In some examples, the devices including inductors, transformer cores, antennas, or the like that include the magnetic material including α"-$Fe_{16}(N_xZ_{1-x})_2$ or a mixture of α"-$Fe_{16}N_2$ and α"-$Fe_{16}Z_2$ may be formed by, for example, chemical vapor deposition (CVD), liquid phase epitaxy (LPE), physical vapor deposition (PVD), ball milling, melt spinning, or the like. Because the devices may be formed using CVD, PVD, or LPE in some examples, the devices may be incorporated in a device, and the techniques for forming the inductors may be incorporated into techniques for forming the semiconductor device.

FIG. 1 is a conceptual and schematic diagram illustrating a portion of an example inductor 12 formed over a substrate 14 as part of a device 10. Device 10 may include any device that is formed on and/or in substrate 14. In some examples, device 10 may include an integrated circuit, a semiconductor device, microelectromechanical system (MEMS), an integrated circuit, a sensor, a radio frequency (RF) energy harvesting device, an antenna, an impedance matching circuit, an AC-DC converter, a filter, or the like.

Substrate 14 may include, for example, semiconductor, such as bulk Si, Ge, or GaAs, a silicon on insulator (SOI) substrate, InGaAs, or the like; a ceramic, such as silicon carbide; a metal, such as Al, Cu, Ni, or Fe; or the like. In some examples, a top surface of substrate 14 may include a semiconductor including a plurality of active devices, such as transistors, formed therein and thereon.

Device 10 also may include a first dielectric or insulator layer 16, which may be formed on substrate 14. First dielectric or insulator layer 16 may electrically isolate electrically conductive layers formed on first dielectric or insulator layer 16 from substrate 14, aside from any conductive vias formed through first dielectric or insulator layer 16. In some examples, first dielectric or insulator layer 16 may include silicon dioxide ($SiO_2$), hafnium silicate, zirconium silicate, hafnium dioxide, zirconium dioxide, oxynitrides, doped silicon dioxide, or the like.

Device 10 also includes inductor 12, which may be at least partially formed on first dielectric or insulator layer 16. For example, a second port 26 of inductor 12 may be formed on first dielectric or insulator layer 16. Second port 26 may include an electrically conductive material, and may electrically connect inductor 12 to a voltage. In some examples, second port 26 may include copper or aluminum. In other examples, second port 26 may include the magnetic material including α"-$Fe_{16}(N_xZ_{1-x})_2$ or a mixture of α"-$Fe_{16}N_2$ and α"-$Fe_{16}Z_2$, where Z includes at least one of C, B, or O. Second port 26 may be an input or an output to inductor 12.

In some examples, second port 26 may be formed using chemical vapor deposition (CVD). For example, a trench may be defined in first dielectric or insulator layer 16 using etching. The shape of the trench may conform to the shape of second port 26. CVD then may be used to deposit second port 26 in the trench, and any excess material may be polished to remove the material and form a substantially flat surface of first dielectric or insulator layer 16. Alternatively, material for second port 26 may be deposited in a layer on the surface of first dielectric or insulator layer 16, and the layer may be patterned and etched to remove material from the layer and define second port 26.

Inductor 12 also includes an electrically conductive via 22, which extends through second dielectric or insulator layer 18. Once second port 26 has been formed, second dielectric or insulator layer 18 may be formed on first dielectric or insulator layer 16 and second port 26 using CVD. Second dielectric or insulator layer 18 may include, for example, any of the materials described above with respect to first dielectric or insulator layer 16. In some examples, second dielectric or insulator layer 18 may be polished to form a substantially flat surface.

Via 22 may be formed by first etching a channel through second dielectric or insulator layer 18 in the location and with the shape of via 22. Via 22 then may be deposited using CVD. In some examples, via 22 may include copper or aluminum. In other examples, via 22 may include the magnetic material including α"-$Fe_{16}(N_xZ_{1-x})_2$ or a mixture of α"-$Fe_{16}N_2$ and α"-$Fe_{16}Z_2$, where Z includes at least one of C, B, or O. Via 22 electrically connects second port 26 to spiral portion 20 of inductor 12.

Figure 2:
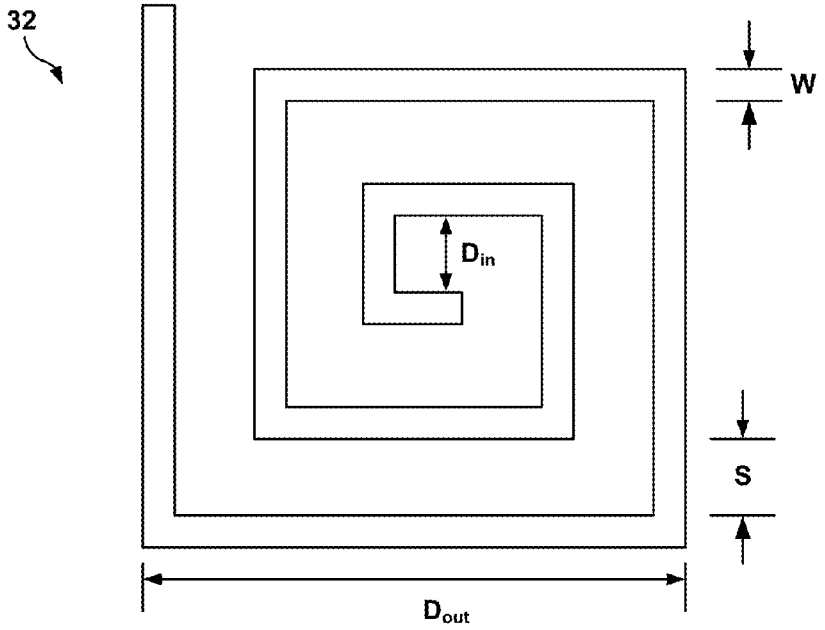
FIG. 2 is a conceptual and schematic diagram of an example spiral portion of an inductor core.

Inductor 12 also includes spiral portion 20. Spiral portion 20 is part of the core of the inductor, and is at least partially surrounded by the coil portion of the inductor. The physical properties, including the dimensions of spiral portion 20 may affect the properties of the inductor, such as the inductance. FIG. 2 is a conceptual and schematic diagram of an example spiral portion 32 of an inductor core (e.g., a core of inductor 12 of FIG. 1). As shown in FIG. 2, spiral portion 32 may be at least partially characterized by an inner diameter, $D_{in}$, an outer diameter, $D_{out}$, a width of the traces, W, and a spacing between adjacent traces, S. Spiral portion 32 also may be characterized by a number of rounds of the spiral. In some examples, spiral portion 32 may include between 1 and 10 rounds of the spiral. In the example illustrated in FIG. 1, spiral portion 20 includes two rounds. In the example illustrated in FIG. 2, spiral portion 32 includes 2.5 rounds.

In some examples, spiral portion 20 or 32 may include an inner diameter, $D_{in}$, between about 10 nanometers (10 nm) and about 100 micrometers (μm). In some examples, spiral portion 20 or 32 may include a trace width, W, of between about 10 nm and about 10 μm. In some examples, spiral portion 20 or 32 may include a spacing between adjacent traces, S, of between about 10 nm and about 10 μm. In some examples, spiral portion 20 or 32 may include an outside diameter, $D_{out}$, of between about 10 nm and about 100 μm.

Inductor 12 (FIG. 1) connects to a first port 24. First port 24 may include an electrically conductive material, and may electrically connect inductor 12 to a voltage. In some examples, first port 24 may include copper or aluminum. In other examples, first port 24 may include the magnetic material including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O. First port 24 may be an input or an output to inductor 12.

Spiral portion 20 and first port 24 may be formed by CVD. For example, a trench may be defined in second dielectric or insulator layer 18 using etching. The shape of the trench may conform to the shape of spiral portion 20 and first port 24. CVD then may be used to deposit spiral portion and first port 24 in the trench, and any excess material may be polished to remove the material and form a substantially flat surface of second dielectric or insulator layer 18. Alternatively, material for spiral portion 20 and first port 24 may be deposited in a layer on the surface of second dielectric or insulator layer 18, and the layer may be patterned and etched to remove material from the layer and define spiral portion 20 and first port 24. Although not shown in FIG. 1, in some examples, a third dielectric or insulator layer may be formed over second dielectric or insulator layer 18, spiral portion 20, and first port 24.

Inductor 12 (e.g., the coil of the inductor may be electrically connected, using first port 24 and second port 26, to other electrical components as part of an electrical circuit, such as an integrated circuit. Example electrical circuits include impedance matching circuits, filters, AC-DC converters, RF energy harvesting devices, and the like.

Figure 3:
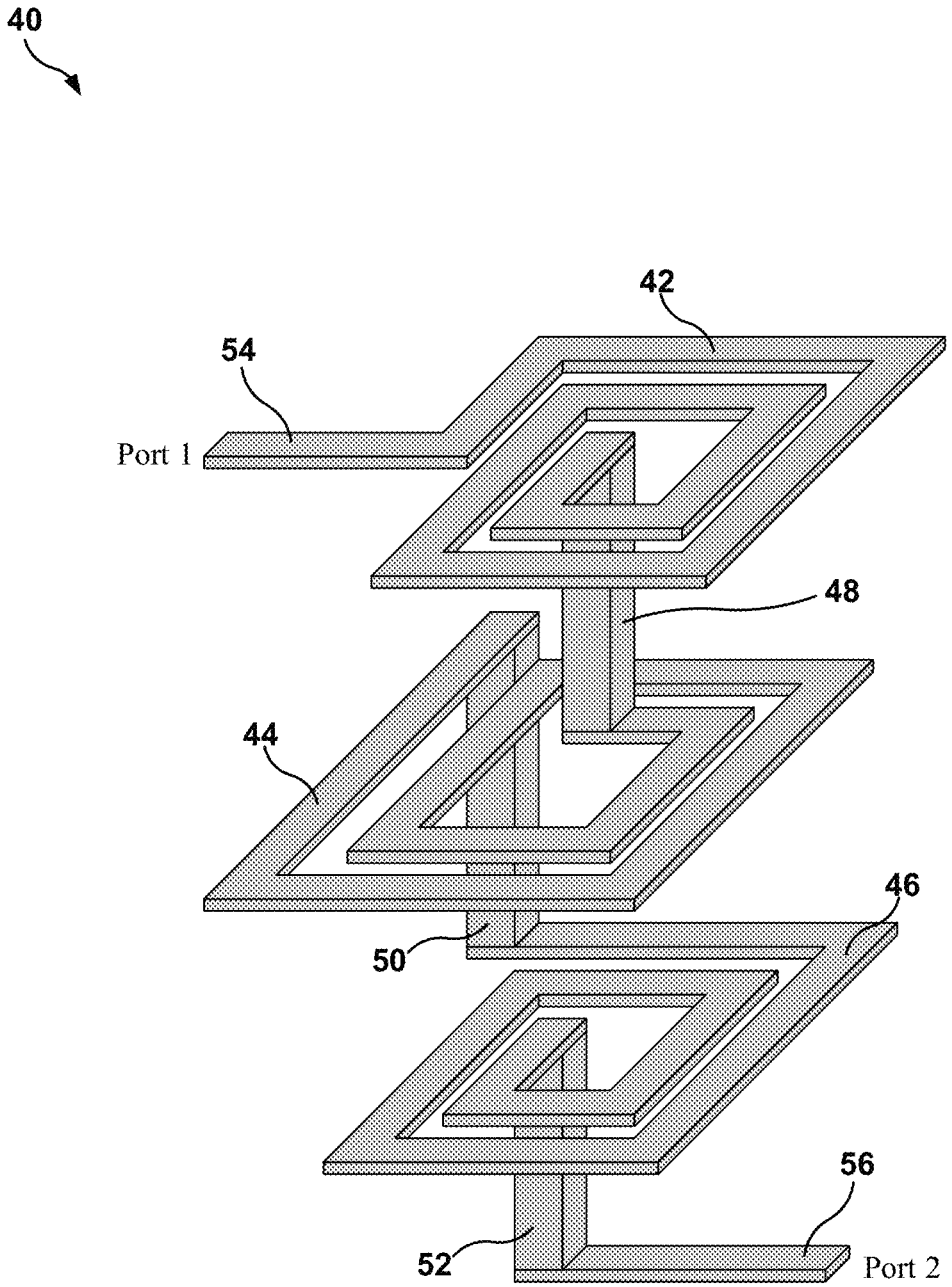
FIG. 3 is a conceptual and schematic diagram illustrating an example multilayer inductor core formed over a substrate as part of a device.

In some examples, instead of including a single spiral portion 20, an inductor may include multiple spiral portions formed in different layers. FIG. 3 is a conceptual and schematic diagram illustrating an example multilayer inductor core 40 formed over a substrate (not shown in FIG. 3) as part of a device (not shown in FIG. 3). Additionally, multilayer inductor core 40 may be at least partially surrounded by a coil portion of the inductor, and the inductor may be substantially encapsulated by dielectric or insulating material formed in one or more layers (e.g., first dielectric or insulating layer 16 and dielectric or insulating layer 18 of FIG. 1).

Multilayer inductor core 40 includes a first port 54 and a second port 56, which may be similar to or substantially the same as first port 24 and second port 26 illustrated in FIG. 1. Multilayer inductor core 40 also includes a plurality of spiral portions 42, 44, and 46. Although FIG. 1 illustrates three spiral portions 42, 44, and 46, in other examples, multilayer inductor core 40 may include more or fewer spiral portions 42, 44, and 46. In general, multilayer inductor core 40 may include a plurality of spiral portions. Each of spiral portions 42, 44, and 46 may be similar to or substantially the same as spiral portions 20 and 32 described with respect to FIGS. 1 and 2. In some examples, each of spiral portions 42, 44, and 46 may be substantially the same. In other examples, at least one of spiral portions 42, 44, and 46 may be different in one or more ways from at least one other of spiral portions 42, 44, and 46.

First spiral portion 42 is electrically connected to second spiral portion 44 by first via 48. Similarly, second spiral portion 44 is electrically connected to third spiral portion 46 by second via 50. Third spiral portion 46 is electrically connected to second port 56 by third via 52. Each of vias 48, 50, and 52 may be similar to or substantially the same as via 22 described with respect to FIG. 1. In some examples, each of vias 48, 50, and 52 may be substantially the same. In other examples, at least one of vias 48, 50, and 52 may be different in one or more ways from at least one other of vias 48, 50, and 52.

Figure 4:
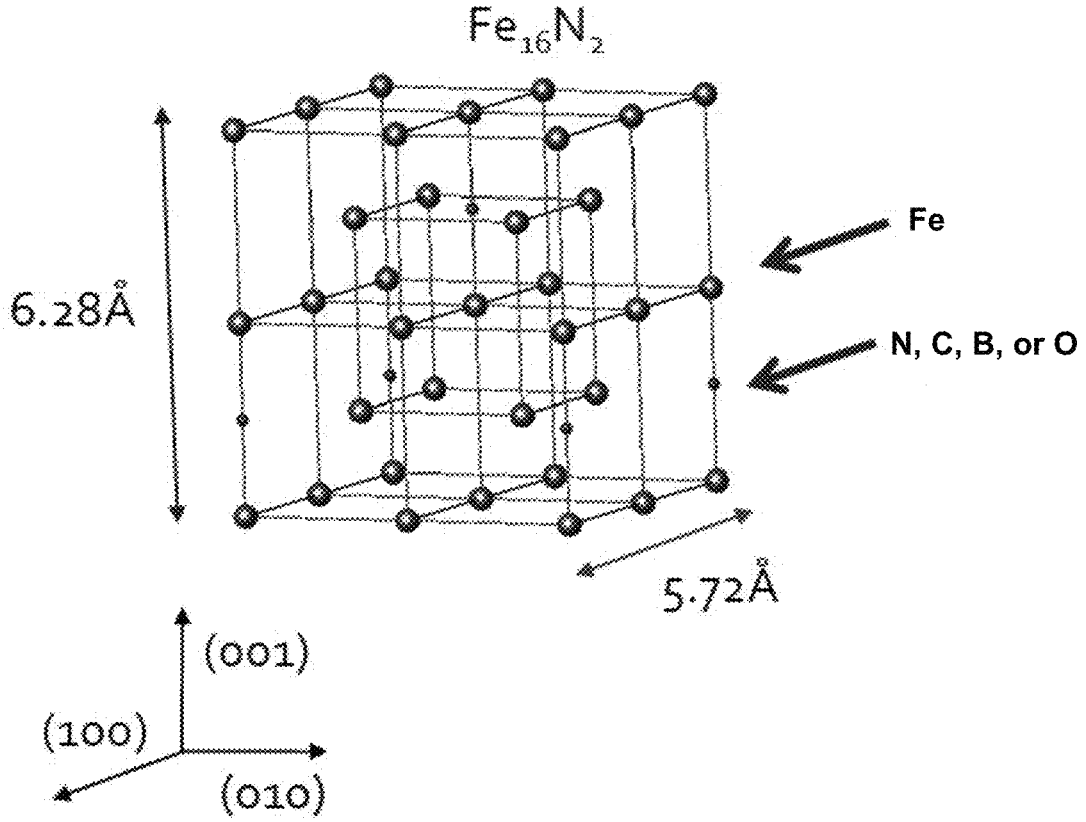
FIG. 4 is a conceptual diagram that shows an $\alpha''$-$Fe_{16}X_2$ unit cell, where X is at least one of N, C, B, or O.

At least some of inductor 12 and multilayer inductor core 40 may be formed of a magnetic material including $Fe_{16}(N_xZ_{1-x})_2$ or a mixture of $\alpha''$-$Fe_{16}N_2$ and $\alpha''$-$Fe_{16}Z_2$, where Z includes at least one of C, B, or O. For example, spiral portions 20, 32, 42, 44, or 46 may include a magnetic material including $Fe_{16}(N_xZ_{1-x})_2$ or a mixture of $\alpha''$-$Fe_{16}N_2$ and $\alpha''$-$Fe_{16}Z_2$. FIG. 4 is a conceptual diagram that shows an $\alpha''$-$Fe_{16}X_2$ unit cell. As shown in FIG. 3, in the $\alpha''$-$Fe_{16}X_2$ phase, the X atoms are aligned along the (002) (iron) crystal planes. The X atoms may include at least one of N, C, B, or O. When all the X atoms are N atoms, the iron nitride unit cell is distorted such that the length of the unit cell along the <001> axis is approximately 6.28 angstroms (Å) while the length of the unit cell along the <010> and <100> axes is approximately 5.72 Å. The $\alpha''$-$Fe_{16}N_2$ unit cell may be referred to as a bet unit cell when in the strained state. When the $\alpha''$-$Fe_{16}N_2$ unit cell is in the strained state, the <001> axis may be referred to as the c-axis of the unit cell. The c-axis may be the magnetic easy axis of the $\alpha''$-$Fe_{16}N_2$ unit cell. In other words, $\alpha''$-$Fe_{16}N_2$ crystals exhibit magnetic anisotropy.

$\alpha''$-$Fe_{16}N_2$ has high saturation magnetization and magnetic anisotropy constant. Additionally, iron and nitrogen are abundant elements, and thus are relatively inexpensive and easy to procure.

As described above, $\alpha''$-$Fe_{16}N_2$ is a hard magnetic material, having a magnetic easy axis lying along the c-axis. Calculations show that the magnetocrystalline anisotropy of $\alpha''$-$Fe_{16}N_2$ may be about $1.6\times10^7$ erg/cm$^3$. $\alpha''$-$Fe_{16}N_2$ also has a relatively high theoretical magnetic saturation moment of about 2.3 Bohr magnetons per Fe atom ($\mu_B$/Fe).

Similarly, when X includes at least one of C, B, or O (Z atoms), $\alpha''$-$Fe_{16}Z_2$ may be a hard magnetic material when the Z atoms are ordered within the iron crystal lattice. Similar to $\alpha''$-$Fe_{16}N_2$, the Z atoms (C, B, or O) in ordered $\alpha''$-$Fe_{16}Z_2$ may be positioned at interstitial sites within the iron crystal. However, in ordered $\alpha''$-$Fe_{16}Z_2$, the lattice parameters may be different than in $\alpha''$-$Fe_{16}N_2$. For example, while not wishing to be bound by any theory, the presence of carbon atoms is expected to reduce the distance between the C atoms and the surrounding Fe atoms lying in the (002) (iron) crystal planes from 3.74 Angstroms to 3.68 Angstroms. This is expected to increase p-d mixing, which is expected to increase bandwidth and lower the density of states. This is expected to reduce the magnetocrystalline anisotropy of $\alpha''$-$Fe_{16}C_2$ to a negative value. Similar results may be expected for B and O atoms.

Ordered $\alpha''$-$Fe_{16}Z_2$, such as when Z is carbon (C), may exhibit magnetocrystalline anisotropy with a magnetic easy axis lying in the a-b plane (e.g., [100]; perpendicular to the c-axis). Hence, the direction of magnetocrystalline anisotropy in $\alpha''$-$Fe_{16}Z_2$ may be substantially perpendicular to the direction of magnetocrystalline anisotropy in $\alpha''$-$Fe_{16}N_2$. Calculations show that the magnetocrystalline anisotropy in ordered $\alpha''$-$Fe_{16}C_2$ may be about $-1.4\times10^7$ erg/cm. $\alpha''$-$Fe_{16}C_2$ also has a relatively high theoretical magnetic saturation moment of about 2.1$\mu_B$/Fe.

Hence, when ordered $\alpha''$-$Fe_{16}C_2$ is mixed in predetermined quantities with $\alpha''$-$Fe_{16}N_2$ with c-axes of the respective $\alpha''$-$Fe_{16}C_2$ and $\alpha''$-$Fe_{16}N_2$ crystals oriented in substantially the same direction, the magnetocrystalline anisotropies of α"-$Fe_{16}C_2$ and α"-$Fe_{16}N_2$ may substantially cancel, leaving the material with a magnetocrystalline anisotropy value of near zero, while providing a theoretical magnetic saturation moment of about $2.2\mu_B$/Fe (the average of the theoretical magnetic saturation moments of α"-$Fe_{16}N_2$ and α"-$Fe_{16}C_2$. For example, a magnetic material including a volume ratio of α"-$Fe_{16}N_2$ to α"-$Fe_{16}C_2$ of about 4.667:5.333 may have a coercivity of about 0 and a theoretical magnetic saturation moment of about $2.2\mu_B$Fe. In this way, a mixture of predetermined volumes of α"-$Fe_{16}N_2$ domains and α"-$Fe_{16}C_2$ domains may produce a magnetic material with a magnetocrystalline anisotropy value of near zero and a relatively high magnetic saturation moment. Similar results may be expected when B, O, or both are substituted for C, based on the similar atomic radii of C, B, and O.

Further, because the low coercivity does result from large grain sizes, and the resisitivity is relatively high (e.g., compared to iron), the cut-off frequency for the inductor may be relatively high. Additionally or alternatively, the relatively high saturation magnetization and permeability of the magnetic material may allow inductors to be smaller while maintaining or even increasing its inductance.

Figure 5:
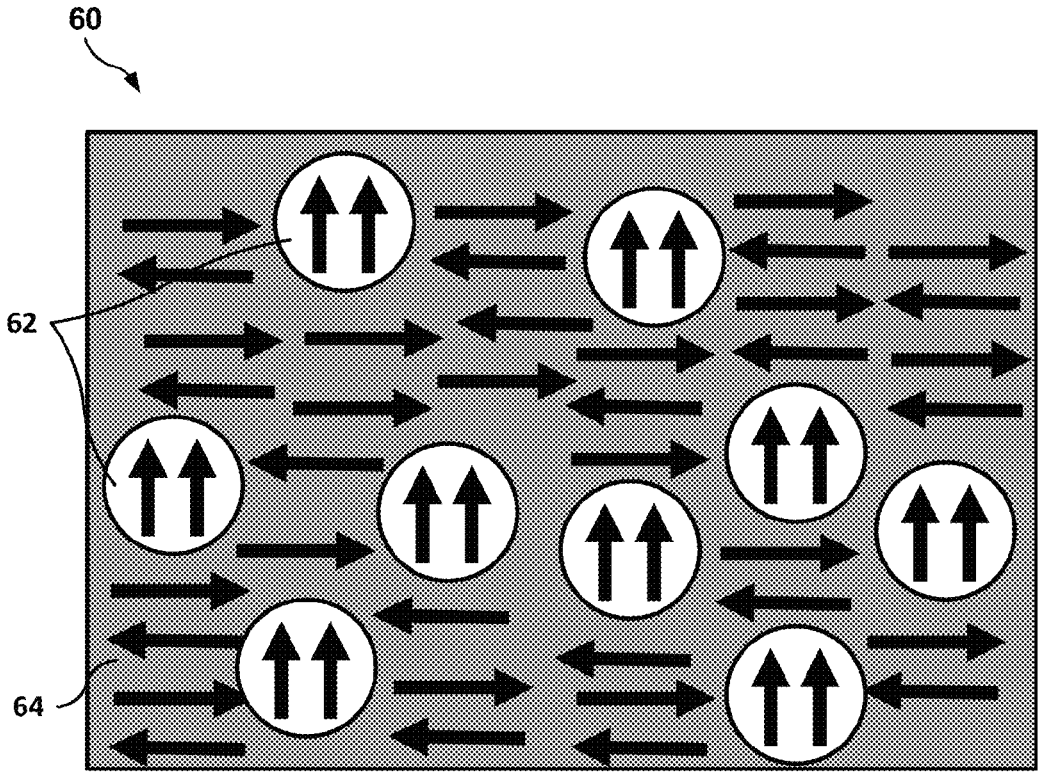
FIG. 5 is a conceptual diagram illustrating a magnetic material including domains of $\alpha''$-$Fe_{16}N_2$ and domains of $\alpha''$-$Fe_{16}Z_2$, where Z includes at least one of C, B, or O.

In some examples, the resulting material may be similar to that shown in FIG. 5. FIG. 5 is a conceptual diagram illustrating a magnetic material 60 including domains of α"-$Fe_{16}N_2$ 62 and domains of α"-$Fe_{16}Z_2$ 64, where Z includes at least one of C, B, or O. In some examples, discrete domains of α"-$Fe_{16}N_2$ 62 may be present, along with discrete domains of α"-$Fe_{16}Z_2$ 64. The easy axes of the domains of α"-$Fe_{16}N_2$ 62 are illustrated as being oriented substantially vertically in FIG. 5, while the easy axes of the domains of α"-$Fe_{16}Z_2$ 64 are illustrated as being oriented substantially horizontally in FIG. 5. When domains of α"-$Fe_{16}N_2$ 62 and domains of α"-$Fe_{16}Z_2$ 64 are present in approximately equal volumes, this may lead the magnetocrystalline anisotropy of similar magnitudes and opposite signs to annihilate each other, resulting in a material with high saturation magnetization and low magnetocrystalline anisotropy.

In other examples, rather than all of the respective domains of α"-$Fe_{16}N_2$ 62 having their magnetic easy axes lying in substantially the same direction, the respective easy axes of the respective domains of α"-$Fe_{16}N_2$ 62 may be substantially randomly distributed. Similarly, the respective easy axes of the respective domains of α"-$Fe_{16}Z_2$ 64 may be substantially randomly distributed. This also may lead to a material with high saturation magnetization and low magnetocrystalline anisotropy.

In some examples, the structure shown in FIG. 5 may be formed by annealing a material including a mixture of iron, carbon, and nitrogen in selected ratios to convert the mixture of iron, carbon, and nitrogen to domains of α"-$Fe_{16}N_2$ 62 and domains of α"-$Fe_{16}Z_2$ 64. Further details regarding example techniques for forming the material illustrated in FIG. 5 will be described below.

In some examples, rather than including discrete domains of α"-$Fe_{16}N_2$ and α"-$Fe_{16}Z_2$, a material may include one or more crystals of α"-$Fe_{16}(N_xZ_{1-x})_2$, where Z includes at least one of C, B, or O, and x is a number greater than 0 and less than 1. In these examples, rather than forming discrete domains, the iron, nitrogen, and Z atoms form a crystalline structure in which some interstitial locations are filled by nitrogen atoms and some interstitial locations are filled by Z atoms. For example, FIG. 4 illustrates an example α"-$Fe_{16}X_2$ unit cell, as described above. The unit cell in FIG. 4 illustrates five X atoms (1 X atom is fully in the unit cell, and 4× atoms are partially in the unit cell). In α"-$Fe_{16}(N_xZ_{1-x})_2$ at least some of the X atoms may be N atoms, and at least some of the X atoms may be Z (C, B, or O) atoms. Although α"-$Fe_{16}(N_xZ_{1-x})_2$ may not include some N atoms and some Z atoms in each unit cell (e.g., some unit cells may include only N atoms and some unit cells may include only Z atoms), when averaged over the volume of the soft magnetic material, the ratio of Fe to N to Z atoms may be expressed by the chemical formula $Fe_{16}(N_xZ_{1-x})_2$, where x is greater than 0 and less than 1.

In some examples, the magnetic material including $Fe_{16}(N_xZ_{1-x})_2$ may not include only $Fe_{16}(N_xZ_{1-x})_2$. For example, the magnetic material may include at least one α"-$Fe_{16}N_2$ phase domain or at least one α"-$Fe_{16}Z_2$ domain in addition to at least one $Fe_{16}(N_xZ_{1-x})_2$ phase domain. In some examples, the magnetic material including $Fe_{16}(N_xZ_{1-x})_2$ may include other iron phases, other iron nitride phases, other iron carbide phases, or other phase including other constituents (e.g., dopants or impurities) present in the magnetic material.

Similarly, the magnetic material including a mixture of α"-$Fe_{16}N_2$ and α"-$Fe_{16}Z_2$ may not include only α"-$Fe_{16}N_2$ and α"-$Fe_{16}Z_2$. For example, the magnetic material may include at least one $Fe_{16}(N_xZ_{1-x})_2$ phase domain in addition to at least one α"-$Fe_{16}N_2$ phase domain and at least one α"-$Fe_{16}Z_2$ phase domain. In some examples, the magnetic material including a mixture of α"-$Fe_{16}N_2$ and α"-$Fe_{16}Z_2$ may include other iron phases, other iron nitride phases, other iron carbide phases, or other phase including other constituents (e.g., dopants or impurities) present in the magnetic material.

In some examples, a magnetic material including at least one α"-$Fe_{16}(N_xZ_{1-x})_2$ phase domain may include at least about 35 volume percent α"-$Fe_{16}(N_xZ_{1-x})_2$ phase domain(s). In other examples, the magnetic material may include at least about 40 volume percent, at least about 50 volume percent, or at least about 60 volume percent α"-$Fe_{16}(N_xZ_{1-x})_2$ phase domain(s). Similarly a magnetic material including a mixture of α"-$Fe_{16}N_2$ and α"-$Fe_{16}Z_2$ may include at least about 35 volume percent of the combination of α"-$Fe_{16}N_2$ and α"-$Fe_{16}Z_2$ phase domains. In other examples, the magnetic material may include at least about 40 volume percent, at least about 50 volume percent, or at least about 60 volume percent of the combination of α"-$Fe_{16}N_2$ and α"-$Fe_{16}Z_2$ phase domains.

In some examples, the magnetic material including $Fe_{16}(N_xZ_{1-x})_2$ or a mixture of α"-$Fe_{16}N_2$ and α"-$Fe_{16}Z_2$ may have a saturation magnetization of at least about 200 emu/gram. In some examples, the magnetic material including $Fe_{16}(N_xZ_{1-x})_2$ or a mixture of α"-$Fe_{16}N_2$ and α"-$Fe_{16}Z_2$ may have a saturation magnetization of at least about 219 emu/gram, which is the saturation magnetization of pure iron. In some examples, the magnetic material including $Fe_{16}(N_xZ_{1-x})_2$ or a mixture of α"-$Fe_{16}N_2$ and α"-$Fe_{16}Z_2$ may have a saturation magnetization of at least about 242 emu/gram, which is the saturation magnetization of $Fe_{65}Co_{35}$. In some examples, the magnetic material including $Fe_{16}(N_xZ_{1-x})_2$ or a mixture of α"-$Fe_{16}N_2$ and α"-$Fe_{16}Z_2$ may have a saturation magnetization of at least about 250 emu/gram.

In some examples, the magnetic material including $Fe_{16}(N_xZ_{1-x})_2$ or a mixture of α"-$Fe_{16}N_2$ and α"-$Fe_{16}Z_2$ may have a magnetic coercivity of less than or equal to about 10 Oerstads.

Figure 6:
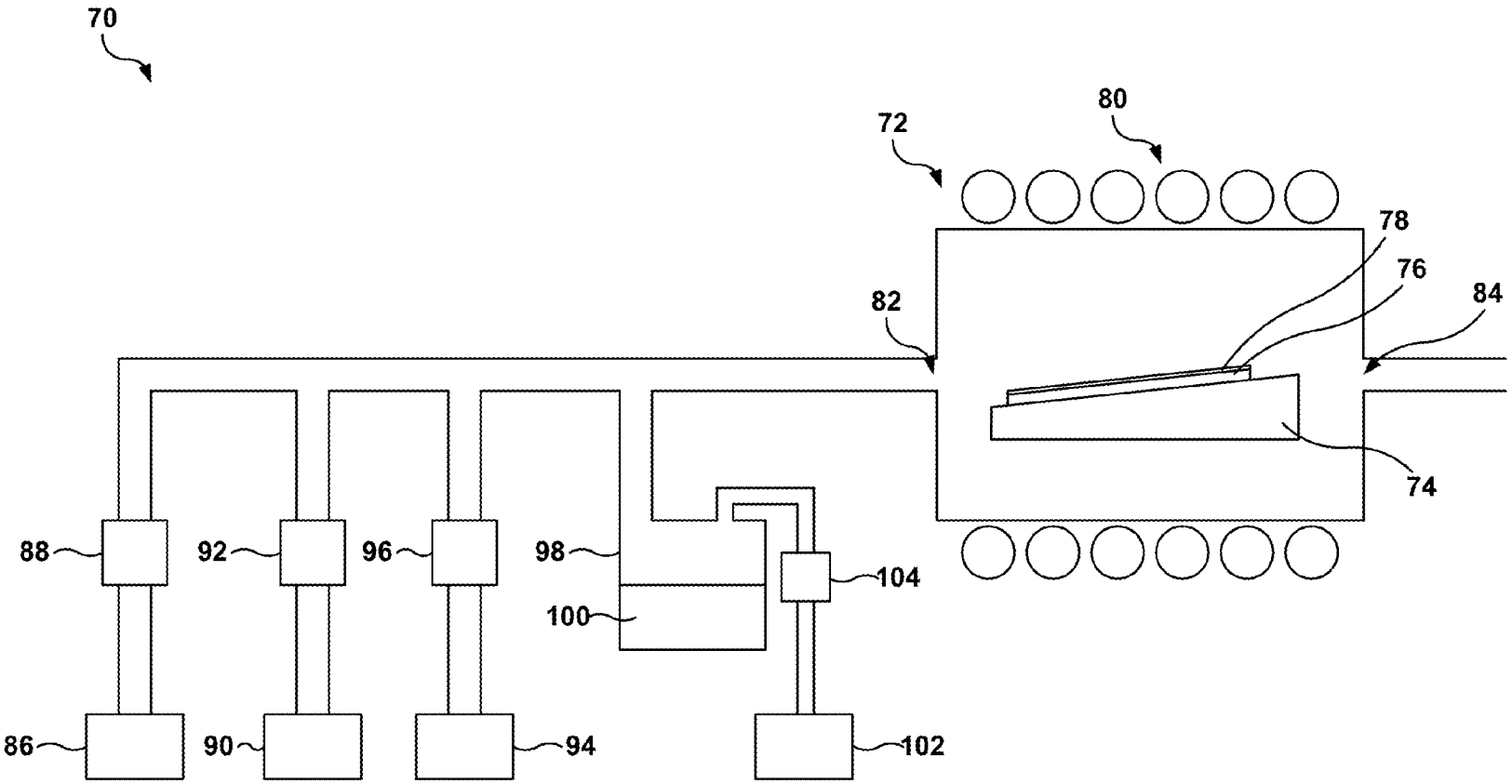
FIG. 6 is a conceptual and schematic diagram illustrating an example chemical vapor deposition system for forming an inductor from a magnetic material including at least one layer including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O.

In some examples, an inductor including the magnetic material including $Fe_{16}(N_xZ_{1-x})_2$ or a mixture of α"-$Fe_{16}N_2$ and α"-$Fe_{16}Z_2$ may be formed using chemical vapor deposition (CVD) or liquid phase epitaxy (LPE) in combination with etching, chemical mechanical polishing (CMP), or the like. FIG. 6 is a conceptual and schematic diagram illustrating an example CVD system 70 for forming depositing a magnetic material including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O as part of an inductor. In particular, CVD system 70 may be used to form a coating including iron, nitrogen, and at least one of carbon, boron, or oxygen, which then may be annealed to form a magnetic material including $\alpha''$-$Fe_{16}(N_xZ_{1-x})_2$ or a mixture of $\alpha''$-$Fe_{16}N_2$ and $\alpha''$-$Fe_{16}Z_2$.

System 70 includes a CVD chamber 72, which may enclose a susceptor 74. A substrate 76 is held by susceptor 74, and coating 78 is formed on at least a portion of substrate 76. Coating 78 may form a part of an inductor, such as inductor 12 of FIG. 1 or multilayer inductor 50 of FIG. 3. CVD chamber 72 may include, for example, quartz or another refractory material. In some examples, CVD chamber 72 may be formed of a material that is substantially transparent to radio frequency (RF) magnetic energy.

In some examples, CVD chamber 72 is at least partially surrounded by RF induction coils 80. RF induction coils 80 may be electrically connected to an RF source (not shown in FIG. 6), which causes an alternating electrical current at RF to flow through RF induction coils 80. In some examples, the RF magnetic field generated by RF induction coils 80 may be absorbed by susceptor 74, which converts the RF energy to heat. This heats substrate 76. Hence, in some examples, susceptor 74 may include graphite or another material that absorbs RF energy of the frequency generated by RF induction coils 80.

In some examples, susceptor 74 may be shaped or oriented to position substrate 76 at an incline with respect to inlet 82. Positioning substrate 76 at an incline with respect to inlet 82 may reduce or substantially eliminate downstream depletion, which is a phenomena in which downstream portions of substrate 76 are coated with a thinner coating than upstream portions of substrate 76 due to depletion of reactants from the coating gas as the coating gas flows along a substantially horizontal substrate 76.

In some examples, rather than including a susceptor 74 heated by RF induction coils 80, CVD chamber 72 may be heated such that an entire volume of CVD chamber 72 is heated. For example, CVD chamber 72 may be disposed in a furnace, or CVD chamber 72 may be formed of a material that absorbs RF energy and heats the volume of CVD chamber 72.

Substrate 76 may include a substrate, such as substrate 14 described with respect to FIG. 1. In some examples, substrate 76 may include a crystalline material with a different lattice structure, different lattice parameters, or both, than at least one of $\alpha''$-$Fe_{16}N_2$, $\alpha''$-$Fe_{16}Z_2$, or $\alpha''$-$Fe_{16}(N_xZ_{1-x})_2$, where Z includes at least one of C, B, or O. In some examples, substrate 76 additionally or alternatively may have a different coefficient of thermal expansion (CTE) than at least one of $\alpha''$-$Fe_{16}N_2$, $\alpha''$-$Fe_{16}Z_2$, or $\alpha''$-$Fe_{16}(N_xZ_{1-x})_2$. In examples in which substrate 76 includes at least one of a different lattice structure, different lattice parameters, or a different CTE than at least one of $\alpha''$-$Fe_{16}N_2$, $\alpha''$-$Fe_{16}Z_2$, or $\alpha''$-$Fe_{16}(N_xZ_{1-x})_2$ substrate 76 may exert a strain on coating 78 during an annealing technique, which may facilitate formation of at least one of $\alpha''$-$Fe_{16}(N_xZ_{1-x})_2$ or a mixture of $\alpha''$-$Fe_{16}N_2$ and $\alpha''$-$Fe_{16}Z_2$ in coating 78.

CVD chamber 72 may include an inlet 82 and an outlet 84. Inlet 82 may be fluidically connected to one or more sources of coating gases. For example, in system 70, inlet 82 is fluidically connected to a carrier gas source 86, a first source 90 of a coating constituent, and a second source 94 of a coating constituent, and a third source 98 of a coating constituent.

In some examples, carrier gas source 86 may include a gas that carries the coating gas to the interior of CVD chamber 72. In some examples, carrier gas source 86 may include a source of substantially inert gas (e.g., a gas that is substantially non-reactive with other elements and compounds present in system 70 during operation of system 70). A substantially inert gas may include, for example, a noble gas, such as argon.

In some examples, carrier gas source 86 additionally or alternatively may include a gas that may react with one or more elements and compounds present in system 70. For examples, carrier gas source 86 may include a source of hydrogen gas ($H_2$). In some examples, hydrogen gas may react with an iron precursor to liberate iron. In some instances, carrier gas source 86 may include a mixture of a substantially inert gas and a gas that reacts with one or more elements and compounds present in system 70. For example, carrier gas source 86 may include a mixture of hydrogen gas and argon.

Carrier gas source 86 may be fluidically connected to CVD chamber 72 via conduit or piping, and at least one valve 88. Valve 88 may be used to control flow of carrier gas from carrier gas source 86 to CVD chamber 72.

System 70 also includes first source 90. First source 90 may include a source of a vapor including a nitrogen-containing compound. In some examples, first source 90 may include a gaseous source of a nitrogen precursor, such as gaseous ammonia ($NH_3$). In other examples, first source 90 may include a liquid or solid source of a nitrogen precursor, such as ammonium nitrate ($NH_4NO_3$; solid), an amide (liquid or solid), or hydrazine (liquid).

Amides include a C—N—H bond and hydrazine includes an N—N bond. Ammonium nitrate, amides and hydrazine may serve as a nitrogen donor for forming the powder including iron nitride. Example amides include carbamide ($(NH_2)_2CO$; also referred to as urea), methanamide (Formula 1), benzamide (Formula 2), and acetamide (Formula 3), although any amide may be used.

Formula 1

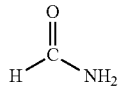

Formula 2

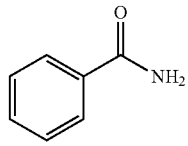

Formula 3

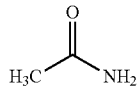

In some examples, amides may be derived from carboxylic acids by replacing the hydroxyl group of a carboxylic acid with an amine group. Amides of this type may be referred to as acid amides.

In examples in which the nitrogen-containing compound in first source 90 is a solid or liquid, first source 90 may include a heat source to vaporize the nitrogen-containing compound and form a vapor including a nitrogen-containing compound.

First source 90 may be fluidically connected to CVD chamber 72 via conduit or piping, and at least one valve 92. Valve 92 may be used to control flow of nitrogen-containing vapor from first source 90 to CVD chamber 72.

System 70 also includes second source 94. Second source 94 may include a source of a vapor including a Z atom-containing compound, where Z includes at least one of carbon, boron, or oxygen. For the purposes of description only, FIGS. 6 and 7 will be described with second source 94 being a source of a carbon-containing compound. However, it will be appreciated that similar principles may be applied to sources of a boron-containing material, sources of an oxygen containing material, or both.

In some examples, second source 94 may include a gaseous source of a carbon-containing compound, such as gaseous carbon monoxide (CO), gaseous carbon dioxide ($CO_2$), or gaseous methane ($CH_4$). In other examples, second source 94 may include a liquid or solid source of a carbon-containing compound, such as pure carbon (e.g., graphite) or urea. In examples in which the nitrogen-containing compound in second source 94 is a solid or liquid, second source 94 may include a heat source to vaporize the nitrogen-containing compound and form a vapor including a nitrogen-containing compound.

Second source 94 may be fluidically connected to CVD chamber 72 via conduit or piping, and at least one valve 96. Valve 96 may be used to control flow of nitrogen-containing vapor from second source 94 to CVD chamber 72.

In some examples, such as when urea is used both for the carbon source and the nitrogen source, system 70 may not include separate first and second sources 90 and 94 for the nitrogen-containing compound and the carbon containing compound, but may instead include a single source for both the nitrogen-containing compound and the carbon containing compound.

System 70 also includes third source 98. Third source 98 may include a source of iron or an iron precursor (or donor). In the example shown in FIG. 6, third source 98 contains a liquid iron donor 100, such as $FeCl_3$ or $Fe(CO)_5$. Third source 98 is fluidically coupled to a gas source 102 via valve 104, which controls flow of gas from gas source 102 into third source 98. In some examples, gas source 102 may be a source of hydrogen ($H_2$) has or another reducing gas.

Gas from gas source 102 flows into third source 98 and vaporizes at least some of liquid iron donor 100. Gas from gas source 102 then carries the vapor including the iron-containing compound into CVD chamber 72 through inlet 82.

Valves 88, 92, 96, and 104 may be used to control the total flow rate of gases and vapors into CVD chamber 72, and the relative proportion of carrier gas, the vapor including the nitrogen-containing compound, the vapor including the carbon-containing compound, and the vapor including the iron-containing compound in the gases and vapors flowing into CVD chamber 72. For example, valves 88, 92, 96, and 104 may be controlled to allow the carrier gas, the vapor including the nitrogen-containing compound, the vapor including the carbon-containing compound, and the vapor including the iron-containing compound to flow into CVD chamber 72 to produce an atomic ratio of iron to the combination nitrogen and carbon in the gases and vapors flowing into CVD chamber 72 to be between about 11.5:1 (iron:nitrogen+carbon) and about 5.65:1 (iron:nitrogen+carbon). For example, the atomic ratio of iron to the combination of nitrogen and carbon in the gases and vapors flowing into CVD chamber 72 may be about 9:1 (iron:nitrogen+carbon), about 8:1 (iron:nitrogen+carbon), or about 6.65:1 (iron:nitrogen+carbon).

Additionally, valves 92 and 96 may be controlled to control the relative flow rates of the vapor including the nitrogen-containing compound and the vapor including the carbon-containing compound to produce a predetermined atomic ratio of nitrogen to carbon in the gases flowing into CVD chamber 72. For example, valves 92 and 96 may be controlled to control the relative flow rates of the vapor including the nitrogen-containing compound and the vapor including the carbon-containing compound to produce an atomic ratio of nitrogen to carbon of between about 0.1:1 and 10:1, such as about 1:1 or about 4.667:5.333.

In some examples, valves 88, 92, 96, and 104 may be controlled to produce a flow rate of the carrier gas between about 5 standard $cm^3$/minute (sccm) and about 5,000 sccm, flow rate of the vapor including the nitrogen-containing compound between about 10 sccm and about 1.000 sccm, a flow rate of the vapor including the carbon-containing compound between about 0.1 sccm and about 1,000 sccm, and a flow rate of the vapor including the iron-containing compound between about 100 sccm and about 5,000 sccm. Flow rates such as these may result in a growth rate of coating 78 of between about 100 micrometers per hour (μm/h) and about 1,000 μm/h.

In some examples, substrate 76 may be heated by susceptor 74 and RF induction coils 80 above at least one of a decomposition temperature of the iron-containing compound, the decomposition temperature of the nitrogen-containing compound, or a decomposition temperature of the carbon-containing compound. For example, substrate 76 may be heated to a temperature between about 200° C. and about 1,000° C. by susceptor 74 and RF induction coils 80.

In some examples in which substantially only susceptor 74 and substrate 76 is heated, the iron-containing compound, the nitrogen-containing compound, and the carbon-containing compound may decompose to release iron, nitrogen, and carbon, or may react with each other to form an iron-nitrogen-carbon compound. Because substrate 76 is heated, this reaction or reactions may occur at the surface of substrate 76, resulting in coating 78 being formed and including iron, nitrogen, and carbon.

In examples in which substantially the entire volume of CVD chamber 72 is heated (e.g., by a furnace), the decomposition reactions or reaction between the iron-containing compound, the nitrogen-containing compound, and the carbon-containing compound may occur above substrate within the volume of CVD chamber 72. The liberated iron, carbon, and nitrogen atoms or iron-carbide-nitride compound then may deposit on the surface of substrate 76 in coating 78.

In some examples, a reaction between the iron-containing compound, the nitrogen containing compound, and the carbon-containing compound may include:

$$16FeCl_3+2NH_3+2CH_4+17H_2 \rightarrow 2Fe_8NC+48HCl$$

As described above, the ratio of iron to nitrogen plus carbon in the gases and vapors entering CVD chamber 72 during formation of coating 76 may be between about 11.5:1 (iron:(nitrogen+carbon)) and about 5.65:1 (iron:(nitrogen+carbon)), such as about 8:1 (iron:(nitrogen+carbon)). Coating 78 may include approximately the same ratio of iron to nitrogen in the gases and vapors entering CVD chamber 72. Thus, coating 78 may include an iron to nitrogen plus carbon ratio of between about 11.5:1 (iron:(nitrogen+carbon)) and about 5.65:1 (iron:(nitrogen+carbon)), such as about 9:1

(iron:(nitrogen+carbon)), about 8:1 (iron:(nitrogen+carbon)), or about 6.65:1 (iron:(nitrogen+carbon)).

In some examples, portions of substrate 76 may be masked, leaving only portions of substrate 76 exposed on which coating 78 is formed. For example, portions of substrate 76 may be masked to define the shape of the portion of the inductor being deposited in the CVD process. In other examples, coating 78 may be etched after deposition of coating 78 (e.g., before or after annealing coating 78) to remove the portions of coating 78, leaving only portions of substrate 76 coated with coating 78 (e.g., corresponding to the shape of the portion of the inductor being deposited in the CVD process). In this way, in some examples, coating 78 may be controllably formed on only selected portions of substrate 76 and later converted to the magnetic material.

In some examples, once coating 78 has been formed to a predetermined thickness, substrate 76 and coating 78 may be removed from CVD chamber 72 and subjected to an annealing technique. In other examples, additional CVD steps or other processing techniques (e.g., chemical mechanical polishing, etching, patterning, or the like) may be performed on substrate 76 and/or coating 78 before annealing coating 78. The annealing technique may facilitate magnetic material including at least one of $\alpha''$-$Fe_{16}(N_xZ_{1-x})_2$ phase (where Z includes at least one of C, B, or O) or a mixture of $\alpha''$-$Fe_{16}N_2$ phase and $\alpha''$-$Fe_{16}Z_2$ phase in coating 78.

The annealing technique may be carried out at a temperature that produces strain in coating 78 due to differences in the coefficients of thermal expansion for substrate 76 and coating 78 to access at least one of the mixture of $\alpha''$-$Fe_{16}N_2$ phase and $\alpha''$-$Fe_{16}C_2$ phase or the $\alpha''$-$Fe_{16}(N_xC_{1-x})_2$ phase. Additionally, the annealing technique allows diffusion of N+ ions, C+ ions, or both within iron crystals in coating 78 to form at least one of $\alpha''$-$Fe_{16}N_2$. $\alpha''$-$Fe_{16}Z_2$, or $\alpha''$-$Fe_{16}(N_xZ_{1-x})_2$. In some examples, annealing at relatively low temperatures allows transformation of partial $Fe_8N$ disordered phase into $\alpha''$-$Fe_{16}N_2$ ordered phase. Similarly, annealing at relatively low temperatures is expected to allow transformation of partial $Fe_8C$ disordered phase into $\alpha''$-$Fe_{16}C_2$ ordered phase and partial $Fe_8(N_xC_{1-x})$ disordered phase into $\alpha''$-$Fe_{16}(N_xC_{1-x})_2$ ordered phase.

In some examples, the annealing technique may be carried out at a temperature below about 300° C., such as between about 120° C. and about 300° C., between about 120° C. and about 220° C., or between about 150° C. and about 220° C. The annealing technique may be performed in a nitrogen ($N_2$) or argon (Ar) atmosphere, or in a vacuum or near-vacuum.

The temperature and duration of the annealing step may be selected based on, for example, a size of the sample and diffusion coefficient of nitrogen atoms in iron and Z atoms in iron at the annealing temperature. Based on these factors, the temperature and duration may be selected to provide sufficient time for nitrogen atoms to diffuse to locations within coating 78 to form $Fe_{16}N_2$ domains, $\alpha''$-$Fe_{16}C_2$ domains, and/or $\alpha''$-$Fe_{16}(N_xC_{1-x})_2$ domains.

Additionally, the temperature and duration of the annealing technique may be selected based on a desired volume fraction of the respective phase domains in coating 78. For example, at a selected temperature, a longer annealing technique may result in a higher volume fraction of $\alpha''$-$Fe_{16}N_2$, $\alpha''$-$Fe_{16}C_2$, and/or $\alpha''$-$Fe_{16}(N_xC_{1-x})_2$. Similarly, for a given annealing technique duration, a higher temperature may result in a higher volume fraction of $\alpha''$-$Fe_{16}N_2$, $\alpha''$-$Fe_{16}C_2$, and/or $\alpha''$-$Fe_{16}(N_xC_{1-x})_2$. However, for durations above a threshold value, the additional volume fraction of $\alpha''$-$Fe_{16}N_2$, $\alpha''$-$Fe_{16}C_2$, and/or $\alpha''$-$Fe_{16}(N_xC_{1-x})_2$ may be limited or eliminated, as the volume fraction of $\alpha''$-$Fe_{16}N_2$, $\alpha''$-$Fe_{16}C_2$, and/or $\alpha''$-$Fe_{16}(N_xC_{1-x})_2$ reaches a relatively stable value. For example, at a temperature of about 150° C., after about 20 hours, the volume fraction of $\alpha''$-$Fe_{16}N_2$ reaches a stable value. The duration of the annealing step may be at least about 5 hours, such as at least about 20 hours, or between about 5 hours and about 100 hours, or between about 5 hours and about 80 hours or between about 20 hours and about 80 hours, or about 40 hours.

$Fe_8N$ and $\alpha''$-$Fe_{16}N_2$ have similar body-centered tetragonal (bet) crystalline structure. However, in $\alpha''$-$Fe_{16}N_2$, nitrogen atoms are ordered within the iron lattice, while in $Fe_8N$, nitrogen atoms are randomly distributed within the iron lattice. The annealing technique facilitates formation of the bet $\alpha''$-$Fe_{16}N_2$ phase crystalline structure at least in part due to the strain exerted on the iron crystal lattice as a result of differential expansion of substrate 76 and coating 78 during the annealing step. For example, the coefficient of thermal expansion for iron is 11.8 μm/m·K, while for silicon it is 2.6 μm/m·K. This difference in thermal expansion coefficients results in a compression stress substantially parallel the major plane of coating 28 and a corresponding stretching force being generated along the <001> crystalline direction on a coating 28 with an (110) face. In some examples, the strain on coating 28 may be between about 0.3% and about 7%, which may result in a substantially similar strain on individual crystals of the iron nitride, such that the unit cell is elongated along the <001> axis between about 0.3% and about 7%. This may facilitate incorporation of nitrogen atoms at the preferred positions of the $\alpha''$-$Fe_{16}N_2$ crystal.

Similarly, carbon atoms in $\alpha''$-$Fe_{16}C_2$ and nitrogen and carbon atoms in $\alpha''$-$Fe_{16}(N_xC_{1-x})_2$ may be aligned along the (002) (iron) crystal planes. The annealing technique facilitates formation of the bet $\alpha''$-$Fe_{16}C_2$ phase crystalline structure or $\alpha''$-$Fe_{16}(N_xC_{1-x})_2$ in coating 78 at least in part due to the strain exerted on the iron crystal lattice as a result of differential expansion of substrate 76 and coating 78 during the annealing step.

Figure 7:
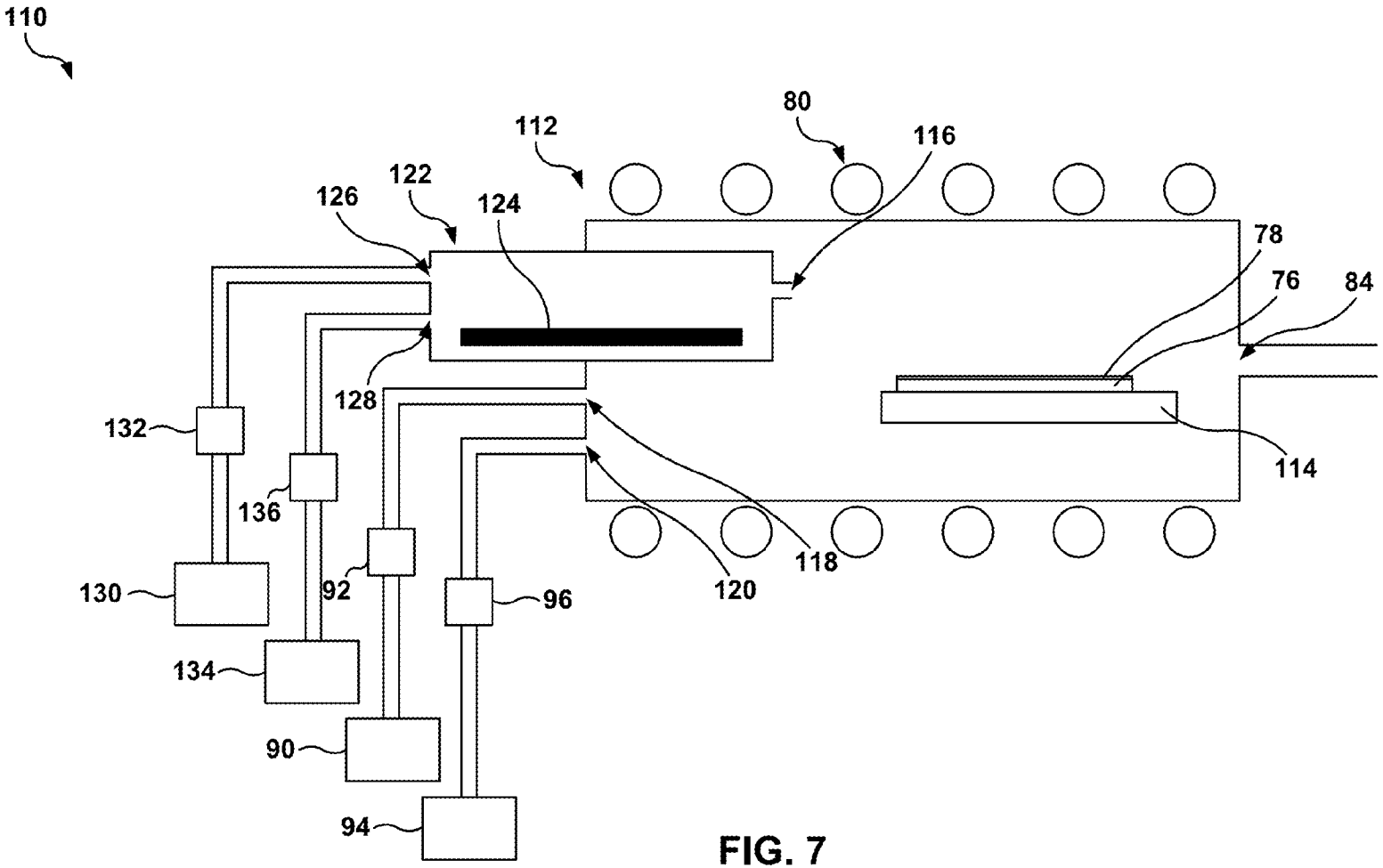
FIG. 7 is a conceptual and schematic diagram illustrating an example chemical vapor deposition system for forming an inductor including a magnetic material including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O.

Although FIG. 6 illustrates an example system 70 for CVD using a liquid iron-containing material, in other examples, CVD may be performed using a solid iron-containing material. FIG. 7 is a conceptual and schematic diagram illustrating an example chemical vapor deposition system 110 for forming a magnetic material including $\alpha''$-$Fe_{16}(N_xZ_{1-x})_2$ or a mixture of $\alpha''$-$Fe_{16}Z_2$ and $\alpha''$-$Fe_{16}N_2$, where Z includes at least one of C, B, or O. Similar to FIG. 6, FIG. 7 will be described with respect to examples where Z is carbon. However, it will be appreciated that similar principles may be applied to sources of a boron-containing material, sources of an oxygen containing material, or both. In some examples, system 110 of FIG. 7 may be similar to or substantially the same as system 70 described with reference to FIG. 6, aside from the differences described herein.

System 110 includes a CVD chamber 112. CVD chamber 112 encloses a susceptor 114, which may be similar or substantially the same as susceptor 74 of FIG. 6. In the example illustrated in FIG. 7, susceptor 114 is not shaped or oriented to position substrate 76 at an incline with respect to inlets 116, 118, and 120. In other examples, susceptor 114 may be shaped or oriented to position substrate 76 at an incline with respect to inlets 116, 118, and 120. CVD chamber 112 may include, for example, quartz or another refractory material. In some examples, CVD chamber 112 may be formed of a material that is substantially transparent to radio frequency (RF) magnetic energy.

CVD chamber 112 is at least partially surrounded by RF induction coils 30. RF induction coils 80 may be similar to or substantially the same as RF induction coils illustrated in FIG. 6. CVD chamber 112 encloses substrate 76, on which coating 78 is formed. Substrate 76 is disposed on susceptor 114.

In some examples, rather than including a susceptor 114 heated by RF induction coils 80, CVD chamber 112 may be heated such that an entire volume of CVD chamber 112 is heated. For example, CVD chamber 112 may be disposed in a furnace, or CVD chamber 112 may be formed of a material that absorbs RF energy and heats the volume of CVD chamber 112.

CVD chamber 112 may include inlets 116, 118, and 120 and an outlet 84. Inlets 116, 118, and 120 may be fluidically connected to one or more sources of coating gases. For example, in system 110, inlet 116 is fluidically connected to a chamber 122 enclosing a solid iron-containing material 124, inlet 118 is fluidically coupled to a first source 90 of a coating constituent via a valve 92, and inlet 120 is fluidically coupled to a second source 94 of a coating constituent via a valve 96. First source 90, valve 92, second source 94, and valve 96 may be similar to or substantially the same as described above with respect to FIG. 6. For example, first source 90 may include a source of a vapor including a nitrogen-containing compound and second source 94 may include a source of a vapor including a carbon-containing compound (more generally, a source of a vapor including at least one of a carbon-containing compound, a boron-containing compound, or an oxygen-containing compound.

Chamber 122 encloses a solid iron-containing material 124. In some examples, iron-containing material 124 may include an iron-containing powder, billet, or thin film deposited on a substrate. In some examples, iron-containing material 124 includes substantially pure iron (e.g., iron with a purity of greater than 90 at. %). In other examples, iron-containing material 124 may include iron oxide (e.g., $Fe_2O_3$ or $Fe_3O_4$).

Chamber 122 may include a first inlet 126 and a second inlet 128. First inlet 126 may be fluidically connected to a first gas source 130 by a valve 132. First gas source 130 may include a source of an acid or chloride, such as HCl. The acid or chloride may react with iron-containing material 134 to form an iron-containing vapor. For example, HCl may react with iron-containing material 134 to form iron chloride ($FeCl_3$), which may be heated to form a vapor.

Second inlet 128 may be fluidically coupled to a carrier gas source 134 by a valve 136. In some examples, carrier gas source 134 may include a source of substantially inert gas (e.g., a gas that is substantially non-reactive with other elements and compounds present in system 110 during operation of system 110). A substantially inert gas may include, for example, a noble gas, such as argon.

Valves 92, 96, 132, and 136 may be used to control the total flow rate of gases and vapors into CVD chamber 112, and the relative proportion of carrier gas, nitrogen-containing vapor, carbon-containing vapor, and iron-containing vapor in the gases and vapors flowing into CVD chamber 112. For example, valves 92, 96, 132, and 136 may be controlled to allow deposition of coating 78, which includes iron, carbon, and nitrogen, and as described with respect to FIG. 6.

In some examples, to form coating 78, valves 92, 96, 132, and 136 may be controlled to allow the carrier gas, the vapor including the nitrogen-containing compound, the vapor including the carbon-containing compound, and the vapor including the iron-containing compound to flow into CVD chamber 112 to produce an atomic ratio of iron to the combination nitrogen and carbon in the gases and vapors flowing into CVD chamber 112 to be between about 11.5:1 (iron:(nitrogen+carbon)) and about 5.65:1 (iron:(nitrogen+carbon)). For example, the atomic ratio of iron to the combination of nitrogen and carbon in the gases and vapors flowing into CVD chamber 62 may be about 9:1 (iron:(nitrogen+carbon)), about 8:1 (iron:(nitrogen+carbon)), or about 6.65:1 (iron:(nitrogen+carbon)).

Additionally, valves 92 and 96 may be controlled to control the relative flow rates of the vapor including the nitrogen-containing compound and the vapor including the carbon-containing compound to produce a predetermined atomic ratio of nitrogen to carbon in the gases flowing into CVD chamber 112. For example, valves 92 and 96 may be controlled to control the relative flow rates of the vapor including the nitrogen-containing compound and the vapor including the carbon-containing compound to produce an atomic ratio of nitrogen to carbon of between about 0.1:1 and 10:1, such as about 1:1, or about 4.667:5.333.

In some examples, to form coating 78, the flow rate of the carrier gas may be between about 5 sccm and about 5.000 sccm, the flow rate of the vapor including the nitrogen-containing compound may be between about 10 sccm and about 1.000 sccm, the flow rate of the vapor including the carbon-containing compound may be between about 0.1 sccm and about 1,000 sccm and the flow rate of the vapor including the iron-containing compound may be between about 100 sccm and about 5,000 sccm. Flow rates such as these may result in a growth rate of coating 728 of between about 100 micrometers per hour (μm/h) and about 1,000 μm/h.

In some examples, the HCl may react with Fe in chamber 112 according to the following reaction:

$$Fe+HCl \rightarrow FeCl_3+H_2$$

The $FeCl_3$ and $H_2$ may flow into CVD chamber 112 through first inlet 116, where the vapors may mix with the nitrogen-containing vapor, such as $NH_3$. In some examples, the nitrogen-containing vapor and the iron containing vapor may react according to the following reaction to deposit coating 118 including an approximately 8:1 ratio of iron to nitrogen plus carbon:

$$16FeCl_3+2NH_3+2CH_4+17H_2 \rightarrow 2Fe_8NC+48HCl$$

As described above with respect to FIG. 6, once coating 78 has been formed to a predetermined thickness, coating 78 may be annealed to transform at least some of the iron, carbon, and nitride mixture in coating 78 to at least one of $\alpha''$-$Fe_{16}(N_xC_{1-x})_2$ or a mixture of $\alpha''$-$Fe_{16}N_2$ and $\alpha''$-$Fe_{16}C_2$. The annealing technique may be similar to or substantially the same as that described above with respect to FIG. 6.

By using CVD to form coating 78 on substrate 76, magnetic material including at least one of $\alpha''$-$Fe_{16}(N_xC_{1-x})_2$ or a mixture of $\alpha''$-$Fe_8N_2$ and $\alpha''$-$Fe_{16}C_2$ may be incorporated into other products formed using CVD and existing manufacturing techniques that utilize CVD. Using existing CVD manufacturing operations, including masking, magnetic material including at least one of $\alpha''$-$Fe_{16}(N_xC_{1-x})_2$ or a mixture of $\alpha''$-$Fe_{16}N_2$ and $\alpha''$-$Fe_{16}C_2$ may be deposited on predetermined portions or regions of substrate 76. For example, magnetic materials including at least one of $\alpha''$-$Fe_{16}(N_xC_{1-x})_2$ or a mixture of $\alpha''$-$Fe_{16}N_2$ and $\alpha''$-$Fe_{16}C_2$ may be incorporated into CMOS (complementary metal-oxide-semiconductor) integrated circuit devices, and the CVD technique for forming magnetic materials including at least one of $\alpha''$-$Fe_{16}(N_xC_{1-x})_2$ or a mixture of $\alpha''$-$Fe_{16}N_2$ and $\alpha''$-$Fe_{16}C_2$ may be incorporated into existing CMOS processing techniques. In other examples, magnetic materials including at least one of $\alpha''$-$Fe_{16}(N_xC_{1-x})_2$ or a mixture of $\alpha''$-$Fe_{16}N_2$ and $\alpha''$-$Fe_{16}C_2$ formed using CVD may be incorporated into other devices utilizing magnetic materials.

CVD may allow growth of coating 78 faster than some other techniques, such as molecular beam epitaxy (MBE), while, in some examples, forming superior coatings compared to some other techniques, such as sputtering.

In other examples, a coating (e.g., coating 78) may be formed on a substrate (e.g., substrate 76) using liquid phase epitaxy (LPE). In LPE, a solution including the coating materials may be cooled to form a supersaturated solution. The coating materials in the solution deposit a coating on a substrate immersed or submerged in the solution. In some examples, the degree of supersaturation may be low, such that the LPE technique is a near-equilibrium process. This may result in coatings with high crystalline quality (e.g., near-perfect crystalline structure). Additionally, because the concentration of the coating materials in the solution are much greater than the concentration of coating materials in vapor phase techniques, the growth rate of the coating may be greater than the growth rate for coatings grown using vapor phase techniques.

Figure 8:
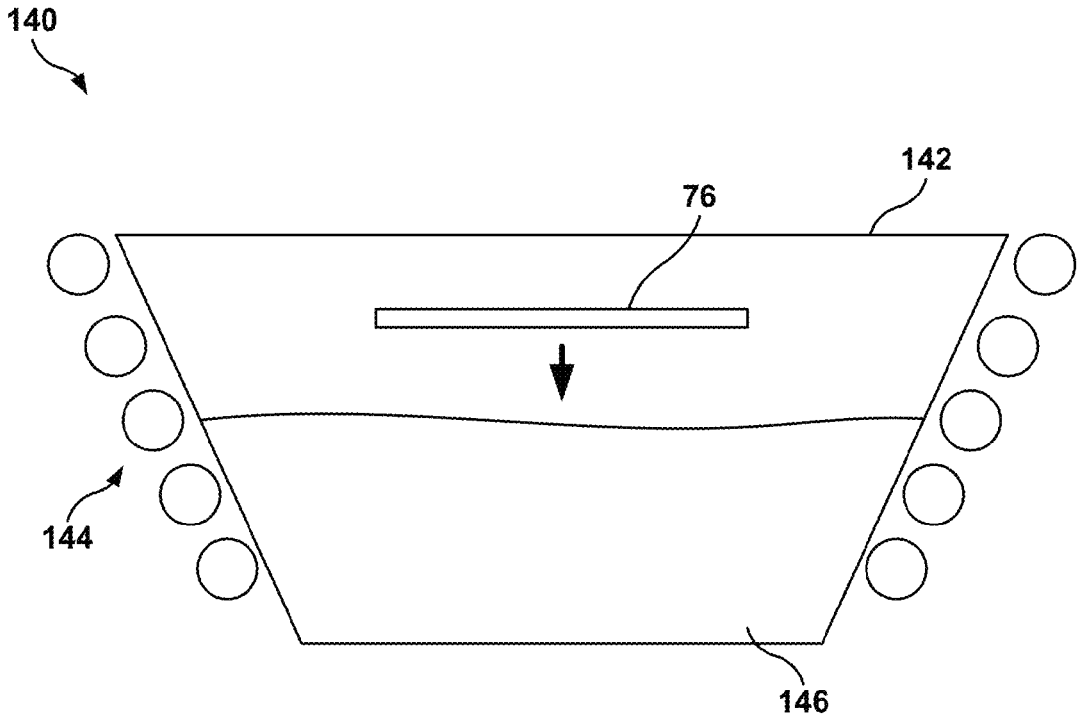
FIG. 8 is a conceptual and schematic diagram illustrating an example system for forming an inductor including a magnetic material including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O on a substrate using LPE.

FIG. 8 is a conceptual and schematic diagram illustrating an example system 140 for forming a coating including iron, nitrogen, and carbon on a substrate 76 using LPE. System 140 includes a crucible 142 in which a coating solution 146 is contained. System 140 also includes RF induction coils 144, which at least partially surrounded crucible 142. RF induction coils 144 may be electrically connected to an RF source (not shown in FIG. 8), which causes an alternating electrical current at RF to flow through RF induction coils 144. In some examples, the RF magnetic field generated by RF induction coils 144 may be absorbed by coating solution 146 or by crucible 142, such that coating solution 146 is heated.

Coating solution 146 may include a solution of iron in a solvent. Coating solution 146 may include a first solution when forming a layer including iron and nitrogen and a second, different solution when forming a layer including iron, carbon, and nitrogen.

In some examples, the solvent may include a nitrogen-containing compound, such as ammonium nitrate, urea, an amide, or hydrazine. In some examples, the solvent may be oversaturated with nitrogen at the deposition temperature and pressure. Example amides include carbamide ($(NH_2)_2CO$; also referred to as urea), methanamide (Formula 1 above), benzamide (Formula 2 above), acetamide (Formula 3 above), and acid amides, although any amide may be used. The amide may be selected to be a liquid at the temperatures experienced by coating solution 96 during the LPE technique.

Coating solution 146 also may include a carbon-containing compound. For example, coating solution 146 may include dissolved carbon monoxide, dissolved carbon dioxide, dissolved methane, or urea.

Coating solution 146 also includes an iron source. In some examples, the iron source may include an iron-containing compound. In some examples, the iron source includes a liquid iron donor, such as $FeCl_3$ or $Fe(CO)_5$. In other examples, the iron source may include an iron-containing powder. In some examples, the iron-containing powder may include substantially pure iron (e.g., iron with a purity of greater than 90 at. %). In some examples, the iron-containing powder may include iron oxide (e.g., $Fe_2O_3$ or $Fe_3O_4$).

During the LPE process for forming a coating including iron, carbon, and nitrogen, the coating solution 146 may be heated to a temperature above the liquidus temperature of the iron, carbon, and nitrogen mixture to be deposited on substrate 26. In some examples, the solvent may not include the iron source, the carbon source, or both when heated to the temperature above the liquidus temperature.

The iron source and carbon source then may be dissolved in the solvent to form a coating solution 146 that is saturated with the iron-containing material, the carbon source, or both. Substrate 76 then may be immersed in coating solution 146.

Coating solution 146 and substrate 76 then may be cooled to a temperature that is below the liquidus temperature of the iron-carbon-nitrogen coating to be formed. This causes coating solution 146 to be supersaturated with the iron-containing material, the carbon-containing material, or both, which drives the LPE coating technique. In some examples the temperature at which the LPE coating technique is performed may be between about 600° C. and about 1,000° C. This temperature may be in a two-phase region, which provides a driving force for precipitation of iron-carbon-nitrogen on the surface of substrate 76. In some examples, the concentration of iron, carbon, and nitrogen in coating solution 146 and the temperature at which the LPE coating technique is performed may be controlled to provide an atomic ratio of iron to nitrogen plus carbon between about 11.5:1 (iron:(nitrogen+carbon)) and about 5.65:1 (iron:(nitrogen+carbon)). For example, the atomic ratio between iron and nitrogen atoms may be about 9:1 (iron:(nitrogen+carbon)), about 8:1 (iron:(nitrogen+carbon)), or about 6.65:1 (iron:(nitrogen+carbon)). Although FIG. 8 has been described with respect to a mixture of iron, nitrogen and carbon, similar concepts may be applied to form coatings including iron, nitrogen, and at least one of boron or oxygen.

After the coating that includes iron, carbon, and nitrogen has been formed, the coating may be annealed under conditions similar to or substantially the same as those described with respect to FIG. 6. The annealing may facilitate formation of $\alpha''$-$Fe_{16}(N_xZ_{1-x})_2$ phase (where Z includes at least one of C, B, or O) or a mixture of $\alpha''$-$Fe_{16}N_2$ phase and $\alpha''$-$Fe_{16}Z_2$ phase in the coating to form the magnetic material in the inductor.

In some examples, the inductors described herein may be incorporated into electronic circuits. Example electronic circuits include an impedance matching circuit, a filter (such as a low pass filter), and AC-DC converter circuit, and the like. In some examples, the magnetic material that includes $\alpha''$-$Fe_{16}(N_xZ_{1-x})_2$ phase (where Z includes at least one of C, B, or O) or a mixture of $\alpha''$-$Fe_{16}N_2$ phase and $\alpha''$-$Fe_{16}Z_2$ phase may also be incorporated into an antenna. Further, multiple circuits and an antenna may be incorporated into an RF energy harvester.

Many fields using RF energy harvesting devices utilize sensors located in remote, dangerous, or sensitive areas that require maintenance-free power at low voltages. Some sensors which require these RF energy harvesting devices are located within a structure in which battery replacement would create structural failure or in a manufacturing process in which many sensors are utilized and individual battery servicing is impractical. Some sensors that use these RF energy harvesting devices also link to a rechargeable battery in the case that electromagnetic energy generation ceases, but sensor function is important. For example, in the biomedical industry, implants may use this energy source since it can prolong the life and maintenance of the implant while diminishing the possibility of contamination and instability associated with implanted batteries. Radio frequency identification devices (RFIDs) already may use RF energy as a type of barcode information system.

Some RF energy harvesting devices may use a basic TV antenna linked to power conversion circuitry. A television antenna linked to a suitable conversion circuit if located approximately 4 meters from a 677 MHz, 960 kW RF source may produce a detected voltage of 0.7 V across an 8 kilo-ohm load, which is approximately 60 microwatts of harvested power. This may be sufficient to power an LCD display thermometer.

Many circuits require a voltage of more than 0.3 volts to sufficiently convert all incoming electromagnetic waves, which means that the required incoming power from the RF source should be higher than 1 milliwatt.

In accordance with examples of this disclosure, RF energy harvesting devices may incorporate inductors, antennas, or both made of magnetic material that includes $\alpha''$-$Fe_{16}(N_xZ_{1-x})_2$ phase (where Z includes at least one of C, B, or O) or a mixture of $\alpha''$-$Fe_{16}N_2$ phase and $\alpha''$-$Fe_{16}Z_2$ phase. Use of antennas, inductor, or both formed of this material may allow formation of efficient RF energy harvesting devices with a size of less than about 1 $cm^2$, which may be less than some other RF energy harvesting devices. As described above, magnetic material that includes $\alpha''$-$Fe_{16}(N_xZ_{1-x})_2$ phase or a mixture of $\alpha''$-$Fe_{16}N_2$ phase and $\alpha''$-$Fe_{16}Z_2$ phase may have low magnetocrystalline anisotropy, low coercivity (e.g., less than about 10 Oe or less than about 5 Oe or less than about 1 Oe) that is not based on large domain sizes, a relatively high saturation magnetization value, a relatively high permeability, or a relatively high intrinsic resistivity. This may result in an inductor that includes $\alpha''$-$Fe_{16}(N_xZ_{1-x})_2$ phase or a mixture of $\alpha''$-$Fe_{16}N_2$ phase and $\alpha''$-$Fe_{16}Z_2$ phase having at least one of relatively large inductance per unit area, relatively high operating frequency, or a relatively high saturation magnetization and relatively high frequencies.

Figure 9:
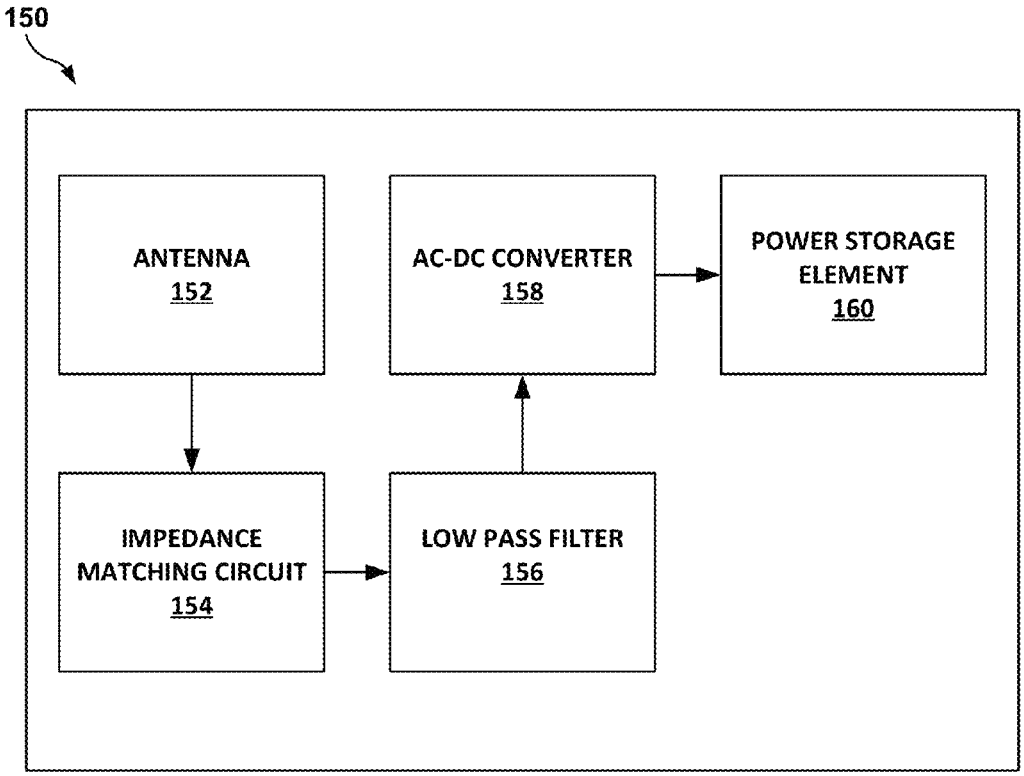
FIG. 9 is a conceptual block diagram illustrating an example RF energy harvesting device.

FIG. 9 is a conceptual block diagram illustrating an example RF energy harvesting device 150. RF energy harvesting device 150 may include an antenna 152, an impedance matching circuit 154, a low pass filter 156, an AC-DC converter 158, and a power storage element 160. RF energy harvesting device 150 may be configured to generate energy from RF electromagnetic signals received by antenna 152. For example, RF energy harvesting device 150 may receive RF electromagnetic signals used by cell phones, TV, radio, GPS, or the like, and may harness energy from these signals. In some examples, RF harvesting device 150 may be utilized in wireless sensor networks, human implanted systems, mobile systems, or the like, to provide power to devices, which may reduce or eliminate replacement of batteries, connection to a wired power source, or both.

Antenna 152 may include any antenna configured to receive any frequency band. For example, antenna 152 may be configured to receive an RF signal having a frequency of at least one of about 13.56 MHz, about 700 MHz, about 750 MHz, about 800 MHz, about 850 MHz, about 915 MHz, about 1.7 GHz, about 1.8 GHz, about 1.9 GHz, about 2.1 GHz, about 2.4 GHz, or the like. In some examples, antenna 152 is configured with a resonant frequency at or near a defined frequency band, such as the 700 MHz band, the 800 MHz band, the 850 MHz band, the 1400 MHz band, the PCS band (1850-1910 MHz and 1930-1990 MHz), the AWS band (1710-1755 MHz and 2110-2155 MHz), the BRS/EBS band (2496-2690 MHz), or other bands defined in other regions of the world.

In some examples, antenna 152 may include a multiband antenna or a wideband antenna, such that antenna 152 is configured to receive signals from multiple bands. In some examples, antenna 152 may be a multipole antenna or a reconfigurable antenna, such that antenna 152 is configurable to receive signals from multiple bands. For example, antenna 152 may be a three pole antenna configurable to receive signals at about 13.56 MHz, about 915 MHz, and about 1.8 GHz.

In some examples, antenna 152 may be formed from a magnetic material that includes $\alpha''$-$Fe_{16}(N_xZ_{1-x})_2$ or a mixture of $\alpha''$-$Fe_{16}N_2$ and $\alpha''$-$Fe_{16}Z_2$, including any of the materials described herein with reference to inductors. In some examples, antenna 152 may define a spiral shape, and a geometry of the antenna may be selected based on a wavelength that antenna 152 is to receive. For example, in an antenna 152 that is spiral-shaped, a length of the outermost segment of the spiral may be equal to about a quarter wavelength and the total length of the spiral may be equal to about a half wavelength. Antenna 152 may be at least partially encapsulated in a dielectric with low dielectric loss, such as $SiO_2$ or $Si_3N_4$. In some examples, antenna 152 may be a multi-pole antenna, with no directional pattern, and a gain greater than about 10 dBi.

RF energy harvesting device 150 also includes an impedance matching circuit 154. Impedance matching circuit 154 adjust an impedance of antenna 152 to more closely match an output impedance of the transmission line, which may reduce power losses and reduce or substantially eliminate reflections of the signal from antenna 152, which otherwise may affect the voltage output of RF energy harvesting device 150. In some examples, RF energy harvesting device 150 may include an inductor and a capacitor. In some examples, the inductor may include a magnetic material that includes $\alpha''$-$Fe_{16}(N_xZ_{1-x})_2$ or a mixture of $\alpha''$-$Fe_{16}N_2$ and $\alpha''$-$Fe_{16}Z_2$, including any of the materials described herein with reference to inductors. Additionally, the inductor may include any of the geometries described herein for inductors, and may be formed using any of the techniques described herein for forming inductors. In some examples, impedance matching circuit 154 may be a n-type matching circuit. In some examples, the inductor in impedance matching circuit 154 may have an inductance of about 0.5 nano-Henries (nH), about 1 nH, about 2 nH, or the like.

In some examples, RF energy harvesting device 150 additionally may include low pass filter 156. Low pass filter 156 may filter high frequency signal content from the signal output by impedance matching circuit 154 to AC-DC power converter 158. Low pass filter 156 may include any design, and, in some examples, includes an inductor. In some examples in which low pass filter 156 includes an inductor, the inductor may include a magnetic material that includes $\alpha''$-$Fe_{16}(N_xZ_{1-x})_2$ or a mixture of $\alpha''$-$Fe_{16}N_2$ and $\alpha''$-$Fe_{16}Z_2$, including any of the materials described herein with reference to inductors. Additionally, the inductor may include any of the geometries described herein for inductors, and may be formed using any of the techniques described herein for forming inductors. In some examples, the inductor in low pass filter 156 may have an inductance of about 1 nH, about 2 nH, about 3 nH, or the like.

Figure 10:
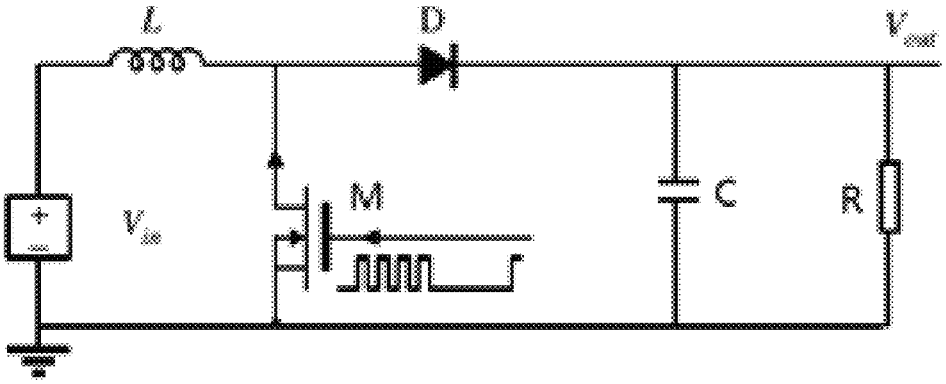
FIG. 10 is a circuit diagram of an example AC-DC boost converter.

In some examples, RF energy harvesting device 150 may include AC-DC converter 158. AC-DC converter 158 may include any circuit design and circuit components suitable for converting an AC (or RF) signal to DC. In some examples, AC-DC converter 158 is a boost converter, which also increases the voltage of the signal. FIG. 10 is a circuit diagram of an example AC-DC boost converter 162. As shown in FIG. 10, among other circuit components, AC-DC boost converter 162 includes an inductor. The inductor may include a magnetic material that includes $\alpha''$-$Fe_{16}(N_xZ_{1-x})_2$ or a mixture of $\alpha''$-$Fe_{16}N_2$ and $\alpha''$-$Fe_{16}Z_2$, including any of the materials described herein with reference to inductors. Additionally, the inductor may include any of the geometries described herein for inductors, and may be formed using any of the techniques described herein for forming inductors. In some examples, the inductor in AC-DC converter 158 may have an inductance of about 5 nH, about 10 nH, about 20 nH, or the like.

In some examples, RF energy harvesting device 150 also may include a power storage element 160. Power storage element 160 may include, for example, a capacitor, a super-capacitor, a battery, or the like. Power storage element 160 may be charged by RF energy harvesting device 150 and be used to output power at times when RF signals provide insufficient power for the device at least partially powered by RF energy harvesting device 150.

By utilizing inductors including a magnetic material that includes $\alpha''$-$Fe_{16}(N_xZ_{1-x})_2$ or a mixture of $\alpha''$-$Fe_{16}N_2$ and $\alpha''$-$Fe_{16}Z_2$ and an antenna 152 that includes a magnetic material including $\alpha''$-$Fe_{16}(N_xZ_{1-x})_2$ or a mixture of $\alpha''$-$Fe_{16}N_2$ and $\alpha''$-$Fe_{16}Z_2$, it is expected that greater energy recovery may be achieved with a similar RF signal while RF energy harvesting device 150 may occupy less area (e.g., less than about 1 $cm^2$). For example, each of antenna 152 and the three inductors (in the impedance matching circuit 154, low pass filter 156, and AC-DC converter 158 is expected to increase efficiency compared to conventional inductors by about 3-4 times. In combination, this may lead to an increase in RF energy harvesting efficiency by up to 80 times. It is believed that RF energy harvesting device 150 may be capable of generating 1.5 V and greater than 100 mW.

Table 1 sets forth some example parameters expected of an RF energy harvesting device constructed in accordance with examples of this application.

TABLE 1

| | |
|---|---|
| Antenna | Reconfigurable antenna, 13.56 MHz, 915 MHz, 1.8 GHz |
| Quiescent current | <0.1 μA |
| Matching impedance | 50 ohms |
| Storage capacitance | Double ESR, C = 0.1 F |
| Output voltage | 1.5 V |
| Max load current | 30 mA |
| Stored energy | 40 mJ |
| Peak efficiency | 70% |
| Gain | >10 dBi |
| Directional Pattern | none (i.e. unlimited directional capability) |

In some examples, the magnetic material used in antenna 152 or the inductors used in RF energy harvesting device 150 may include at least about 35 volume percent $\alpha''$-$Fe_{16}(N_xZ_{1-x})_2$ phase domain(s). In other examples, the magnetic material may include at least about 40 volume percent, at least about 50 volume percent, or at least about 60 volume percent $\alpha''$-$Fe_{16}(N_xZ_{1-x})_2$ phase domain(s). Similarly a magnetic material including a mixture of $\alpha''$-$Fe_{16}N_2$ and $\alpha''$-$Fe_{16}Z_2$ may include at least about 35 volume percent of the combination of $\alpha''$-$Fe_{16}N_2$ and $\alpha''$-$Fe_{16}Z_2$ phase domains. In other examples, the magnetic material may include at least about 40 volume percent, at least about 50 volume percent, or at least about 60 volume percent of the combination of $\alpha''$-$Fe_{16}N_2$ and $\alpha''$-$Fe_{16}Z_2$ phase domains.

Although the foregoing examples described inductors formed as parts of devices, e.g., using CVD, PVD, or LPE, in other examples, inductors may be formed using other techniques. For example, the magnetic material that includes $\alpha''$-$Fe_{16}(N_xZ_{1-x})_2$ or a mixture of $\alpha''$-$Fe_{16}N_2$ and $\alpha''$-$Fe_{16}Z_2$ may be formed into a wire and used as part of an air core inductor, a ferromagnetic core inductor, or the like. In some examples, the magnetic material that includes $\alpha''$-$Fe_{16}(N_xZ_{1-x})_2$ or a mixture of $\alpha''$-$Fe_{16}N_2$ and $\alpha''$-$Fe_{16}Z_2$ may be included in the inductor core.

In some examples, the disclosure also describes a transformer core that includes a magnetic material including $\alpha''$-$Fe_{16}(N_xZ_{1-x})_2$ or a mixture of $\alpha''$-$Fe_{16}N_2$ and $\alpha''$-$Fe_{16}Z_2$. Soft magnetic materials that have small grain sizes and low coercivity have been aggressively pursued by researchers in industry and academia. Large grain sizes (e.g., 20 μm to 50 μm) have low coercivity but work effectively at low frequencies (e.g., less than about 100 kHz). Grain sizes smaller than 20 μm, such as $Co_{0.57}Ni_{0.13}Fe_{0.30}$ and FeAlN, may have a coercivity greater than five Oe, which may result in unacceptable core losses.

As described above, a magnetic material including $\alpha''$-$Fe_{16}(N_xZ_{1-x})_2$ or a mixture of $\alpha''$-$Fe_{16}N_2$ and $\alpha''$-$Fe_{16}Z_2$ may have nearly zero magnetocrystalline anisotropy, relatively high saturation magnetization, relatively high resistivity, and relatively high permeability. These properties may make magnetic materials including $\alpha''$-$Fe_{16}(N_xZ_{1-x})_2$ or a mixture of $\alpha''$-$Fe_{16}N_2$ and $\alpha''$-$Fe_{16}Z_2$ promising for use in transformer cores.

Magnetic materials including $\alpha''$-$Fe_{16}(N_xZ_{1-x})_2$ or a mixture of $\alpha''$-$Fe_{16}N_2$ and $\alpha''$-$Fe_{16}Z_2$ may be utilized to form transformer cores that are drop-in replacements for existing transformer cores. It is expected that transformer losses may be reduced by up to about 28% by using magnetic materials including $\alpha''$-$Fe_{16}(N_xZ_{1-x})_2$ or a mixture of $\alpha''$-$Fe_{16}N_2$ and $\alpha''$-$Fe_{16}Z_2$. Transformer losses may be separated into three categories-hysteresis losses, eddy current losses, and no-load losses. It is expected that using magnetic materials including $\alpha''$-$Fe_{16}(N_xZ_{1-x})_2$ or a mixture of $\alpha''$-$Fe_{16}N_2$ and $\alpha''$-$Fe_{16}Z_2$ in transformer cores may reduce hysteresis losses by about 50% compared to conventional magnetic materials due to the low magnetocrystalline anisotropy of the magnetic materials including $\alpha''$-$Fe_{16}(N_xZ_{1-x})_2$ or a mixture of $\alpha''$-$Fe_{16}N_2$ and $\alpha''$-$Fe_{16}Z_2$. It is expected that using magnetic materials including $\alpha''$-$Fe_{16}(N_xZ_{1-x})_2$ or a mixture of $\alpha''$-$Fe_{16}N_2$ and $\alpha''$-$Fe_{16}Z_2$ in transformer cores may reduce eddy current losses by about 70% compared to conventional magnetic materials due to the relatively high resistivity and nanocrystalline structure of the magnetic materials including $\alpha''$-$Fe_{16}(N_xZ_{1-x})_2$ or a mixture of $\alpha''$-$Fe_{16}N_2$ and $\alpha''$-$Fe_{16}Z_2$. It is expected that using magnetic materials including $\alpha''$-$Fe_{16}(N_xZ_{1-x})_2$ or a mixture of $\alpha''$-$Fe_{16}N_2$ and $\alpha''$-$Fe_{16}Z_2$ in transformer cores may reduce no-load losses (which may include relaxation and resonant losses) by about 70% compared to conventional magnetic materials due to the static (e.g., DC) magnetic properties of magnetic materials including $\alpha''$-$Fe_{16}(N_xZ_{1-x})_2$ or a mixture of $\alpha''$-$Fe_{16}N_2$ and $\alpha''$-$Fe_{16}Z_2$.

The magnetic materials that include $\alpha''$-$Fe_{16}(N_xZ_{1-x})_2$ or a mixture of $\alpha''$-$Fe_{16}N_2$ and $\alpha''$-$Fe_{16}Z_2$ for use in a transformer core may be formed using any suitable technique, including CVD or LPE, as described above. In other examples, the magnetic materials that include $\alpha''$-$Fe_{16}(N_xZ_{1-x})_2$ or a mixture of $\alpha''$-$Fe_{16}N_2$ and $\alpha''$-$Fe_{16}Z_2$ may be formed using a ball milling technique: a melt spinning technique; a cold crucible technique: an ion implantation technique; or the like.

In some examples, the magnetic materials that include $\alpha''$-$Fe_{16}(N_xZ_{1-x})_2$ or a mixture of $\alpha''$-$Fe_{16}N_2$ and $\alpha''$-$Fe_{16}Z_2$ for use in a transformer core may be formed by first forming a plurality of workpieces including magnetic materials that include $\alpha''$-$Fe_8(N_xZ_{1-x})_2$ or a mixture of $\alpha''$-$Fe_{16}N_2$ and $\alpha''$-$Fe_{16}Z_2$, then consolidating the plurality of workpieces to form a bulk magnetic material including $\alpha''$-$Fe_{16}(N_xZ_{1-x})_2$ or a mixture of $\alpha''$-$Fe_{16}N_2$ and $\alpha''$-$Fe_{16}Z_2$.

Figure 11:
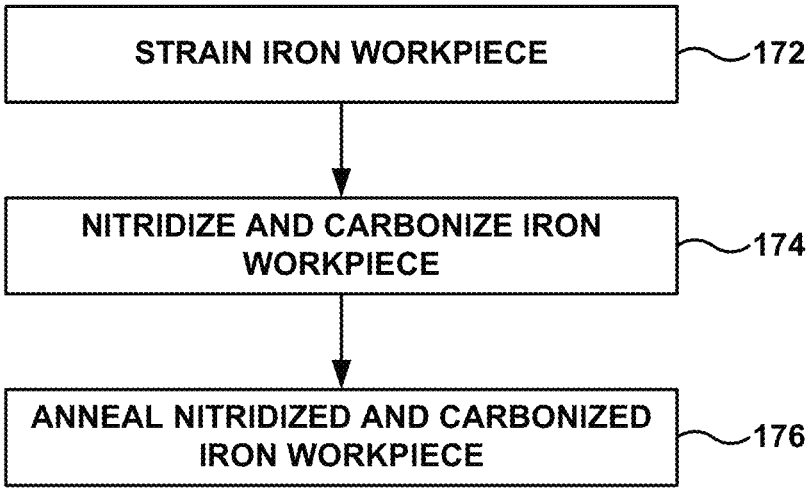
FIG. 11 is a flow diagram that illustrates an example technique for forming a bulk magnetic material including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O.
Figure 12:
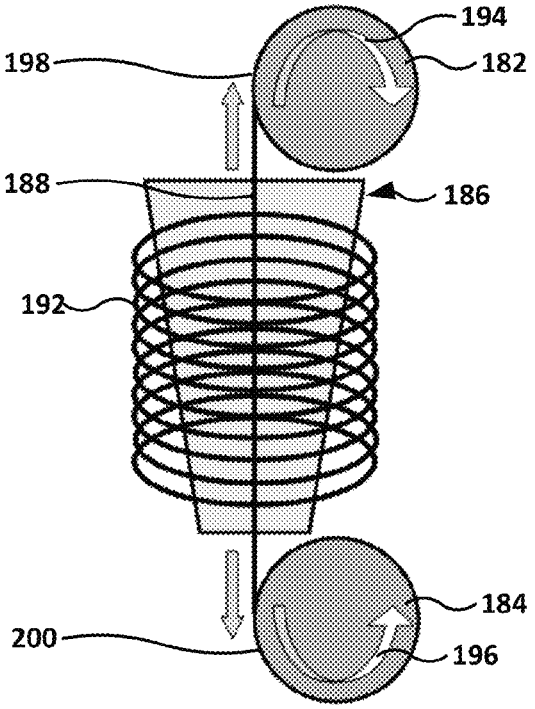
FIG. 12 illustrates a conceptual diagram of an apparatus with which an iron workpiece can be strained and exposed to nitrogen and carbon.
Figure 13:
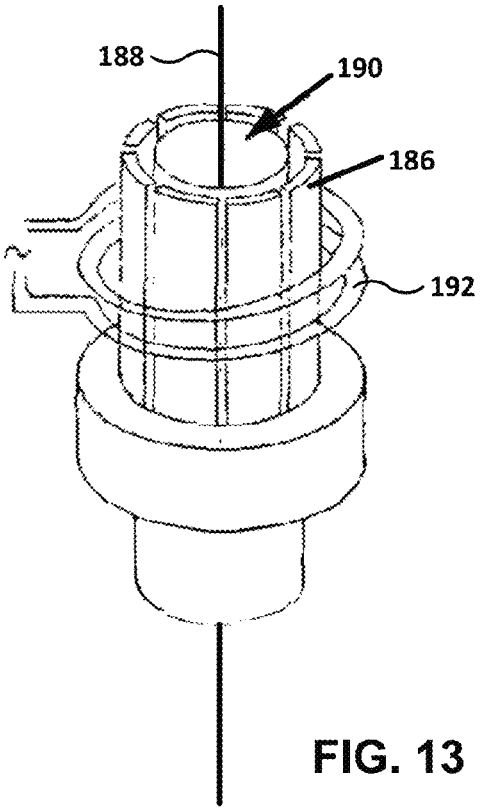
FIG. 13 illustrates further detail of one example of the crucible heating stage shown in FIG. 12.

FIG. 11 is a flow diagram that illustrates an example technique for forming a workpiece including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O. The technique of FIG. 11 will be described with concurrent reference to FIGS. 12 and 13. FIG. 12 illustrates a conceptual diagram of an apparatus with which an iron workpiece can be strained and exposed to nitrogen and carbon. FIG. 13 illustrates further detail of one example of the crucible heating stage shown in FIG. 12.

The example apparatus of FIG. 12 includes a first roller 182, a second roller 184, and a crucible heating stage 186. First roller 182 and second roller 184 are configured to receive a first end 198 and a second end 200, respectively, of an iron workpiece 188, such as a fiber, a wire, a filament, a cable, a film, a thick film, a foil, a ribbon, or a sheet. Iron workpiece 188 defines a major axis between first end 198 and second end 200. As best seen in FIG. 13, iron workpiece 188 passes through an aperture 190 defined by crucible heating stage 186. Crucible heating stage 186 includes an inductor 192 that surrounds at least a portion of the aperture 190 defined by crucible heating stage 186.

The example technique of FIG. 11 includes straining iron workpiece 188 along a direction substantially parallel (e.g., parallel or nearly parallel) to a <001> axis of at least one iron crystal in the iron workpiece 188 (172). In some examples, iron workpiece 188 is formed of iron having a body centered cubic (bcc) crystal structure.

In some examples, iron workpiece 188 is formed of a single bcc crystal structure. In other examples, iron workpiece 188 may be formed of a plurality of bcc iron crystals. In some of these examples, the plurality of iron crystals are oriented such that at least some, e.g., a majority or substantially all, of the <001> axes of individual unit cells and/or crystals are substantially parallel to the direction in which strain is applied to iron workpiece 188. For example, when the iron is formed as iron workpiece 188, at least some of the <001> axes may be substantially parallel to the major axis of the iron workpiece 188, as shown in FIGS. 12 and 13. In some examples, single crystal iron nitride workpieces may be formed using crucible techniques. In addition to such crucible techniques, single crystal iron workpieces may be formed by either the micro melt zone floating or pulling from a micro shaper to form iron workpiece 188.

The stain may be exerted on iron workpiece 188 using a variety of strain inducing apparatuses. For example, as shown in FIG. 12, first end 198 and second end 200 of iron workpiece 188 may be received by (e.g., wound around) first roller 182 and second roller 184, respectively, and rollers 182, 184 may be rotated in opposite directions (indicated by arrows 194 and 195 in FIG. 12) to exert a tensile force on the iron workpiece 188.

Rollers 182, 184 may strain iron workpiece 188 to a certain elongation. For example, the strain on iron workpiece 188 may be between about 0.3% and about 7%. In other examples, the strain on iron workpiece 188 may be less than about 0.3% or greater than about 7%. In some examples, exerting a certain strain on iron workpiece 188 may result in a substantially similar strain on individual unit cells of the iron, such that the unit cell is elongated along the <001> axis between about 0.3% and about 7%.

As rollers 182, 184 exert the strain on iron workpiece 188 and/or once rollers 182, 184 are exerting a substantially constant strain on the iron workpiece 188, iron workpiece 188 may be nitridized and carbonized (174). In some examples, during the nitridization and carbonization process, iron workpiece 188 may be heated using a heating apparatus. One example of a heating apparatus that can be used to heat iron workpiece 188 is crucible heating stage 186, shown in FIGS. 12 and 13.

Crucible heating stage 186 defines aperture 190 through which iron workpiece 138 passes (e.g., in which a portion of iron workpiece 188 is disposed). In some examples, no portion of crucible heating stage 186 contacts iron workpiece 188 during the heating of iron workpiece 188. In some implementations, this is advantageous as it lowers a risk of unwanted elements or chemical species contacting and diffusing into iron workpiece 188. Unwanted elements or chemical species may affect properties of iron workpiece 188; thus, it may be desirable to reduce or limit contact between iron workpiece 188 and other materials.

Crucible heating stage 186 also includes an inductor 192 that surrounds at least a portion of aperture 190 defined by crucible heating stage 186. An AC electric current may be passed through inductor 192, which may induce eddy currents in iron workpiece 188 and heat the iron workpiece 188. In other examples, instead of using crucible heating stage 186 to heat iron workpiece 188, other non-contact heating sources may be used.

Regardless of the heating apparatus used to heat iron workpiece 188 during the nitridizing and carbonizing process, the heating apparatus may heat iron workpiece 188 to temperature for a time sufficient to allow diffusion of nitrogen and carbon to a predetermined concentration substantially throughout the thickness or diameter of iron workpiece 188. In this manner, the heating time and temperature are related, and may also be affected by the composition and/or geometry of iron workpiece 188. For example, iron workpiece 188 may be heated to a temperature between about 650° C. and about 900° C. for between about 2 hours and about 10 hours, after which the iron workpiece 188 may be quenched to room temperature by a quenching medium, such as water, ice water, oil, or brine.

In addition to heating iron workpiece 188, nitridizing and carbonizing iron workpiece 188 (174) includes exposing iron workpiece 188 to atomic nitrogen and atomic carbon, which diffuse into iron workpiece 188. In some examples, the atomic nitrogen and atomic carbon may be supplied from urea ($CO(NH_2)_2$). The nitrogen and carbon may be supplied in a gas phase alone (e.g., substantially pure urea gas) or as a mixture with a carrier gas. In some examples, the carrier gas is argon (Ar).

Regardless of the technique used to nitridize and carbonize iron workpiece 188 (174), the nitrogen and carbon may be diffused into iron workpiece 188 to a collective concentration of nitrogen and carbon between about 8 atomic percent (at. %) and about 14 at. %, such as about 11 at. %. The concentration of nitrogen and carbon in iron may be an average concentration, and may vary throughout the volume of iron workpiece 188. In some examples, the atomic ratio of iron to the combination of nitrogen plus carbon is between about 11.5:1 (iron:nitrogen+carbon) and about 5.65:1 (iron:nitrogen+carbon). For example, the atomic ratio of iron to the combination of nitrogen and carbon may be about 9:1 (iron:nitrogen+carbon), about 8:1 (iron:nitrogen+carbon), or about 6.65:1 (iron:nitrogen+carbon).

In some examples, once iron workpiece 188 has been nitridized (174), iron workpiece 188 may be annealed at a temperature for a time to facilitate diffusion of the nitrogen and carbon atoms into appropriate interstitial spaces within the iron lattice to form $\alpha''$-$Fe_{16}(N_xC_{1-x})_2$ or a mixture of $\alpha''$-$Fe_{16}N_2$ and $\alpha''$-$Fe_{16}C_2$ (176). In some examples, the nitridized and carbonized iron workpiece 188 may be annealed at a temperature between about 100° C. and about 210° C. The nitridized and carbonized iron workpiece 188 may be annealed using crucible heating stage 186, a plasma arc lamp, a radiation heat source, such as an infrared heat lamp, an oven, or a closed retort.

The annealing process may continue for a predetermined time that is sufficient to allow diffusion of the nitrogen and carbon atoms to the appropriate interstitial spaces. In some examples, the annealing process continues for between about 5 hours and about 100 hours, such as between about 40 hours and about 80 hours. In some examples, the annealing process may occur under an inert atmosphere, such as Ar, to reduce or substantially prevent oxidation of the iron. The resulting material may include $\alpha''$-$Fe_{16}(N_xC_{1-x})_2$ or a mixture of $\alpha''$-$Fe_{16}N_2$ and $\alpha''$-$Fe_{16}C_2$. A similar technique may be used to form a material including $Fe_{16}(N_xZ_{1-x})_2$ or a mixture of $\alpha''$-$Fe_{16}N_2$ and $\alpha''$-$Fe_{16}Z_2$, where Z is at least one of B or O.

Figure 14:
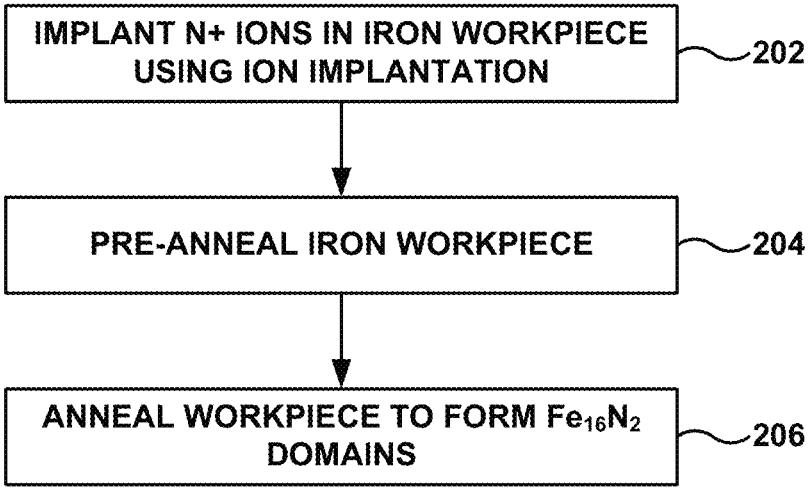
FIG. 14 is a flow diagram that illustrates an example technique for forming a magnetic material including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O.

FIG. 14 is a flow diagram illustrating an example technique for forming a workpiece including $Fe_{16}(N_xZ_{1-x})_2$ or a mixture of $\alpha''$-$Fe_{16}N_2$ and $\alpha''$-$Fe_{16}Z_2$, where Z is at least one of C, B, or O using ion implantation. The technique of FIG. 14 will be described with Z being carbon atoms. A similar technique may be used to form a material including $Fe_{16}(N_xZ_{1-x})_2$ or a mixture of $\alpha''$-$Fe_{16}N_2$ and $\alpha''$-$Fe_{16}Z_2$, where Z is at least one of B or O.

The technique shown in FIG. 14 includes implanting N+ and C+ ions in an iron workpiece using ion implantation (202). The iron workpiece may include a plurality of iron crystals. In some examples, the plurality of iron crystals may have crystal axes oriented in substantially the same direction. For example, a major surface of the iron workpiece may be parallel to the (110) surfaces of all or substantially all of the iron crystals. In other examples, a major surface of the iron workpiece may be parallel to another surface of all or substantially all of the iron crystals. By using a workpiece in which all or substantially all of the iron crystals have substantially aligned crystal axes, anisotropy formed when forming the $Fe_{16}(N_xC_{1-x})_2$ or a mixture of $\alpha''$-$Fe_{16}N_2$ and $\alpha''$-$Fe_{16}C_2$ phases may be substantially aligned.

In some examples, workpieces include a dimension that is longer, e.g., much longer, than other dimensions of the workpiece. Example workpieces with a dimension longer than other dimensions include fibers, wires, filaments, cables, films, thick films, foils, ribbons, sheets, or the like. In other examples, workpieces may not have a dimension that is longer than other dimensions of the workpiece. For example, workpieces can include grains or powders, such as spheres, cylinders, flecks, flakes, regular polyhedra, irregular polyhedra, and any combination thereof. Examples of suitable regular polyhedra include tetrahedrons, hexahedrons, octahedron, decahedron, dodecahedron and the like, non-limiting examples of which include cubes, prisms, pyramids, and the like.

In some examples of the technique of FIG. 14, the workpiece includes a foil. The workpiece may define a thickness on the order of hundreds of nanometers to millimeters. In some examples, the iron workpiece may define a thickness between about 500 nanometers (nm) and about 1 millimeter (mm). The thickness of the iron workpiece may affect the parameters used for ion implantation and annealing of the workpiece, as will be described below. The thickness of the workpiece may be measured in a direction substantially normal to a surface of the substrate to which the workpiece is attached.

Prior to implantation of N+ and C+ ions in the iron workpiece, the iron workpiece may be positioned on a surface of a silicon substrate or a gallium arsenide (GaAs) substrate. In some examples, the iron workpiece may be position on the (111) surface of a (single crystal) silicon substrate, although any crystalline orientation may be used. In some examples, the iron workpiece may be attached to the surface of the substrate at this time.

The average depth to which the N+ and C+ ions are implanted in the iron workpiece may depend upon the energy to which the N+ ions are accelerated. For each implant energy, N+ and C+ ions are implanted within the iron workpiece in a range depths surrounding the average implant depth. The implant energy used to implant the N+ and C+ ions may be selected based at least in part on the thickness of the iron workpiece. The implant energy also may be selected to implant the N+ and C+ ions without doing overly significant damage to the iron workpiece, including the crystal lattice of the iron crystals in the iron workpiece. For example, while higher implant energies may allow implantation of the N+ and C+ ions at a greater average depth, higher implant energies may increase the damage to the iron workpiece, including damaging the crystal lattice of the iron crystals and ablating some of the iron atoms due to the impact of the N+ ions. Hence, in some examples, the implant energy may be limited to be below about 180 keV. In some examples, the incident angle of implantation may be about zero degrees (e.g., substantially perpendicular to the surface of the iron workpiece). In other examples, the incident angle of implantation may be adjusted to reduce lattice damage. For example, the incident angle of implantation may be between about 1° and about 15° from perpendicular.

As an example, when the iron workpiece defines a thickness of about 500 nm, an implant energy of about 100 keV may be used to implant the N+ and C+ ions in the iron workpiece. An implant energy of about 100 keV may also be used to implant the N+ and C+ ions in iron workpieces of other thicknesses. In other examples, a different implant energy may be used for iron workpieces defining a thickness of about 500 nm, and the same or different implant energy may be used for workpieces defining a thickness different than 500 nm.

Additionally, the fluency of N+ and C+ ions may be selected to implant a desired dose of N+ and C+ ions within the iron workpiece. In some examples, the fluency of N+ and C+ ions may be selected to implant approximately stoichiometric number of N+ ions within the iron workpiece. The stoichiometric ratio of iron to nitrogen in $\alpha''$-$Fe_{16}N_2$, iron to carbon in $\alpha''$-$Fe_{16}C_2$, and iron to nitrogen plus carbon in $\alpha''$-$Fe_{16}(N_xC_{1-x})_2$ is 8:1. Thus, the approximate number of iron atoms in the iron workpiece may be determined, and a number of N+ and C+ ions equal to approximately ⅛ (12.5%) of the iron atoms may be implanted in the iron workpiece, such as between about 8 at. % and about 15 at. %. For example, an iron workpiece having measurements of about 1 cm by 1 cm by 500 nm may include about $4.23\times10^{18}$ iron atoms. Thus, to achieve a stoichiometric ratio of iron atoms to N+ and C+ ions in the iron workpiece, about $5.28\times10^{17}$ N+ and C+ ions may be implanted in the sample. The ratio of N+ ions to C+ ions also may be controlled to be about 1:1, or about 4.667:5.333.

The temperature of the iron workpiece during the ion implantation also may be controlled. In some examples, the temperature of the iron workpiece may be between about room temperature and about 500° C.

Once the N+ and C+ ions have been implanted in the iron workpiece (202), the iron workpiece may be subjected to a first annealing step (204), which may be referred to as a pre-annealing step. The pre-annealing step may accomplish multiple functions, including, for example, securely attaching the iron workpiece to the substrate. As described below, secure attachment of the iron workpiece to the substrate allows the post-annealing step to generate stress in the iron workpiece, facilitating the transformation of the crystalline structure of at least some of the crystals in the iron workpiece from body centered cubic (bcc) iron to body centered tetragonal (bet) iron nitride. In some examples, the pre-annealing step also may activate the implanted N+ and C+ ions, repair damage to the iron crystals' lattices due to the ion implantation procedure, and/or remove any oxygen in the workpiece. In some examples, the pre-annealing step may be performed at a temperature between about 450° C. and about 550° C. for between about 30 minutes and about 4 hours. As an example, the pre-annealing step may be performed at a temperature of about 500° C. for between about 30 minutes and about 1 hour.

In some examples, in addition to heating the iron workpiece and the substrate, the pre-annealing step may include applying an external force between about 0.2 gigapascals (GPa) and about 10 GPa between the iron workpiece and the substrate. The external force may assist bonding of the iron workpiece and the substrate.

The atmosphere in which the pre-annealing step is performed may include, for example, nitrogen, argon, and/or hydrogen, such as a mixture of about 4 vol. % hydrogen, about 10 vol. % nitrogen, and about 86 vol. % argon. The composition of the atmosphere may assist with removing oxygen from the workpiece and cleaning surfaces of the workpiece.

Following the pre-annealing step (204), the iron workpiece including implanted N+ and C+ ions and the substrate may be exposed to a second annealing step (206), which may be referred to as a post-annealing step. The post-annealing step may be carried out at a temperature that produces strain in the iron workpiece due to differences in the coefficients of thermal expansion for the substrate and the iron workpiece and that accesses the $\alpha''$-$Fe_{16}(N_xC_{1-x})_2$ or a mixture of $\alpha''$-$Fe_{16}N_2$ and $\alpha''$-$Fe_{16}C_2$ phases. Additionally, the post-annealing step allows diffusion of N+ and C+ ions iron crystals to form $\alpha''$-$Fe_{16}(N_xC_{1-x})_2$ or a mixture of $\alpha''$-$Fe_{16}N_2$ and $\alpha''$-$Fe_{16}C_2$ phases. The post-annealing step may be carried out at a temperature and for a time described herein with respect to other annealing steps for forming $\alpha''$-$Fe_{16}(N_xC_{1-x})_2$ or a mixture of $\alpha''$-$Fe_{16}N_2$ and $\alpha''$-$Fe_{16}C_2$ phases.

Figure 15:
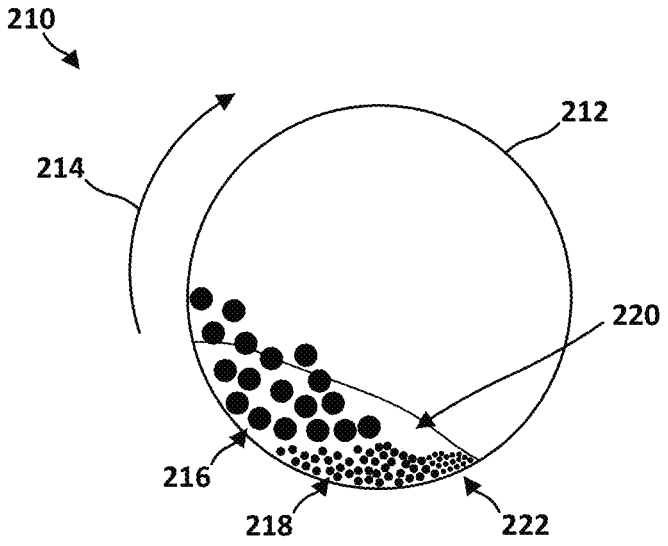
FIG. 15 is a conceptual diagram illustrating a milling apparatus that may be used to mill an iron-containing raw material with a nitrogen source and/or a carbon source.

FIG. 15 is a conceptual diagram illustrating a first milling apparatus that may be used to mill an iron-containing raw material with a nitrogen source and a carbon source to form a material including iron, carbon, and nitrogen, which may be annealed to form a workpiece including $\alpha''$-$Fe_{16}(N_xC_{1-x})_2$ or a mixture of $\alpha''$-$Fe_{16}N_2$ and $\alpha''$-$Fe_{16}C_2$ phases. The technique of FIG. 15 will be described with Z being carbon atoms. A similar technique may be used to form a material including $Fe_{16}(N_xZ_{1-x})_2$ or a mixture of $\alpha''$-$Fe_{16}N_2$ and $\alpha''$-$Fe_{16}Z_2$, where Z is at least one of B or O.

Milling apparatus 210 may be operated in rolling mode, in which the bin 212 of milling apparatus 210 rotates about a horizontal axis, as indicated by arrow 214. As bin 212 rotates, milling spheres 216 move within bin 212 and, over time, crush iron-containing raw material 218. In addition to iron-containing raw material 218 and milling spheres 216, bin 212 encloses a mixture 220 including nitrogen source and a carbon source.

In the example illustrated in FIG. 15, milling spheres 216 may include a sufficiently hard material that, when contacting iron-containing raw material 218 with sufficient force, will wear iron-containing raw material 218 and cause particles of iron-containing raw material 218 to, on average, have a smaller size. In some examples, milling spheres 216 may be formed of steel, stainless steel, or the like. In some examples, the material from which milling spheres 216 are formed may not chemically react with iron-containing raw material 218 and/or mixture 220. In some examples, milling spheres 216 may have an average diameter between about 5 millimeters (mm) and about 20 mm.

Iron-containing raw material 218 may include any material containing iron, including atomic iron, iron oxide, iron chloride, or the like. In some examples, iron-containing raw material 218 may include substantially pure iron (e.g., iron with less than about 10 atomic percent (at. %) dopants or impurities). In some examples, the dopants or impurities may include oxygen or iron oxide. Iron-containing raw material 218 may be provided in any suitable form, including, for example, a powder or relatively small particles. In some examples, an average size of particles in iron containing raw material 218 may be less than about 100 micrometers (μm).

Mixture 220 may include a nitrogen source and a carbon source. The nitrogen source and carbon source may include any sources of nitrogen and carbon described herein, including hydrazine, an amide, urea, ammonia, ammonium nitrate, or the like for a nitrogen source; and urea, carbon monoxide, carbon dioxide, methane, or the like for a carbon source.

In some examples, bin 212 also may enclose a catalyst 222. Catalyst 222 may include, for example, cobalt (Co) particles and/or nickel (Ni) particles. Catalyst 222 catalyzes the nitriding of the iron-containing raw material 218. One possible conceptualized reaction pathway for nitriding iron using a Co catalyst is shown in Reactions 1-3, below. A similar reaction pathway may be followed when using Ni as the catalyst 212.

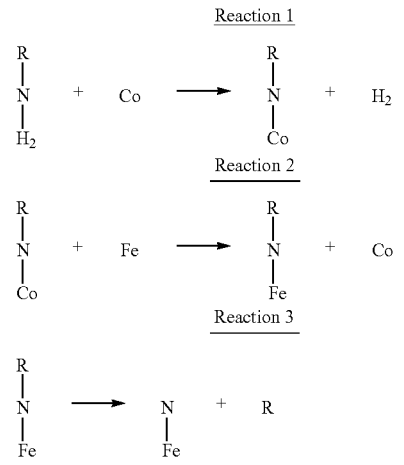

Hence, by mixing sufficient amide and catalyst 212, iron-containing raw material 218 may be converted to iron nitride containing material.

Bin 212 of milling apparatus 210 may be rotated at a rate sufficient to cause mixing of the components in bin 212 (e.g., milling spheres 216, iron-containing raw material 218, mixture 220, and catalyst 22 (if present)) and cause milling spheres 216 to mill iron-containing raw material 218. In other examples, the milling process may be performed using a different type of milling apparatus, such as a stirring mode milling apparatus or a vibration mode milling apparatus.

Regardless of the type of milling used to form powder including iron, carbon, and nitrogen, the resulting powder may include iron, carbon, and nitrogen. Milling an iron-containing raw material in the presence of a nitrogen source and a carbon source may be a cost-effective technique for forming an iron-carbon-nitrogen containing powder. Further, milling an iron-containing raw material in the presence of a nitrogen source and a carbon source may facilitate mass production of iron-carbon-nitrogen containing powder, and may reduce iron oxidation. The resulting iron-carbon-nitrogen containing powder then may be annealed while straining to form $\alpha''$-$Fe_{16}(N_xC_{1-x})_2$ or a mixture of $\alpha''$-$Fe_{16}N_2$ and $\alpha''$-$Fe_{16}C_2$.

In some examples, instead of using milling apparatus 210 to form a powder including iron, nitrogen, and carbon, milling apparatus 210 may instead be used to form a first powder including iron and nitrogen by milling an iron-containing raw material 218 in the presence of a nitrogen source. This powder then may be annealed to form at least one $\alpha''$-$Fe_{16}N_2$ phase domain. Milling apparatus 210 also may be used to form a second powder including iron and carbon by milling an iron-containing raw material 218 in the presence of a carbon source. This powder then may be annealed to form at least one $\alpha''$-$Fe_{16}C_2$ phase domain. The powder including at least one $\alpha''$-$Fe_{16}N_2$ phase domain and the powder including at least one $\alpha''$-$Fe_{16}C_2$ phase domain then may be consolidated to form a magnetic material including $\alpha''$-$Fe_{16}(N_xC_{1-x})_2$ or a mixture of $\alpha''$-$Fe_{16}N_2$ and $\alpha''$-$Fe_{16}C_2$.

In some examples, an iron-carbon-nitrogen containing material may be melted and continuously casted, pressed, and quenched to form workpieces containing $\alpha''$-$Fe_{16}(N_xC_{1-x})_2$ or a mixture of $\alpha''$-$Fe_{16}N_2$ and t$\alpha''$-$Fe_{16}C_2$. In some examples, the workpieces may have a dimension in one or more axis between about 0.001 mm and about 50 mm. For example, in some examples in which the workpieces include ribbons, the ribbons may have a thickness between about 0.001 mm and about 5 mm. As another example, in some examples in which the workpieces include wires, the wires may have a diameter between about 0.1 mm and about 50 mm. The workpieces then may be strained and post-annealed to form $\alpha''$-$Fe_{16}(N_xC_{1-x})_2$ or a mixture of $\alpha''$-$Fe_{16}N_2$ and $\alpha''$-$Fe_{16}C_2$. In some examples, these workpieces $\alpha''$-$Fe_{16}(N_xC_{1-x})_2$ or a mixture of $\alpha''$-$Fe_{16}N_2$ and $\alpha''$-$Fe_{16}C_2$ then may be joined with other workpieces including $\alpha''$-$Fe_{16}(N_xC_{1-x})_2$ or a mixture of $\alpha''$-$Fe_{16}N_2$ and $\alpha''$-$Fe_{16}C_2$ a larger material.

Figure 16:
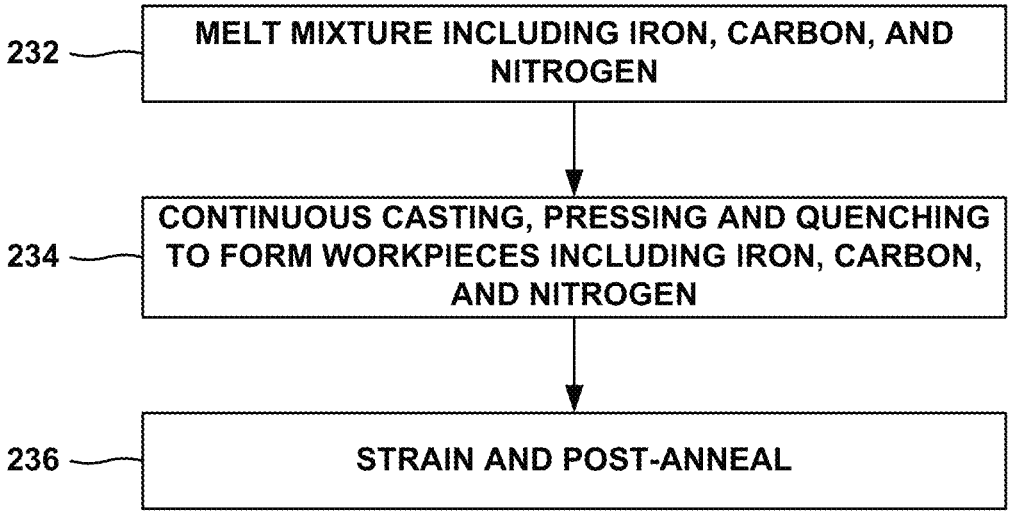
FIG. 16 is a flow diagram of an example technique for forming a workpiece including $\alpha''$-$Fe_{16}(N_xC_{1-x})_2$ or a mixture of $\alpha''$-$Fe_{16}N_2$ and $\alpha''$-$Fe_{16}C_2$.

FIG. 16 is a flow diagram of an example technique for forming a workpiece including $\alpha''$-$Fe_{16}(N_xC_{1-x})_2$ or a mixture of $\alpha''$-$Fe_{16}N_2$ and $\alpha''$-$Fe_{16}C_2$. The technique of FIG. 16 will be described with Z being carbon atoms. A similar technique may be used to form a material including $Fe_{16}(N_xZ_{1-x})_2$ or a mixture of $\alpha''$-$Fe_{16}N_2$ and $\alpha''$-$Fe_{16}Z_2$, where Z is at least one of B or O.

The technique illustrated in FIG. 16 includes melting a mixture including iron, carbon nitrogen to form a molten iron nitride-containing mixture (232). The mixture including iron, carbon, and nitrogen may include, for example, an atomic ratio of iron to nitrogen plus carbon of between about 11.5:1 (iron:nitrogen+carbon) and about 5.65:1 (iron:nitrogen+carbon). For example, the atomic ratio of iron to the combination of nitrogen and carbon may be about 9:1 (iron:nitrogen+carbon), about 8:1 (iron:nitrogen+carbon), or about 6.65:1 (iron:nitrogen+carbon). For example, the mixture may include between about 8 atomic percent (at. %) and about 15 at. % of the combination of nitrogen and carbon, with a balance iron, other elements, and dopants. As another example, the mixture may include between about 10 at. % and about 13 at. % of the combination of nitrogen and carbon, or about 11.1 at. % of the combination of nitrogen and carbon.

In some examples, the mixture including iron and nitrogen may have a purity (e.g., collective iron and nitrogen content) of at least 92 atomic percent (at. %).

In some examples, melting the mixture including iron, carbon, and nitrogen to form a molten mixture (232) may include heating the mixture including iron, carbon, and nitrogen at a temperature above about 1500° C. In some examples, the mixture including iron, carbon, and nitrogen may be heated in a furnace using a radio frequency (RF) induction coil. In other examples, the mixture including iron, carbon, and nitrogen may be heated in a furnace using a low or mid-frequency induction coil. In some examples, the furnace may be heated at a temperature greater than about 1600° C., or at a temperature greater than about 2000° C. In some examples, the mixture including iron and nitrogen may be heated under an ambient atmosphere.

Once the mixture including iron, carbon, and nitrogen is molten, the mixture may be subjected to a casting, quenching, and pressing process to form workpieces including iron, carbon, and nitrogen (234). In some examples, the casting, quenching, and pressing process may be continuous, as opposed to a batch process. The molten mixture including iron, carbon, and nitrogen may be deposited in a mold, which may shape the mixture including iron, carbon, and nitrogen into a predetermined shape, such as at least one wire, ribbon, or other article having length that is greater than its width or diameter. During the casting process, the temperature of the mold may be maintained at a temperature between about 650° C. and about 1200° C., depending on the casting speed. In some examples, during the casting process, the temperature of the mold may be maintained at a temperature between about 800° C. and about 1200° C. The casting process can be conducted in air, a nitrogen environment, an inert environment, a partial vacuum, a full vacuum, or any combination thereof. The casting process can be at any pressure, for example, between about 0.1 GPa and about 20 GPa. In some examples, the casting process can be assisted by a straining field, a temperature field, a pressure field, a magnetic field, an electrical field, or any combination thereof.

After casting is complete or while the casting process is being completed, the mixture including iron, carbon, and nitrogen may be quenched to set the crystalline structure and phase composition of the material. In some examples, during the quenching process, the workpiece may be heated to a temperature above 650° C. for between about 0.5 hour and about 20 hours. In some examples, the temperature of the workpiece may be dropped abruptly below the martensite temperature of the workpiece alloy (Ms). For example, for $Fe_{16}N_2$, the martensite temperature (Ms) is about 250° C. The medium used for quenching can include a liquid, such as water, brine (with a salt concentration between about 1% and about 30%), a non-aqueous liquid or solution such as an oil, or liquid nitrogen. In other examples, the quenching medium can include a gas, such as nitrogen gas with a flow rate between about 1 sccm and about 1000 sccm. In other examples, the quenching medium can include a solid, such as salt, sand, or the like. In some examples, the workpieces including iron, carbon, and nitrogen may be cooled at a rate of greater than 50° C. per second during the quenching process. In some examples, the casting process can be assisted by a magnetic field and/or an electrical field.

After quenching is complete, the material including iron, carbon, and nitrogen may be pressed to achieve the predetermined size of the material. During the pressing process, the temperature of the material may be maintained below about 250° C., and the material may be exposed to a pressure between about 5 tons and 50 tons, depending on the desired final dimension (e.g., thickness or diameter) of the material. When the pressing process is complete, the material including iron, carbon, and nitrogen may be in the shape of a workpiece with a dimension in one or more axis between about 0.001 mm and about 50 mm (e.g., a diameter between about 0.1 mm and about 50 mm for a wire or a thickness between about 0.001 mm and about 5 mm for a ribbon).

The technique illustrated in FIG. 16 further includes straining and post-annealing the workpiece including iron, carbon, and nitrogen (236). The straining and post-annealing process may convert at least some of the iron, carbon, and nitrogen mixture to $\alpha''$-$Fe_{16}(N_xC_{1-x})_2$ phase domains or a mixture of $\alpha''$-$Fe_{16}N_2$ and $\alpha''$-$Fe_{16}Z_2$ phase domains. A strain inducing apparatus may strain the workpiece to a certain elongation. For example, the strain on the workpiece may be between about 0.3% and about 12%. In other examples, the strain on the workpiece may be less than about 0.3% or greater than about 12%. In some examples, exerting a certain strain on the workpiece may result in a substantially similar strain on individual unit cells of the iron, such that the unit cell is elongated along the <001> axis between about 0.3% and about 12%.

While the workpiece including iron, carbon, and nitrogen is strained, the workpiece may be heated to anneal the workpiece. The workpiece including iron, carbon, and nitrogen may be annealed by heating the workpiece to a temperature in any of the ranges listed herein for a time in any of the time ranges listed herein. Annealing the workpiece including iron, carbon, and nitrogen while straining the workpiece may facilitate conversion of at least some of the iron, carbon, and nitrogen to $\alpha''$-$Fe_{16}(N_xC_{1-x})_2$ or a mixture of $\alpha''$-$Fe_{16}N_2$ and $\alpha''$-$Fe_{16}C_2$.

In other examples, a workpiece including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O, and where x is greater than zero and less than one may be formed using sputtering. In sputtering, atoms from a sputtering target are ejected from the sputtering target due to bombardment of the sputtering target with energetic particles. The ejected atoms then deposit over a substrate in a coating.

The substrate over which the coating including iron, carbon, and nitrogen is formed may include any material over which the coating may be formed. For example, the substrate may include a semiconductor, such as silicon, GaAs, InGaAs, or the like. In other examples, the substrate may include another material, such as a glass, SiC, MgO, $SiO_2$ (e.g., a layer of $SiO_2$ on a Si or other semiconductor substrate), a metal, or the like. In some examples, the substrate may include a single crystal structure that can generate biaxial strain on the deposited film, such as silicon, GaAs, MgO, NaCl, Ge, SiC, or the like.

In some examples, the sputtering target may include iron and carbon. For example, sputtering target may include a carbon concentration of between about 1 at. % and about 10 at. %, with a balance of iron. The sputtering target may be the source of iron and nitrogen in the coating.

During the sputtering process, a nitrogen plasma may be generated. The nitrogen plasma may be the source of nitrogen in the coating.

Once the coating has been formed to a predetermined thickness, the coating may be annealed to transform at least some of the iron, carbon, and nitride mixture in the coating to at least one of $\alpha''$-$Fe_{16}(N_xC_{1-x})_2$ or a mixture of $\alpha''$-$Fe_{16}N_2$ and $\alpha''$-$Fe_{16}C_2$. The annealing technique may be similar to or substantially the same as that described above with respect to FIG. 3. The mismatch of coefficients of thermal expansion between the coating and the substrate may strain the coating, which may facilitate formation of at least one of $\alpha''$-$Fe_{16}(N_xC_{1-x})_2$ or a mixture of $\alpha''$-$Fe_{16}N_2$ and $\alpha''$-$Fe_{16}C_2$.

In other examples, a workpiece including $\alpha''$-$Fe_{16}(N_xZ_{1-x})_2$ or a mixture of $\alpha''$-$Fe_{16}N_2$ and $\alpha''$-$Fe_{16}Z_2$, where Z includes at least one of C, B, or O, and where x is greater than zero and less than one may be formed using melt spinning. In melt spinning, a molten iron-nitrogen-Z (where Z is at least one C, B, or O) mixture including a selected amount of nitrogen and Z (e.g., any of the amounts described herein) may be flowed over a cold roller surface to quench the molten iron nitride mixture and form a brittle ribbon of material. In some examples, the cold roller surface may be cooled at a temperature below room temperature by a cooling agent, such as water. For example, the cold roller surface may be cooled at a temperature between about 10° C. and about 25° C. The brittle ribbon of material may then undergo a heat treatment step to pre-anneal the brittle iron material. In some examples, the heat treatment may be carried out at a temperature between about 200° C. and about 600° C. at atmospheric pressure for between about 0.1 hour and about 10 hours. In some examples, the heat treatment may be performed in a nitrogen or argon atmosphere. After heat-treating the brittle ribbon of material under an inert gas, the brittle ribbon of material may be shattered to form an iron-nitrogen-Z-containing powder. After melting spinning the molten iron-nitrogen-Z mixture, the melt spinning technique may include annealing the iron-nitrogen-Z-containing powder using any of the annealing conditions described herein to form magnetic materials that include $\alpha''$-$Fe_{16}(N_xZ_{1-x})_2$ or a mixture of $\alpha''$-$Fe_{16}N_2$ and $\alpha''$-$Fe_{16}Z_2$.

The properties of the workpiece or magnetic material that includes $\alpha''$-$Fe_{16}(N_xZ_{1-x})_2$ or a mixture of $\alpha''$-$Fe_{16}N_2$ and $\alpha''$-$Fe_{16}Z_2$ may depend at least in part on the technique used to form the magnetic material. Table 2 illustrates example experimentally derived and calculated properties for example magnetic material formed using melt spinning and ball milling techniques.

TABLE 2

| | Melt Spinning | Ball Milling | Data source |
|---|---|---|---|
| Density | 6.9-7.0 g/cm³ | 5-5.1 g/cm³ | Experiment |
| Modulus | 160-200 GPa | 140-160 Gpa | Experiment |
| Curie temperature | >500° C. | >500° C. | Theoretical calculation |
| Working temperature | >225° C. | >180° C. | Experiment |
| Resistivity | 200-300 μΩ-cm | 0.1-0.5 Ω-cm | Experiment |
| Saturation magnetization | 245 emu/g | 220 emu/g | Experiment |
| Coercivity | 1-5 Oe | 5-8 Oe | Experiment |
| Maximum permeability | 8000-10000 | 2000-3000 | Derived based on experiment |

TABLE 2-continued

| | Melt Spinning | Ball Milling | Data source |
|---|---|---|---|
| Cut-off frequency | 30 GHz | 3 GHz | Theory |
| Core loss | 3.1 W @ 100 W (3.1%) | 7 W @ 100 W (7%) | Calculated by assuming 100 W output and 200 kHz frequency |

The density of the materials in table 2 was determined experimentally using the Archimedes method. The modulus was measured experimentally using pulling and bending tests on individual samples in-situ in a Transmission Electron Microscope (TEM). The Curie temperature was determined experimentally using Differential Scanning Calorimetry (DSC). The working temperature was determined experimentally using the actual aging method. The resistivity was determined using the four-probe method. The saturation magnetization and coercivity were determined using the Vibration Sample Magnetometry (VSM) method. The maximum permeability was determined using experimental data and the equation $$\mu = \frac{Js^2}{2\mu_0 K_u},$$

where $J_s$ is the saturation magnetic polarization, $\mu_0$ is the permeability constant, and $K_u$ is the uniaxial anisotropy constant. The cut-off frequency was determined using experimental data and the equation, where $$f_g = \frac{4}{\pi}\frac{\rho_{el}}{\mu_0\mu_{dc}d^2},$$

where $f_g$ is the cut-off frequency, $\rho_{el}$ is the resistivity, d is the diameter of the material, and $\mu_{dc}$ is the permeability at DC. Assuming d=20 micrometers and $\rho_{el}$=120 μΩ-cm, cut-off frequencies for different values of $\mu_{dc}$ are shown in Table 3.

TABLE 3

| $\mu_{dc}$ | $f_g$ (kHz) |
|---|---|
| 100,000 | 30 |
| 10,000 | 300 |
| 1,000 | 3,000 |

The core loss was defined as classical loss plus excess loss. Classical loss was calculated by the equation $$\frac{\pi^2}{6}\frac{d^2}{\rho_{el}}(Bf)^2$$

and excess loss was calculated using the equation $\sqrt{K_u}(Bf)^{3/2}$.

In some examples, the magnetic material or workpieces used in the transformer core may include at least about 35 volume percent α"-$Fe_{16}(N_xZ_{1-x})_2$ phase domain(s). In other examples, the magnetic material or workpieces may include at least about 40 volume percent, at least about 50 volume percent, or at least about 60 volume percent α"-$Fe_{16}(N_xZ_{1-x})_2$ phase domain(s). Similarly a magnetic material or workpiece including a mixture of α"-$Fe_{16}N_2$ and α"-$Fe_{16}Z_2$ may include at least about 35 volume percent of the combination of α"-$Fe_{16}N_2$ and α"-$Fe_{16}Z_2$ phase domains. In other examples, the magnetic material or workpiece may include at least about 40 volume percent, at least about 50 volume percent, or at least about 60 volume percent of the combination of α"-$Fe_{16}N_2$ and α"-$Fe_{16}Z_2$ phase domains.

Once workpieces including α"-$Fe_{16}(N_xZ_{1-x})_2$ or a mixture of α"-$Fe_{16}N_2$ and α"-$Fe_{16}Z_2$ have been formed using any of the techniques described herein, the workpieces may be consolidated to form a transformer core. In some examples, a plurality of workpieces may be joined using a eutectic alloy. For example, tin (Sn) may be disposed on a surface of at least one workpiece including α"-$Fe_{16}(N_xZ_{1-x})_2$ or a mixture of α"-$Fe_{16}N_2$ and α"-$Fe_{16}Z_2$. Crystallite and atomic migration may cause the Sn to agglomerate. The workpieces then may be pressed together and heated to form an iron-tin (Fe—Sn) alloy. The Fe—Sn alloy may be annealed at a temperature between about 150° C. and about 400° C. to join the workpieces. In some examples, the annealing temperature may be sufficiently low that magnetic properties of the first workpieces may be substantially unchanged. In some examples, rather than Sn being used to join the at least to workpieces including at least one $Fe_{16}N_2$ phase domain, Cu, Zn, or Ag may be used. In some examples, the c-axes of the α"-$Fe_{16}(N_xZ_{1-x})_2$ domains or the mixture of α"-$Fe_{16}N_2$ and α"-$Fe_{16}Z_2$ domains may be substantially aligned. In other examples, the c-axes of the α"-$Fe_8(N_xZ_{1-x})_2$ domains or the mixture of α"-$Fe_{16}N_2$ and α"-$Fe_{16}Z_2$ domains may be substantially randomly oriented.

As another example, the plurality of workpieces may be disposed within a resin or other adhesive. Examples of the resin or other adhesive include natural or synthetic resins, including ion-exchange resins, such as those available under the trade designation Amberlite™, from The Dow Chemical Company, Midland, Mich.: epoxies, such as Bismaleimide-Triazine (BT)-Epoxy; a polyacrylonitrile; a polyester: a silicone; a prepolymer; a polyvinyl buryral; urea-formaldehyde, or the like. The resin or other adhesive may be cured to bond the plurality of workpieces to each other. In some examples, the resin or other adhesive may be electrically insulating, and may increase the electrical resistivity of the transformer core compared to resistivity of the α"-$Fe_{16}(N_xZ_{1-x})_2$ or the mixture of α"-$Fe_{16}N_2$ and α"-$Fe_{16}Z_2$.

In other examples, shock compression may be used to join a plurality of workpieces including α"-$Fe_{16}(N_xZ_{1-x})_2$ or a mixture of α"-$Fe_{16}N_2$ and α"-$Fe_{16}Z_2$. In some examples, shock compression may include placing workpieces between parallel plates. The workpieces may be cooled by flowing liquid nitrogen through conduit coupled to a back side of one or both of the parallel plates, e.g., to a temperature below 0° C. A gas gun may be used to impact one of the parallel plates with a burst of gas at a high velocity, such as about 850 m/s. In some examples, the gas gun may have a diameter between about 40 mm and about 80 mm.

In other example, electromagnetic consolidation may be used to join the plurality of workpieces. For example a current may be passed through an electrically conductive coil, which generates an electromagnetic field. The current may be generated in a pulse to generate an electromagnetic force, which may help to consolidate the plurality of workpieces, which are disposed within the bore of the coil. In some examples, the plurality of workpieces may be disposed within an electrically conductive tube or container within the bore of the coil. The coil may be pulsed with a high electrical current to produce a magnetic field in the bore of the coil that, in turn, induces electrical currents in the electrically conductive tube or container. The induced currents interact with the magnetic field generated by the coil to produce an inwardly acting magnetic force that collapses the electrically conductive tube or container. The collapsing electromagnetic container or tube transmits a force to the plurality of workpieces and joins the plurality of workpieces.

In other examples, cold compression may be used to join the plurality of workpieces. For example, the workpieces may be mixed with resin, such as 1 volume percent or 1 weight percent resin, and pressed at relatively low temperatures for a predetermined time to join the plurality of workpieces. The resin may be electrically insulating, and may increase the resistivity of the magnetic material compared to $\alpha''$-$Fe_{16}(N_xZ_{1-x})_2$ or a mixture of $\alpha''$-$Fe_{16}N_2$ and $\alpha''$-$Fe_{16}Z_2$. Increasing the resistivity may reduce formation of eddy currents in the transformer core, which may reduce core losses.

In any of the above examples, other techniques for assisting consolidation of a plurality of workpieces including at least one $Fe_{16}N_2$ phase domain may be used, such as pressure, electric pulse, spark, applied external magnetic fields, a radio frequency signal, laser heating, infrared heating, for the like. Each of these example techniques for joining a plurality of workpieces including at least one $Fe_{16}N_2$ phase domain may include relatively low temperatures such that the temperatures use may leave the $Fe_{16}N_2$ phase domains substantially unmodified (e.g., by converting $Fe_{16}N_2$ phase domains to other types of iron nitride).

Although the preceding description has primarily described devices including magnetic materials that include $\alpha''$-$Fe_{16}(N_xZ_{1-x})_2$ or a mixture of $\alpha''$-$Fe_{16}N_2$ and $\alpha''$-$Fe_{16}Z_2$, in some examples, the magnetic materials may additionally or alternatively include $\alpha'$-$Fe_8(N_xZ_{1-x})$ or a mixture of $\alpha'$-$Fe_8N$ and $\alpha'$-$Fe_8Z$.

Clause 1: A semiconductor device comprising: a semiconductor substrate; a dielectric or insulator layer on the semiconductor substrate; and an inductor on the dielectric or insulator layer, wherein the inductor comprises a magnetic material comprising at least one $\alpha''$-$Fe_{16}(N_xZ_{1-x})_2$ phase domain, wherein Z includes at least one of C, B, or O, and wherein x is a number greater than zero and less than one.

Clause 2: The semiconductor device of clause 1, wherein the inductor comprises a substantially planar spiral portion.

Clause 3: The semiconductor device of clause 1, wherein the inductor comprises a plurality of substantially planar spiral portion.

Clause 4: The semiconductor device of any one of clauses 1 to 3, wherein x is equal to about 0.5.

Clause 5: The semiconductor device of any one of clauses 1 to 4, wherein Z consists of C.

Clause 6: The semiconductor device of any one of clauses 1 to 5, wherein the magnetic material further comprises at least one of an $\alpha''$-$Fe_{16}N_2$ phase domain or an $\alpha''$-$Fe_{16}Z_2$ phase domain.

Clause 7: The semiconductor device of any one of clauses 1 to 6, wherein the magnetic material comprises a saturation magnetization of at least about 219 emu/gram.

Clause 8: The semiconductor device of any one of clauses 1 to 6, wherein the magnetic material comprises a saturation magnetization of greater than about 242 emu/gram.

Clause 9: The semiconductor device of any one of clauses 1 to 6, wherein the magnetic material comprises a saturation magnetization of greater than about 250 emu/gram.

Clause 10: The semiconductor device of any one of clauses 1 to 9, wherein the magnetic material comprises a magnetic coercivity of less than or equal to about 10 Oerstads.

Clause 11: The semiconductor device of any one of clauses 1 to 10, wherein at least about 35 volume percent of the magnetic material is the at least one $\alpha''$-$Fe_{16}(N_xZ_{1-x})_2$ phase domain.

Clause 12: The semiconductor device of any one of clauses 1 to 10, wherein at least about 40 volume percent of the magnetic material is the at least one $\alpha''$-$Fe_{16}(N_xZ_{1-x})_2$ phase domain.

Clause 13: The semiconductor device of any one of clauses 1 to 10, wherein at least about 50 volume percent of the magnetic material is the at least one $\alpha''$-$Fe_{16}(N_xZ_{1-x})_2$ phase domain.

Clause 14: The semiconductor device of any one of clauses 1 to 10, wherein at least about 60 volume percent of the magnetic material is the at least one $\alpha''$-$Fe_{16}(N_xZ_{1-x})_2$ phase domain.

Clause 15: The semiconductor device of any one of clauses 1 to 14, wherein the at least one $\alpha''$-$Fe_{16}(N_xZ_{1-x})_2$ phase domain comprises a plurality of $\alpha''$-$Fe_{16}(N_xZ_{1-x})_2$ crystals, and wherein respective [001] axes of the plurality of crystals are randomly distributed within the magnetic material.

Clause 16: A semiconductor device comprising: a semiconductor substrate: a dielectric or insulator layer on the semiconductor substrate; and an inductor on the dielectric or insulator layer, wherein the inductor comprises a magnetic material comprising at least one $\alpha''$-$Fe_{16}N_2$ phase domain and at least one $\alpha''$-$Fe_{16}Z_2$ phase domain, wherein Z includes at least one of C, B, or O.

Clause 17: The semiconductor device of clause 16, wherein the inductor comprises a substantially planar spiral portion.

Clause 18: The semiconductor device of clause 16, wherein the inductor comprises a plurality of substantially planar spiral portion.

Clause 19: The semiconductor device of any one of clauses 16 to 18, wherein the at least one $\alpha''$-$Fe_{16}N_2$ phase domain comprises a plurality of $\alpha''$-$Fe_{16}N_2$ crystals, wherein the at least one $\alpha''$-$Fe_{16}Z_2$ phase domain comprises a plurality of $\alpha''$-$Fe_{16}Z_2$ crystals and wherein respective [001] axes of the plurality of $\alpha''$-$Fe_{16}N_2$ crystals and respective [001] axes of the plurality of $\alpha''$-$Fe_{16}Z_2$ crystals are randomly distributed within the magnetic material.

Clause 20: The semiconductor device of any one of claims 16 to 19, wherein Z consists of C.

Clause 21: The semiconductor device of any one of clauses 16 to 20, wherein the magnetic material comprises a saturation magnetization of at least about 219 emu/gram.

Clause 22: The semiconductor device of any one of clauses 16 to 20, wherein the magnetic material comprises a saturation magnetization of greater than about 242 emu/gram.

Clause 23: The semiconductor device of any one of clauses 16 to 20, wherein the magnetic material comprises a saturation magnetization of greater than about 250 emu/gram.

Clause 24: The semiconductor device of any one of clauses 16 to 23, wherein the magnetic material comprises a magnetic coercivity of less than or equal to about 10 Oerstads.

Clause 25: The semiconductor device of any one of clauses 16 to 24, wherein the at least one $\alpha''$-$Fe_{16}N_2$ phase domain and the at least one $\alpha''$-$Fe_{16}Z_2$ phase domain together form at least about 35 volume percent of the magnetic material.

Clause 26: The semiconductor device of any one of clauses 16 to 24, wherein the at least one $\alpha''$-$Fe_{16}N_2$ phase domain and the at least one $\alpha''$-$Fe_{16}Z_2$ phase domain together form at least about 40 volume percent of the magnetic material.

Clause 28: The semiconductor device of any one of clauses 16 to 24, wherein the at least one $\alpha''$-$Fe_{16}N_2$ phase domain and the at least one $\alpha''$-$Fe_{16}Z_2$ phase domain together form at least about 50 volume percent of the magnetic material.

Clause 29: The semiconductor device of any one of clauses 16 to 24, wherein the at least one $\alpha''$-$Fe_{16}N_2$ phase domain and the at least one $\alpha''$-$Fe_{16}Z_2$ phase domain together form at least about 60 volume percent of the magnetic material.

Clause 30. A method comprising: forming a dielectric or insulator layer on a semiconductor substrate; and forming an inductor on the dielectric or insulator layer, wherein the inductor comprises a magnetic material comprising at least one $\alpha''$-$Fe_{16}(N_xZ_{1-x})_2$ phase domain, wherein Z includes at least one of C, B, or O, and x is greater than zero and less than one.

Clause 31: A method comprising: forming a dielectric or insulator layer on a semiconductor substrate; and forming an inductor on the dielectric or insulator layer, wherein the inductor comprises a magnetic material comprising at least one $\alpha''$-$Fe_{16}N_2$ phase domain and at least one $\alpha''$-$Fe_{16}Z_2$ phase domain, wherein Z includes at least one of C, B, or O.

Clause 32: The method of clause 30 or 31, wherein forming the inductor comprises: heating an iron source to form a vapor comprising an iron-containing compound; depositing iron from the vapor comprising the iron-containing compound, nitrogen from a vapor comprising a nitrogen-containing compound, and at least one of carbon, boron, or oxygen from a vapor comprising the compound containing the at least one of carbon, boron, or oxygen on the dielectric or insulator layer to form a layer comprising iron, nitrogen, and the at least one of carbon, boron, or oxygen; and annealing the layer comprising iron, nitrogen, and the at least one of carbon, boron, or oxygen to form the inductor.

Clause 33: The method of clause 30 or 31, wherein forming the inductor comprises: submerging a dielectric or insulator layer on a semiconductor substrate in a coating solution comprising a nitrogen-containing solvent, an iron source, and a carbon source, wherein the coating solution is saturated with the iron source at a first temperature above a liquidus temperature of an iron-carbon-nitrogen mixture to be deposited from the coating solution; cooling the coating solution to a second temperature to form a supersaturated coating solution, wherein the second temperature is below the liquidus temperature of the iron-carbon-nitrogen mixture; maintaining the substrate in the supersaturated coating solution to allow a coating comprising iron, carbon, and nitrogen to form on the substrate; and annealing the coating comprising iron, carbon, and nitrogen to form the inductor.

Clause 34: The method of clause 32 or 33, further comprising: defining a depression in the dielectric or insulator layer corresponding to a shape of at least part of the inductor; wherein forming the inductor on the dielectric or insulator layer comprises forming the inductor in the depression.

Clause 35: The method of clause 32 or 33, wherein forming an inductor on the dielectric or insulator layer comprises: forming a layer comprising the magnetic material on the dielectric or insulator layer; and etching the layer comprising the magnetic material to define a shape of at least part of the inductor.

Clause 36: An antenna comprising: a magnetic material comprising at least one of: at least one $\alpha''$-$Fe_{16}(N_xZ_{1-x})_2$ phase domain, wherein x is a number greater than zero and less than one: or at least one $\alpha''$-$Fe_{16}N_2$ phase domain and at least one $\alpha''$-$Fe_1Z_2$ phase domain, wherein Z includes at least one of C, B, or O.

Clause 37: The antenna of clause 36, wherein the antenna comprises a multiband antenna.

Clause 38: The antenna of clause 36, wherein the antenna comprises a multipole antenna.

Clause 39: The antenna of clause 36, wherein the antenna comprises a wideband antenna.

Clause 40: The antenna of clause 36, wherein the antenna comprises a reconfigurable antenna.

Clause 41: The antenna of any one of clauses 36 to 40, wherein the antenna is configured to receive a signal having a frequency of at least one of about 13.56 MHz, about 700 MHz, about 750 MHz, about 800 MHz, about 850 MHz, about 915 MHz, about 1.7 GHz, about 1.8 GHz, about 1.9 GHz, about 2.1 GHz, or about 2.4 GHz.

Clause 42: The antenna of any one of clauses 36 to 40, wherein the antenna is configurable to receive a signal having a frequency of at least one of about 13.56 MHz, about 915 MHz, or about 1.8 GHz.

Clause 43: The antenna of any one of clauses 36 to 42, wherein the magnetic material comprises the at least one $\alpha''$-$Fe_{16}(N_xZ_{1-x})_2$ phase domain, and wherein x is equal to about 0.5.

Clause 44: The antenna of any one of clauses 36 to 42, wherein the magnetic material comprises the at least one $\alpha''$-$Fe_{16}(N_xZ_{1-x})_2$ phase domain, and wherein x is equal to about 0.4667.

Clause 45: The antenna of any one of clauses 36 to 44, wherein Z consists of C.

Clause 46: The antenna of any one of clauses 36 to 45, wherein the magnetic material comprises the at least one $\alpha''$-$Fe_{16}(N_xZ_{1-x})_2$ phase domain, and wherein at least about 35 volume percent of the magnetic material is the at least one $\alpha''$-$Fe_{16}(N_xZ_{1-x})_2$ phase domain.

Clause 47: The antenna of any one of clauses 36 to 45, wherein at least about 60 volume percent of the magnetic material is the at least one $\alpha''$-$Fe_{16}(N_xZ\text{-}x)_2$ phase domain.

Clause 48: The antenna of any one of clauses 36 to 47, wherein the magnetic material comprises the at least one $\alpha''$-$Fe_{16}(N_xZ_{1-x})_2$ phase domain, wherein the at least one $\alpha''$-$Fe_{16}(N_xZ_{1-x})_2$ phase domain comprises a plurality of $\alpha''$-$Fe_{16}(N_xZ_{1-x})_2$ crystals, and wherein respective [001] axes of the plurality of crystals are randomly distributed within the magnetic material.

Clause 49: The antenna of any one of clauses 36 to 48, wherein the magnetic material comprises the at least one $\alpha''$-$Fe_{16}N_2$ phase domain and the at least one $\alpha''$-$Fe_{16}Z_2$ phase domain, wherein the at least one $\alpha''$-$Fe_{16}N_2$ phase domain comprises a plurality of $\alpha''$-$Fe_{16}N_2$ crystals, wherein the at least one $\alpha''$-$Fe_{16}Z_2$ phase domain comprises a plurality of $\alpha''$-$Fe_{16}Z_2$ crystals, and wherein respective [001] axes of the plurality of $\alpha''$-$Fe_{16}N_2$ crystals and respective [001] axes of the plurality of $\alpha''$-$Fe_{16}Z_2$ crystals are randomly distributed within the magnetic material.

Clause 50: The antenna of any one of clauses 36 to 49, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 35 volume percent of the magnetic material.

Clause 51: The antenna of any one of clauses 36 to 50, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 60 volume percent of the magnetic material.

Clause 52: An impedance matching circuit comprising: an inductor comprising a magnetic material comprising at least one of: at least one $\alpha''$-$Fe_{16}(N_xZ_{1-x})_2$ phase domain, wherein x is a number greater than zero and less than one; or at least one $\alpha''$-$Fe_{16}N_2$ phase domain and at least one $\alpha''$-$Fe_{16}Z_2$ phase domain, wherein Z includes at least one of C, B, or O.

Clause 53: The impedance matching circuit of clause 52, wherein the magnetic material comprises the at least one $\alpha''$-$Fe_{16}(N_xZ_{1-x})_2$ phase domain, and wherein x is equal to about 0.5.

Clause 54: The impedance matching circuit of clause 52 or 53, wherein the magnetic material comprises the at least one $\alpha''$-$Fe_{16}(N_xZ_{1-x})_2$ phase domain, and wherein x is equal to about 0.4667.

Clause 55: The impedance matching circuit of any one of clauses 52 to 54, wherein Z consists of C.

Clause 56: The impedance matching circuit of any one of clauses 52 to 55, wherein the magnetic material comprises the at least one $\alpha''$-$Fe_{16}(N_xZ_{1-x})_2$ phase domain, and wherein at least about 35 volume percent of the magnetic material is the at least one $\alpha''$-$Fe_{16}(N_xZ_{1-x})_2$ phase domain.

Clause 57: The impedance matching circuit of any one of clauses 52 to 55, wherein at least about 60 volume percent of the magnetic material is the at least one $\alpha''$-$Fe_{16}(N_xZ_{1-x})_2$ phase domain.

Clause 58: The impedance matching circuit of any one of clauses 52 to 57, wherein the magnetic material comprises the at least one $\alpha''$-$Fe(N_xZ_{1-x})_2$ phase domain, wherein the at least one $\alpha''$-$Fe_{16}(N_xZ_{1-x})_2$ phase domain comprises a plurality of $\alpha''$-$Fe_{16}(N_xZ_{1-x})_2$ crystals, and wherein respective [001] axes of the plurality of crystals are randomly distributed within the magnetic material.

Clause 59: The impedance matching circuit of any one of clauses 52 to 58, wherein the magnetic material comprises the at least one $\alpha''$-$Fe_{16}N_2$ phase domain and the at least one $\alpha''$-$Fe_{16}Z_2$ phase domain, wherein the at least one $\alpha''$-$Fe_{16}N_2$ phase domain comprises a plurality of $\alpha''$-$Fe_{16}N_2$ crystals, wherein the at least one $\alpha''$-$Fe_{16}Z_2$ phase domain comprises a plurality of $\alpha''$-$Fe_{16}Z_2$ crystals, and wherein respective [001] axes of the plurality of $\alpha''$-$Fe_{16}N_2$ crystals and respective [001] axes of the plurality of $\alpha''$-$Fe_{16}Z_2$ crystals are randomly distributed within the magnetic material.

Clause 60: The impedance matching circuit of any one of clauses 52 to 59, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 35 volume percent of the magnetic material.

Clause 61: The impedance matching circuit of any one of clauses 52 to 60, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 60 volume percent of the magnetic material.

Clause 62: The impedance matching circuit of any one of clauses 52 to 61, further comprising at least one capacitor.

Clause 63: A low pass filter comprising: an inductor comprising a magnetic material comprising at least one of: at least one $\alpha''$-$Fe_{16}(N_xZ_{1-x})_2$ phase domain, wherein x is a number greater than zero and less than one; or at least one $\alpha''$-$Fe_{16}N_2$ phase domain and at least one $\alpha''$-$Fe_{16}Z_2$ phase domain, wherein Z includes at least one of C, B, or O.

Clause 64: The low pass filter of clause 63, wherein the magnetic material comprises the at least one $\alpha''$-$Fe_{16}(N_xZ_{1-x})_2$ phase domain, and wherein x is equal to about 0.5.

Clause 65: The low pass filter of clause 63 or 64, wherein the magnetic material comprises the at least one $\alpha''$-$Fe_{16}(N_xZ_{1-x})_2$ phase domain, and wherein x is equal to about 0.4667.

Clause 66: The low pass filter of any one of clauses 63 to 65, wherein Z consists of C.

Clause 67: The low pass filter of any one of clauses 63 to 66, wherein the magnetic material comprises the at least one $\alpha''$-$Fe_{16}(N_xZ_{1-x})_2$ phase domain, and wherein at least about 35 volume percent of the magnetic material is the at least one $\alpha''$-$Fe_{16}(N_xZ_{1-x})_2$ phase domain.

Clause 68: The low pass filter of any one of clauses 63 to 66, wherein at least about 60 volume percent of the magnetic material is the at least one $\alpha''$-$Fe_{16}(N_xZ_{1-x})_2$ phase domain.

Clause 69: The low pass filter of any one of clauses 63 to 68, wherein the magnetic material comprises the at least one $\alpha''$-$Fe_{16}(N_xZ_{1-x})_2$ phase domain, wherein the at least one $\alpha''$-$Fe_{16}(N_xZ_{1-x})_2$ phase domain comprises a plurality of $\alpha''$-$Fe_{16}(N_xZ_{1-x})_2$ crystals, and wherein respective [001] axes of the plurality of crystals are randomly distributed within the magnetic material.

Clause 70: The low pass filter of any one of clauses 63 to 69, wherein the magnetic material comprises the at least one $\alpha''$-$Fe_{16}N_2$ phase domain and the at least one $\alpha''$-$Fe_{16}Z_2$ phase domain, wherein the at least one $\alpha''$-$Fe_{16}N_2$ phase domain comprises a plurality of $\alpha''$-$Fe_{16}N_2$ crystals, wherein the at least one $\alpha''$-$Fe_{16}Z_2$ phase domain comprises a plurality of $\alpha''$-$Fe_{16}Z_2$ crystals, and wherein respective [001] axes of the plurality of $\alpha''$-$Fe_{16}N_2$ crystals and respective [001] axes of the plurality of $\alpha''$-$Fe_{16}Z_2$ crystals are randomly distributed within the magnetic material.

Clause 71: The low pass filter of any one of clauses 63 to 70, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 35 volume percent of the magnetic material.

Clause 72: The low pass filter of any one of clauses 63 to 71, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 60 volume percent of the magnetic material.

Clause 73: The low pass filter of any one of clauses 63 to 72, further comprising at least one capacitor.

Clause 74: The low pass filter of any one of clauses 63 to 72, further comprising at least one capacitor and at least one resistor.

Clause 75: An AC-DC converter comprising: at least one inductor comprising a magnetic material comprising at least one of: at least one $\alpha''$-$Fe_{16}(N_xZ_{1-x})_2$ phase domain, wherein x is a number greater than zero and less than one; or at least one $\alpha''$-$Fe_{16}N_2$ phase domain and at least one $\alpha''$-$Fe_{16}Z_2$ phase domain, wherein Z includes at least one of C, B, or O.

Clause 76: The AC-DC converter of clause 75, wherein the magnetic material comprises the at least one α"-$Fe_{16}(N_xZ_{1-x})_2$ phase domain, and wherein x is equal to about 0.5.

Clause 77: The AC-DC converter of clause 75 or 76, wherein the magnetic material comprises the at least one α"-$Fe_{16}(N_xZ_{1-x})_2$ phase domain, and wherein x is equal to about 0.4667.

Clause 78: The AC-DC converter of any one of clauses 75 to 77, wherein Z consists of C.

Clause 79: The AC-DC converter of any one of clauses 75 to 78, wherein the magnetic material comprises the at least one α"-$Fe_{16}(N_xZ_{1-x})_2$ phase domain, and wherein at least about 35 volume percent of the magnetic material is the at least one α"-$Fe_{16}(N_xZ_{1-x})_2$ phase domain.

Clause 80: The AC-DC converter of any one of clauses 75 to 78, wherein at least about 60 volume percent of the magnetic material is the at least one α"-$Fe_{16}(N_xZ_{1-x})_2$ phase domain.

Clause 81: The AC-DC converter of any one of clauses 75 to 80, wherein the magnetic material comprises the at least one α"-$Fe_{16}(N_xZ_{1-x})_2$ phase domain, wherein the at least one α"-$Fe_{16}(N_xZ_{1-x})_2$ phase domain comprises a plurality of α"-$Fe_{16}(N_xZ_{1-x})_2$ crystals, and wherein respective [001] axes of the plurality of crystals are randomly distributed within the magnetic material.

Clause 82: The AC-DC converter of any one of clauses 75 to 81, wherein the magnetic material comprises the at least one α"-$Fe_{16}N_2$ phase domain and the at least one α"-$Fe_{16}Z_2$ phase domain, wherein the at least one α"-$Fe_{16}N_2$ phase domain comprises a plurality of α"-$Fe_{16}N_2$ crystals, wherein the at least one α"-$Fe_{16}Z_2$ phase domain comprises a plurality of α"-$Fe_{16}Z_2$ crystals, and wherein respective [001] axes of the plurality of α"-$Fe_{16}N_2$ crystals and respective [001] axes of the plurality of α"-$Fe_{16}Z_2$ crystals are randomly distributed within the magnetic material.

Clause 83: The AC-DC converter of any one of clauses 75 to 82, wherein the magnetic material comprises the at least one α"-$Fe_{16}N_2$ phase domain and the at least one α"-$Fe_{16}Z_2$ phase domain, and wherein the at least one α"-$Fe_{16}N_2$ phase domain and the at least one α"-$Fe_{16}Z_2$ phase domain together form at least about 35 volume percent of the magnetic material.

Clause 84: The AC-DC converter of any one of clauses 75 to 83, wherein the magnetic material comprises the at least one α"-$Fe_{16}N_2$ phase domain and the at least one α"-$Fe_{16}Z_2$ phase domain, and wherein the at least one α"-$Fe_{16}N_2$ phase domain and the at least one α"-$Fe_{16}Z_2$ phase domain together form at least about 60 volume percent of the magnetic material.

Clause 85: A radio frequency energy harvesting device comprising: at least one antenna; an impedance matching circuit comprising a first inductor, wherein the first inductor comprises a magnetic material comprising at least one of: at least one α"-$Fe_{16}(N_xZ_{1-x})_2$ phase domain, wherein x is a number greater than zero and less than one: or at least one α"-$Fe_{16}N_2$ phase domain and at least one α"-$Fe_{16}Z_2$ phase domain, wherein Z includes at least one of C, B, or O; and an AC-DC converter.

Clause 86: The radio frequency energy harvesting device of clause 85, wherein the AC-DC converter comprises a second inductor, and wherein the second inductor comprises a magnetic material comprising at least one of: at least one α"-$Fe(N_xZ_{1-x})_2$ phase domain, wherein x is a number greater than zero and less than one; or at least one α"-$Fe_{16}N_2$ phase domain and at least one α"-$Fe_{16}Z_2$ phase domain, wherein Z includes at least one of C, B, or O.

Clause 87: The radio frequency energy harvesting device of clause 85 or 86, further comprising a low pass filter comprising a third inductor, wherein the third inductor comprises a magnetic material comprising at least one of: at least one α"-$Fe_{16}(N_xZ_{1-x})_2$ phase domain, wherein x is a number greater than zero and less than one; or at least one α"-$Fe_{16}N_2$ phase domain and at least one α"-$Fe_{16}Z_2$ phase domain, wherein Z includes at least one of C, B, or O.

Clause 88: The radio frequency energy harvesting device of any one of clauses 85 to 87, further comprising an energy storage element.

Clause 89: The radio frequency energy harvesting device of any one of clauses 85 to 88, wherein the antenna comprises a magnetic material comprising at least one of: at least one α"-$Fe_{16}(N_xZ_{1-x})_2$ phase domain, wherein x is a number greater than zero and less than one; or at least one α"-$Fe_{16}N_2$ phase domain and at least one α"-$Fe_{16}Z_2$ phase domain, wherein Z includes at least one of C, B, or O.

Clause 90: The radio frequency energy harvesting device of clause 89, wherein the antenna comprises a multiband antenna.

Clause 91: The radio frequency energy harvesting device of clause 89, wherein the antenna comprises a multipole antenna.

Clause 92: The radio frequency energy harvesting device of clause 89, wherein the antenna comprises a wideband antenna.

Clause 93: The radio frequency energy harvesting device of clause 89, wherein the antenna comprises a reconfigurable antenna.

Clause 94: The radio frequency energy harvesting device of any one of clauses 89 to 93, wherein the antenna is configured to receive a signal having a frequency of at least one of about 13.56 MHz, about 700 MHz, about 750 MHz, about 800 MHz, about 850 MHz, about 915 MHz, about 1.7 GHz, about 1.8 GHz, about 1.9 GHz, about 2.1 GHz, or about 2.4 GHz.

Clause 95: The radio frequency energy harvesting device of any one of clauses 89 to 93, wherein the antenna is configurable to receive a signal having a frequency of at least one of about 13.56 MHz, about 915 MHz, or about 1.8 GHz.

Clause 96: The radio frequency energy harvesting device of any one of clauses 85 to 95, wherein the magnetic material comprises the at least one α"-$Fe_{16}(N_xZ_{1-x})_2$ phase domain, and wherein x is equal to about 0.5.

Clause 97: The radio frequency energy harvesting device of any one of clauses 85 to 96, wherein the magnetic material comprises the at least one α"-$Fe_{16}(N_xZ_{1-x})_2$ phase domain, and wherein x is equal to about 0.4667.

Clause 98: The radio frequency energy harvesting device of any one of clauses 85 to 97, wherein Z consists of C.

Clause 99: The radio frequency energy harvesting device of any one of clauses 85 to 98, wherein the magnetic material comprises the at least one α"-$Fe_{16}(N_xZ_{1-x})_2$ phase domain, and wherein at least about 35 volume percent of the magnetic material is the at least one α"-$Fe_{16}(N_xZ_{1-x})_2$ phase domain.

Clause 100: The radio frequency energy harvesting device of any one of clauses 85 to 98, wherein at least about 60 volume percent of the magnetic material is the at least one α"-$Fe_{16}(N_xZ_{1-x})_2$ phase domain.

Clause 101: The radio frequency energy harvesting device of any one of clauses 85 to 100, wherein the magnetic material comprises the at least one α"-$Fe_{16}(N_xZ_{1-x})_2$ phase domain, wherein the at least one α"-$Fe_{16}(N_xZ_{1-x})_2$ phase domain comprises a plurality of α"-$Fe_{16}(N_xZ_{1-x})_2$ crystals, and wherein respective [001] axes of the plurality of crystals are randomly distributed within the magnetic material.

Clause 102: The radio frequency energy harvesting device of any one of clauses 85 to 101, wherein the magnetic material comprises the at least one $\alpha''$-$Fe_{16}N_2$ phase domain and the at least one $\alpha''$-$Fe_{16}Z_2$ phase domain, wherein the at least one $\alpha''$-$Fe_{16}N_2$ phase domain comprises a plurality of $\alpha''$-$Fe_{16}N_2$ crystals, wherein the at least one $\alpha''$-$Fe_{16}Z_2$ phase domain comprises a plurality of $\alpha''$-$Fe_{16}Z_2$ crystals, and wherein respective [001] axes of the plurality of $\alpha''$-$Fe_{16}N_2$ crystals and respective [001] axes of the plurality of $\alpha''$-$Fe_{16}Z_2$ crystals are randomly distributed within the magnetic material.

Clause 103: The radio frequency energy harvesting device of any one of clauses 85 to 102, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 35 volume percent of the magnetic material.

Clause 104: The radio frequency energy harvesting device of any one of clauses 85 to 103, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 60 volume percent of the magnetic material.

Clause 105: A transformer core comprising: a magnetic material comprising at least one of: at least one $\alpha''$-$Fe_{16}(N_xZ_{1-x})_2$ phase domain, wherein x is a number greater than zero and less than one; or at least one $\alpha''$-$Fe_{16}N_2$ phase domain and at least one $\alpha''$-$Fe_{16}Z_2$ phase domain, wherein Z includes at least one of C, B, or O.

Clause 106: The transformer core of clause 105, wherein the magnetic material comprises the at least one $\alpha''$-$Fe_{16}(N_xZ_{1-x})_2$ phase domain, and wherein x is equal to about 0.5.

Clause 107: The transformer core of clause 105 or 106, wherein the magnetic material comprises the at least one $\alpha''$-$Fe_{16}(N_xZ_{1-x})_2$ phase domain, and wherein x is equal to about 0.4667.

Clause 108: The transformer core of any one of clauses 105 to 107, wherein Z consists of C.

Clause 109: The transformer core of any one of clauses 105 to 108, wherein the magnetic material comprises the at least one $\alpha''$-$Fe_{16}(N_xZ_{1-x})_2$ phase domain, and wherein at least about 35 volume percent of the magnetic material is the at least one $\alpha''$-$Fe_{16}(N_xZ_{1-x})_2$ phase domain.

Clause 110: The transformer core of any one of clauses 105 to 108, wherein at least about 60 volume percent of the magnetic material is the at least one $\alpha''$-$Fe_{16}(N_xZ_{1-x})_2$ phase domain.

Clause 111: The transformer core of any one of clauses 105 to 110, wherein the magnetic material comprises the at least one $\alpha''$-$Fe_{16}(N_xZ_{1-x})_2$ phase domain, wherein the at least one $\alpha''$-$Fe_{16}(N_xZ_{1-x})_2$ phase domain comprises a plurality of $\alpha''$-$Fe_{16}(N_xZ_{1-x})_2$ crystals, and wherein respective [001] axes of the plurality of crystals are randomly distributed within the magnetic material.

Clause 112: The transformer core of any one of clauses 105 to 111, wherein the magnetic material comprises the at least one $\alpha''$-$Fe_{16}N_2$ phase domain and the at least one $\alpha''$-$Fe_{16}Z_2$ phase domain, wherein the at least one $\alpha''$-$Fe_{16}N_2$ phase domain comprises a plurality of $\alpha''$-$Fe_{16}N_2$ crystals, wherein the at least one $\alpha''$-$Fe_{16}Z_2$ phase domain comprises a plurality of $\alpha''$-$Fe_{16}Z_2$ crystals, and wherein respective [001] axes of the plurality of $\alpha''$-$Fe_{16}N_2$ crystals and respective [001] axes of the plurality of $\alpha''$-$Fe_{16}Z_2$ crystals are randomly distributed within the magnetic material.

Clause 113: The transformer core of any one of clauses 105 to 112, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 35 volume percent of the magnetic material.

Clause 114: The transformer core of any one of clauses 105 to 113, wherein the magnetic material comprises the at least one $\alpha''$-$Fe_{16}N_2$ phase domain and the at least one $\alpha''$-$Fe_{16}Z_2$ phase domain, and wherein the at least one $\alpha''$-$Fe_{16}N_2$ phase domain and the at least one $\alpha''$-$Fe_{16}Z_2$ phase domain together form at least about 60 volume percent of the magnetic material.

Clause 115: The transformer core of any one of clauses 105 to 113, wherein an average grain size of the magnetic material is less than about 20 micrometers.

Clause 116: The transformer core of any one of clauses 105 to 114, wherein an average grain size of the magnetic material is less than about 1 micrometer.

Clause 117: The transformer core of any one of clauses 105 to 116, wherein a saturation magnetization of the magnetic material is greater than about 2.88 T.

Clause 18: The transformer core of any one of clauses 105 to 117, wherein a resistivity of the magnetic material is greater than about 120 μΩcm.

Clause 119: The transformer core of any one of clauses 105 to 118, wherein the magnetic material comprises a plurality of workpieces, further comprising an electrically insulating binder that binds the plurality of workpieces.

Clause 120: The transformer core of clause 19, wherein the plurality of workpieces comprise particles, ribbons, wires, sheets, films, or the like.

Clause 121: The transformer core of clause 119 or 120, wherein the electrically insulating binder comprises at least one of an oxide, a phosphate, a sulfide, or a resin.

Clause 122: A method comprising: forming a plurality of workpieces, wherein at least one of workpieces comprises at least one $\alpha''$-$Fe_{16}(N_xZ_{1-x})_2$ phase domain, wherein x is a number greater than zero and less than one; or at least one $\alpha''$-$Fe_{16}N_2$ phase domain and at least one $\alpha''$-$Fe_{16}Z_2$ phase domain, wherein Z includes at least one of C, B, or O; and consolidating the plurality of workpieces to form a transformer core comprising the at least one $\alpha''$-$Fe_{16}(N_xZ_{1-x})_2$ phase domain, wherein x is a number greater than zero and less than one or the at least one $\alpha''$-$Fe_{16}N_2$ phase domain and at least one $\alpha''$-$Fe_{16}Z_2$ phase domain, wherein Z includes at least one of C, B, or O.

Clause 123: The method of clause 122, wherein forming the plurality of workpieces comprises milling an iron-containing material in the presence of a carbon source and a nitrogen source.

Clause 124: The method of clause 122, wherein forming the plurality of workpieces comprises melt spinning a mixture comprising iron, carbon, and nitrogen.

Clause 125: The method of any one of clauses 122 to 124, wherein consolidating the plurality of workpieces utilizes at least one of cold compression or shock compression.

Clause 126: The method of clause 125, further comprising introducing an electrically insulating binder between at least some workpieces of the plurality of workpieces prior to consolidating the plurality of workpieces.

Clause 127: The method of clause 126, wherein the electrically insulating binder comprises at least one of an oxide, a phosphate, a sulfide, or a resin.

EXAMPLES

Figure 17:
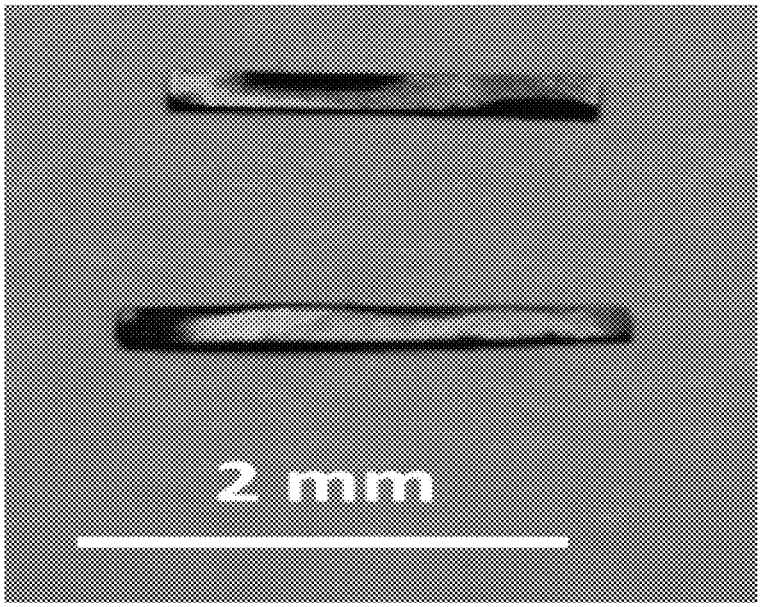
FIG. 17 is a photograph illustrating bulk samples including $\alpha''$-$Fe_{16}(N_xC_{1-x})_2$ phase domains.
Figure 18:
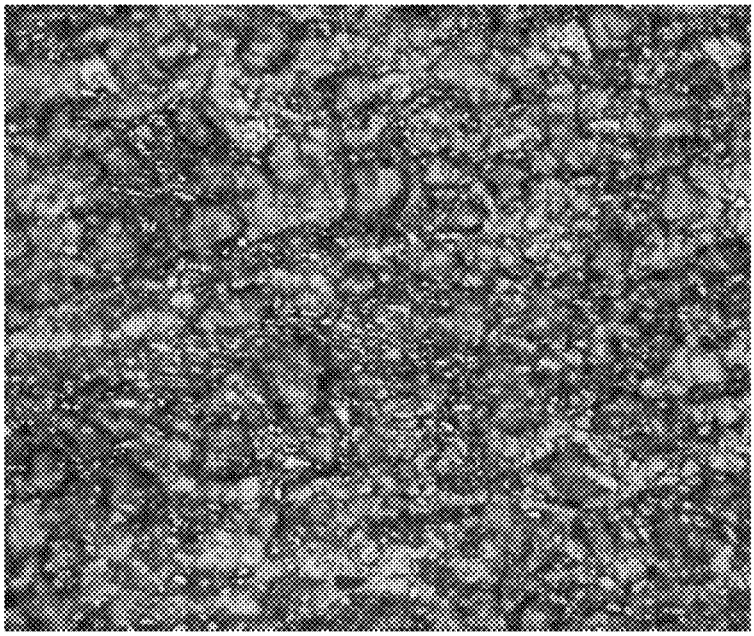
FIG. 18 is a cross-sectional micrograph illustrating the microstructure of a bulk sample including $\alpha''$-$Fe_{16}(N_xC_{1-x})_2$ phase domains.

Samples including $\alpha''$-$Fe_{16}(N_xC_{1-x})_2$ phase domains was prepared using a cold crucible technique. FIG. 17 is a photograph illustrating the bulk samples including $\alpha''$-$Fe_{16}(N_xC_{1-x})_2$ phase domains. As shown in FIG. 17, the samples were rods or needles with a length of about 2 mm. FIG. 18 is a cross-sectional micrograph illustrating the microstructure of one of the bulk samples including $\alpha''$-$Fe_{16}(N_xC_{1-x})_2$ phase domains.

Figure 19:
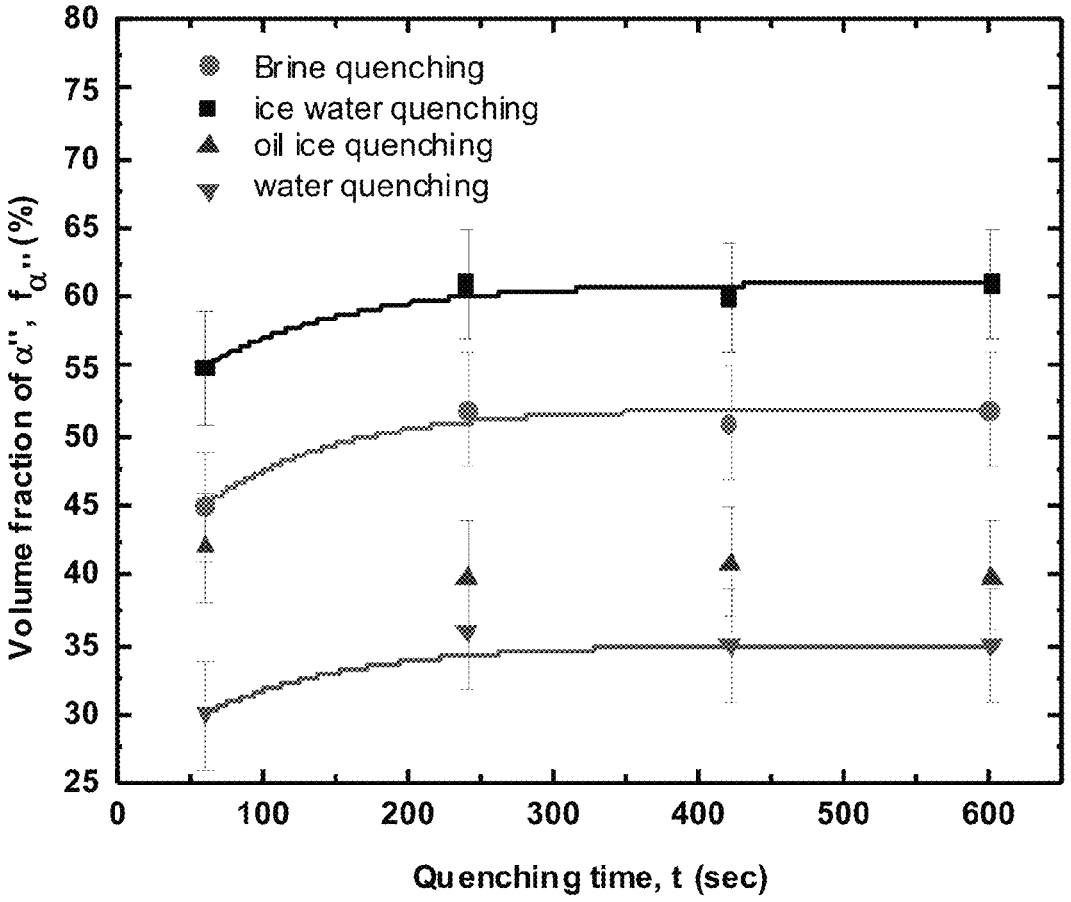
FIG. 19 is a plot of volume fraction of $\alpha''$-$Fe_{16}(N_xC_{1-x})_2$ phase domains in bulk samples for each of four different quenching media.

FIG. 19 is a plot of volume fraction of $\alpha''$-$Fe_{16}(N_xC_{1-x})_2$ phase domains in bulk samples for each of four different quenching media as a function of quenching time. To generate the results shown in FIG. 19, the samples were annealed at a temperature of about 180° C. for about 10 hours. For the samples labeled 1 (downward pointing triangles), the quenching medium was substantially pure water. For the samples labeled 2 (squares), the quenching medium was oil. For the samples labeled 3 (upward pointing triangles), the quenching medium was brine. For the samples labeled 4 (circles), the quenching medium was ice water. As shown in FIG. 19, quenching in ice water provided the highest volume fraction of $\alpha''$-$Fe_{16}(N_xC_{1-x})_2$ of the four quenching media tested.

Figure 20:
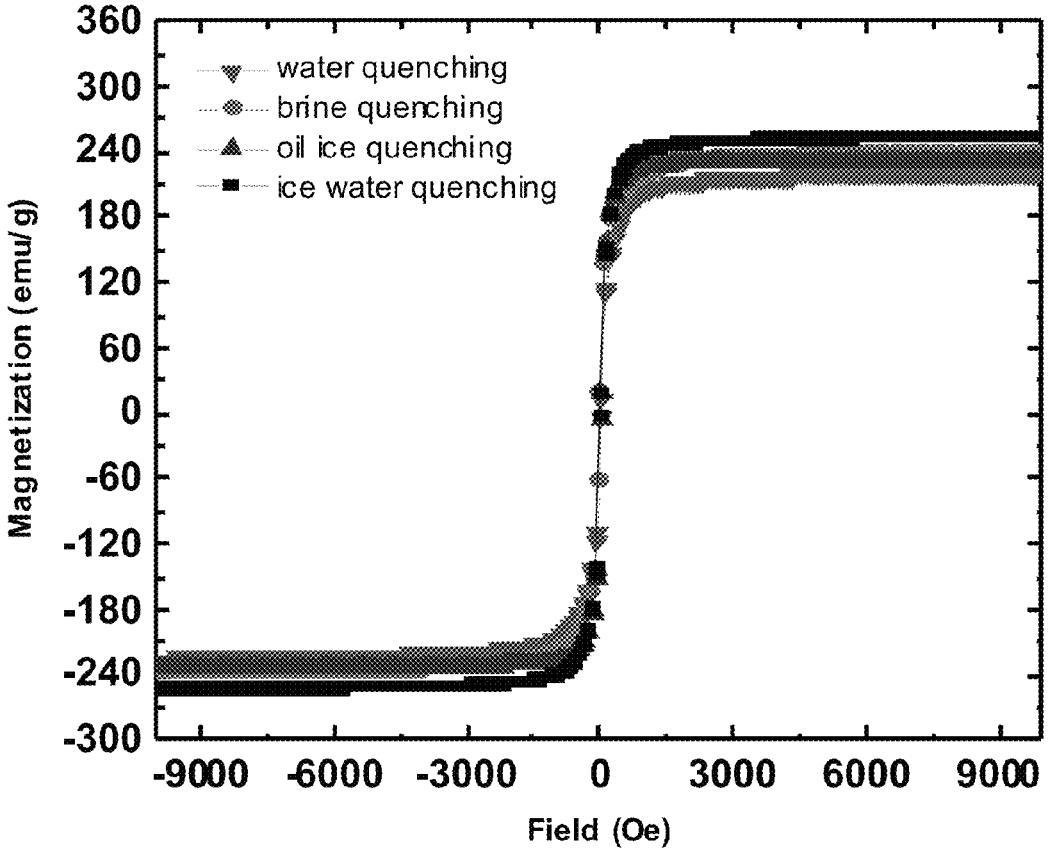
FIG. 20 is a plot of magnetization versus applied field for samples similar to those used to generate the data for FIG. 11.
Figure 21:
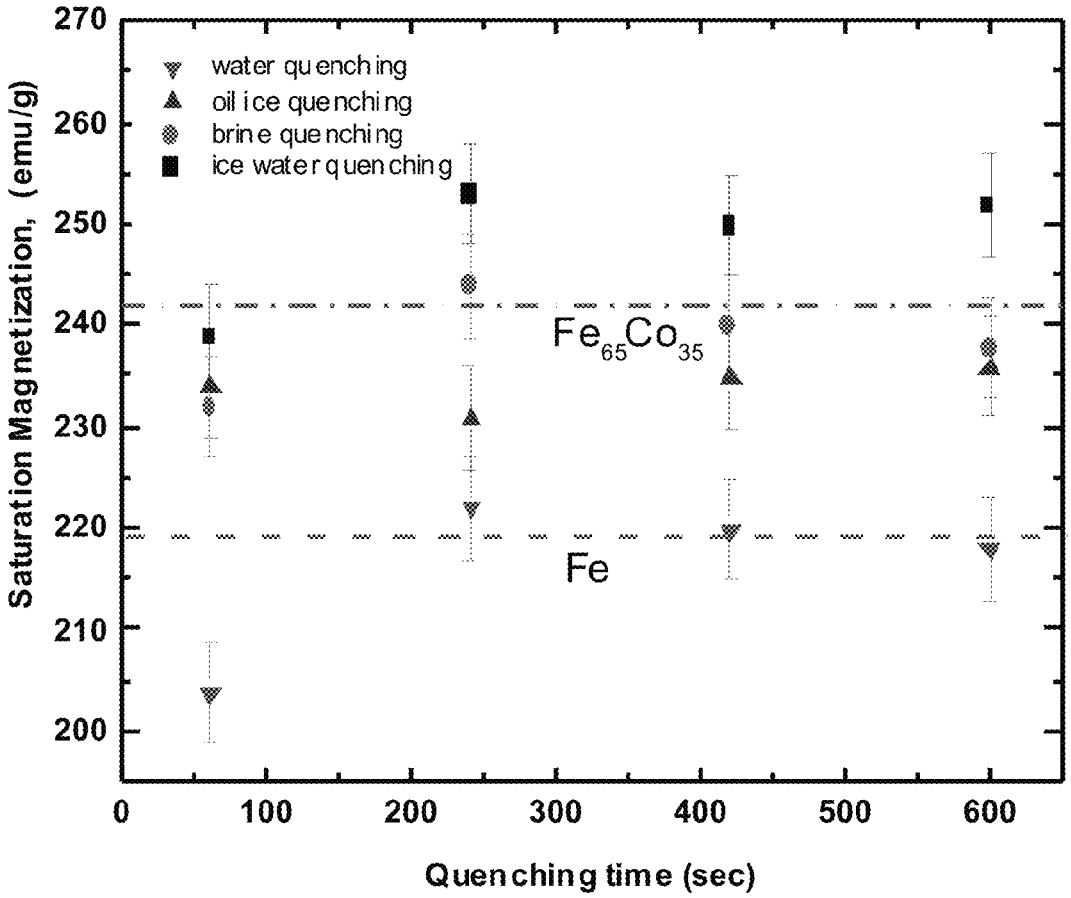
FIG. 21 is a plot of saturation magnetization versus quenching time for samples similar to those used to generate the data for FIG. 11.

FIG. 20 is a plot of magnetization versus applied field for samples similar to those used to generate the data for FIG. 19. FIG. 21 is a plot of saturation magnetization versus quenching time for samples similar to those used to generate the data for FIG. 19. As shown in FIGS. 20 and 21, each of the samples had a saturation magnetization above about 204 emu/g, and most of the samples had a saturation magnetization above about 220 emu/g. For samples quenched in ice water for greater than about 200 seconds, the saturation magnetization was above about 250 emu/g. FIG. 20 also shows that the coercivity of the samples is relatively low, near zero. Further, FIG. 20 shows that magnetic saturation was reached relatively quickly, which indicates that the samples possess relatively high permeability.

Figure 22:
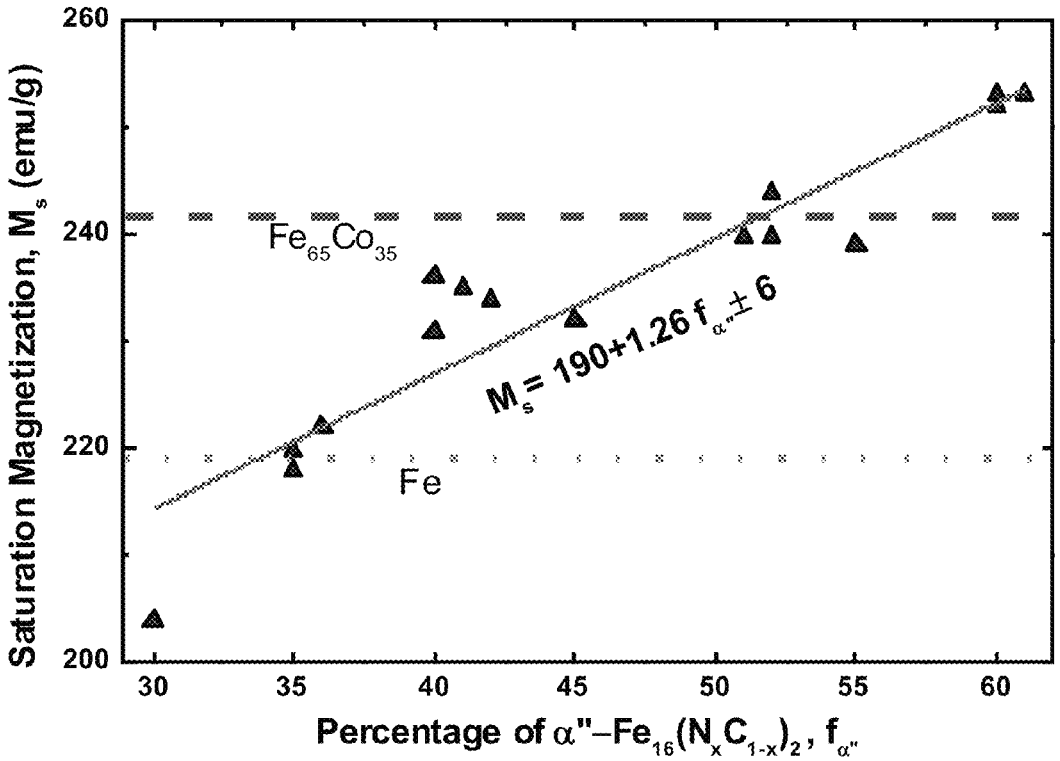
FIG. 22 is a scatter plot of saturation magnetization versus volume fraction of $\alpha''$-$Fe_{16}(N_xC_{1-x})_2$ phase domains in the sample.

FIG. 22 is a scatter plot of saturation magnetization versus volume fraction of $\alpha''$-$Fe_{16}(N_xC_{1-x})_2$ phase domains in the sample. The plot illustrated in FIG. 22 also includes a linear regression line. FIG. 22 shows that the saturation magnetization increases with increasing volume fraction of $\alpha''$-$Fe_{16}(N_xC_{1-x})_2$ phase domains in the sample.

When ranges are used herein for physical properties, such as molecular weight, or chemical properties, such as chemical formulae, all combinations and subcombinations of ranges for specific examples therein are intended to be included.

Various examples have been described. Those skilled in the art will appreciate that numerous changes and modifications can be made to the examples described in this disclosure and that such changes and modifications can be made without departing from the spirit of the disclosure. These and other examples are within the scope of the following claims.

Fe—(C—N) films for antennas or inductors may be fabricated using a facing-targets type DC sputtering method. Fe—C binary alloys with C contents of 0.17, 0.29, 0.79, 2, 3, 4, 6, 8, 10, and 12% will be used as sputtering targets. Silicon {1 0 0} single-crystal substrates will be used. The base pressure of the sputtering chamber will be below $3\times10^{-7}$ Torr. Mixed Ar and $N_2$ gas will be introduced to the chamber at a total 5 sccm with various $N_2$ flow ratios which will be controlled from 0 to 20% under total pressure of 10 mTorr. Before the deposition of Fe—(C—N) films, the substrates will be baked at 200° C. for 2 h, and a 50-Angstrom-thick Fe layer will be deposited onto the silicon substrates as an underlayer in a pure Ar plasma. Then, the substrates will cooled to room temperature. The Fe—(C—N) films with 3000 Angstrom thickness will be successively deposited onto the Fe underlayer.

The disclosure of each patent, patent application, and publication cited or described in this document are hereby incorporated herein by reference, in its entirety.

What is claimed is:

1. A device comprising:

a substrate;

a dielectric or insulator layer on the substrate; and an inductor on the dielectric or insulator layer, wherein the inductor comprises a magnetic material comprising at least one of:

a plurality of $\alpha''$-$Fe_{16}(N_xZ_{1-x})_2$ or $\alpha'$-$Fe_8(N_xZ_{1-x})$ phase domain, wherein x is a number greater than zero and less than one, and wherein respective [001] axes of the plurality of $\alpha''$-$Fe_{16}(N_xZ_{1-x})_2$ or $\alpha'$-$Fe_8(N_xZ_{1-x})$ phase domains are randomly distributed within the magnetic material; or a plurality of $\alpha''$-$Fe_{16}N_2$ or $\alpha'$-$Fe_8N$ phase domains and a plurality of $\alpha''$-$Fe_{16}Z_2$ or $\alpha'$-$Fe_8Z$ phase domains, wherein Z includes at least one of C, B, or O, and wherein respective [001] axes of the plurality of $\alpha''$-$Fe_{16}N_2$ or $\alpha'$-$Fe_8N$ phase domains and respective [001] axes of the plurality of $\alpha''$-$Fe_{16}Z_2$ or $\alpha'$-$Fe_8Z$ phase domains are randomly distributed within the magnetic material.

2. The device of claim 1, wherein the inductor comprises a core, and wherein the core comprises the magnetic material.

3. The device of claim 2, wherein the core comprises a substantially planar spiral portion.

4. The device of claim 2, wherein the core comprises a plurality of substantially planar spiral portions.

5. The device of claim 2, wherein the magnetic material comprises the plurality of $\alpha''$-$Fe_{16}(N_xZ_{1-x})_2$ or $\alpha'$-$Fe_8(N_xZ_{1-x})$ phase domains, and wherein x is equal to about 0.5.

6. The device of claim 2, wherein the magnetic material comprises the plurality of $\alpha''$-$Fe_{16}(N_xZ_{1-x})_2$ or $\alpha'$-$Fe_8(N_xZ_{1-x})$ phase domain, and wherein x is equal to about 0.4667.

7. The device of claim 2, wherein Z consists of C.

8. The device of claim 2, wherein the magnetic material comprises a saturation magnetization of at least about 200 emu/gram.

9. The device of claim 2, wherein the magnetic material comprises a saturation magnetization of greater than about 250 emu/gram.

10. The device of claim 2, wherein the magnetic material comprises a magnetic coercivity of less than or equal to about 10 Oerstads.

11. The device of claim 2, wherein the magnetic material comprises the plurality of $\alpha''$-$Fe_{16}(N_xZ_{1-x})_2$ or $\alpha'$-$Fe_8(N_xZ_{1-x})$ phase domains, and wherein at least about 35 volume percent of the magnetic material is the plurality of $\alpha''$-$Fe_{16}(N_xZ_{1-x})_2$ or $\alpha'$-$Fe_8(N_xZ_{1-x})$ phase domains.

12. The device of claim 2, wherein at least about 60 volume percent of the magnetic material is the plurality of $\alpha''$-$Fe_{16}(N_xZ_{1-x})_2$ or $\alpha'$-$Fe_8(N_xZ_{1-x})$ phase domains.

13. The device of claim 2, wherein the magnetic material comprises the plurality of $\alpha''$-$Fe_{16}N_2$ or $\alpha'$-$Fe_8N$ phase domains and the plurality of $\alpha''$-$Fe_{16}Z_2$ or $\alpha'$-$Fe_8Z$ phase domains, and wherein the plurality of $\alpha''$-$Fe_{16}N_2$ or $\alpha'$-$Fe_8N$ phase domains and the plurality of $\alpha''$-$Fe_{16}Z_2$ or $\alpha'$-$Fe_8Z$ phase domains together form at least about 35 volume percent of the magnetic material.

14. The device of claim 2, wherein the magnetic material comprises the plurality of $\alpha''$-$Fe_{16}N_2$ or $\alpha'$-$Fe_8N$ phase domains and the plurality of $\alpha''$-$Fe_{16}Z_2$ or $\alpha'$-$Fe_8Z$ phase domains, and wherein the plurality of $\alpha''$-$Fe_{16}N_2$ or $\alpha'$-$Fe_8N$ phase domains and the plurality of $\alpha''$-$Fe_{16}Z_2$ or $\alpha'$-$Fe_8Z$ phase domains together form at least about 60 volume percent of the magnetic material.

15. The device of claim 2, further comprising an impedance matching circuit, wherein the impedance matching circuit comprises the inductor.

16. The device of claim 2, further comprising a low pass filter, wherein the low pass filter comprises the inductor.

17. The device of claim 2, further comprising an AC-DC converter, wherein the AC-DC converter comprises the inductor.

18. The device of claim 2, further comprising an antenna, wherein the antenna comprises a magnetic material comprising at least one of:

at least one $\alpha''$-$Fe_{16}(N_xZ_{1-x})_2$ or $\alpha'$-$Fe_8(N_xZ_{1-x})$ phase domains, wherein x is a number greater than zero and less than one; or at least one $\alpha''$-$Fe_{16}N_2$ or $\alpha'$-$Fe_8N$ phase domain and at least one $\alpha''$-$Fe_{16}Z_2$ or $\alpha'$-$Fe_8Z$ phase domain, wherein Z includes at least one of C, B, or O.

19. The device of claim 18, wherein the antenna comprises a multiband antenna.

20. The device of claim 2, further comprising a radio frequency energy harvesting device, wherein the radio frequency energy harvesting device comprises the inductor.

21. A method comprising:

forming a dielectric or insulator layer on a substrate; and forming an inductor on the dielectric or insulator layer, wherein a core of the inductor comprises a magnetic material comprising at least one of:

a plurality of $\alpha''$-$Fe_{16}(N_xZ_{1-x})_2$ phase domains, wherein x is a number greater than zero and less than one, and wherein respective [001] axes of the plurality of $\alpha''$-$Fe_{16}(N_xZ_{1-x})_2$ phase domains are randomly distributed within the magnetic material; or a plurality of $\alpha''$-$Fe_{16}N_2$ phase domain and plurality of $\alpha''$-$Fe_{16}Z_2$ phase domains, wherein Z includes at least one of C, B, or O, and wherein respective [001] axes of the plurality of $\alpha''$-$Fe_{16}N_2$ phase domains and respective [001] axes of the plurality of $\alpha''$-$Fe_{16}N_2$ phase domains are randomly distributed within the magnetic material.

22. The method of claim 21, wherein forming the inductor comprises:

heating an iron source to form a vapor comprising an iron-containing compound;

depositing iron from the vapor comprising the iron-containing compound, nitrogen from a vapor comprising a nitrogen-containing compound, and at least one of carbon, boron, or oxygen from a vapor comprising the compound containing the at least one of carbon, boron, or oxygen on the dielectric or insulator layer to form a layer comprising iron, nitrogen, and the at least one of carbon, boron, or oxygen; and annealing the layer comprising iron, nitrogen, and the at least one of carbon, boron, or oxygen to form the inductor.

23. The method of claim 21, wherein forming the inductor comprises:

submerging a dielectric or insulator layer on a substrate in a coating solution comprising a nitrogen-containing solvent, an iron source, and a carbon source, wherein the coating solution is saturated with the iron source at a first temperature above a liquidus temperature of an iron-carbon-nitrogen mixture to be deposited from the coating solution;

cooling the coating solution to a second temperature to form a supersaturated coating solution, wherein the second temperature is below the liquidus temperature of the iron-carbon-nitrogen mixture;

maintaining the substrate in the supersaturated coating solution to allow a coating comprising iron, carbon, and nitrogen to form on the substrate; and annealing the coating comprising iron, carbon, and nitrogen to form the inductor.

24. The method of claim 22, further comprising:

defining a depression in the dielectric or insulator layer corresponding to a shape of at least part of the inductor;

wherein forming the inductor on the dielectric or insulator layer comprises forming the inductor in the depression.

25. The method of claim 23, further comprising:

defining a depression in the dielectric or insulator layer corresponding to a shape of at least part of the inductor;

wherein forming the inductor on the dielectric or insulator layer comprises forming the inductor in the depression.

26. The method of claim 22, wherein forming an inductor on the dielectric or insulator layer comprises:

forming a layer comprising the magnetic material on the dielectric or insulator layer; and etching the layer comprising the magnetic material to define a shape of at least part of the inductor.

27. The method of claim 23, wherein forming an inductor on the dielectric or insulator layer comprises:

forming a layer comprising the magnetic material on the dielectric or insulator layer; and etching the layer comprising the magnetic material to define a shape of at least part of the inductor.

28. The method of claim 21, further comprising forming an impedance matching circuit, wherein the impedance matching circuit comprises the inductor.

29. The method of claim 21, further comprising forming a low pass filter, wherein the low pass filter comprises the inductor.

30. The method of claim 21, further comprising forming an AC-DC converter, wherein the AC-DC converter comprises the inductor.

31. The method of claim 21, further comprising forming an antenna on the dielectric or insulator layer, wherein the antenna comprises a magnetic material comprising at least one of:

at least one $\alpha''$-$Fe_{16}(N_xZ_{1-x})_2$ or $\alpha'$-$Fe_8(N_xZ_{1-x})$ phase domain, wherein x is a number greater than zero and less than one; or at least one $\alpha''$-$Fe_{16}N_2$ or $\alpha'$-$Fe_8N$ phase domain and at least one $\alpha''$-$Fe_{16}Z_2$ or $\alpha'$-$Fe_8Z$ phase domain, wherein Z includes at least one of C, B, or O.

32. The method of claim 31, wherein the antenna comprises a multiband antenna.

33. The method of claim 31, further comprising forming a radio frequency energy harvesting device, wherein the radio frequency energy harvesting device comprises the inductor.

* * * * *